United States Patent [19]

Takamatsu et al.

[11] Patent Number: 4,974,020

[45] Date of Patent: Nov. 27, 1990

[54] REMOVABLE DEVELOPING UNITS FOR A COPYING MACHINE AND DISPLAY FOR INDICATING THE USEFUL LIFE OF THE MACHINE

[75] Inventors: Junichi Takamatsu; Kazunori Akiyama, both of Osaka, Japan

[73] Assignee: Mita Industrial Co., Japan

[21] Appl. No.: 99,815

[22] Filed: Sep. 22, 1987

[30] Foreign Application Priority Data

| | | | |
|---|---|---|---|
| Sep. 30, 1986 | [JP] | Japan | 61-233863 |
| Oct. 14, 1986 | [JP] | Japan | 61-242004 |
| Oct. 21, 1986 | [JP] | Japan | 61-248436 |
| Oct. 22, 1986 | [JP] | Japan | 61-249735 |
| Oct. 28, 1986 | [JP] | Japan | 61-254722 |

[51] Int. Cl.[5] ..... G03G 21/00; G03G 15/06

[52] U.S. Cl. ..... 355/208; 355/245; 355/296; 355/299

[58] Field of Search ..... 355/3 R, 3 DD, 4, 203, 355/206, 208, 209, 245, 296, 299; 222/DIG. 1; 206/216, 578

[56] References Cited

U.S. PATENT DOCUMENTS

| | | | |
|---|---|---|---|
| 4,089,601 | 5/1978 | Navone | 355/208 X |
| 4,281,918 | 8/1981 | Fortmann | 355/3 R |
| 4,349,132 | 9/1982 | Macaluso et al. | 222/DIG. 1 |
| 4,367,944 | 1/1983 | Kuru | 355/6 X |
| 4,500,195 | 2/1985 | Hosono | 355/3 R |
| 4,523,834 | 6/1985 | Pelda et al. | 355/3 DD |
| 4,538,897 | 9/1985 | Osaka et al. | 355/3 DD |
| 4,551,000 | 11/1985 | Kanemitsu et al. | 355/3 R |
| 4,579,443 | 4/1986 | Abuyama et al. | 355/4 |
| 4,602,864 | 7/1986 | Kimura et al. | 355/299 |
| 4,605,299 | 8/1986 | Mochimaru | 355/3 R |
| 4,666,290 | 5/1987 | Yoshiura | 355/209 |
| 4,702,591 | 10/1987 | Tsuda et al. | 355/3 DD X |
| 4,740,808 | 4/1988 | Kasamura et al. | 355/4 X |
| 4,742,372 | 5/1988 | Takahashi | 355/3 DD X |
| 4,771,313 | 9/1988 | Kuroda et al. | 355/203 |
| 4,803,521 | 2/1989 | Honda | 355/245 X |

*Primary Examiner*—Fred L. Braun

[57] ABSTRACT

An image-forming machine, such as an electrostatic copying machine, having a number of optional features. A display device is provided for displaying the number or type of toner cartridge loaded in the main body of a developing device. An image-forming condition adjusting device is provided for adjusting the image-forming conditions in response to a toner cartridge loaded in the main body. A life signal producing device is provided for signaling the end of the service life of the electrostatographic material. The life signal is produced in response to a cartridge replacement signal and a final cartridge signal. Alternatively, the life signal is produced in response to a final cartridge signal and either a signal indicating a predetermined number of rotations of the image-bearing member or a cartridge replacement signal, whichever is produced earlier. A toner removing blade is held at a non-operating position when a process unit is detached from the image-forming machine and positioned in a unit holding box. When a predetermined number of toner cartridges have been selectively loaded and detached into and from the developing device, loading of a new toner cartridge is prevented. When a cartridge has been loaded and detached into and from the main body of the developing device, loading of another toner cartridge of the same type is prevented.

48 Claims, 33 Drawing Sheets

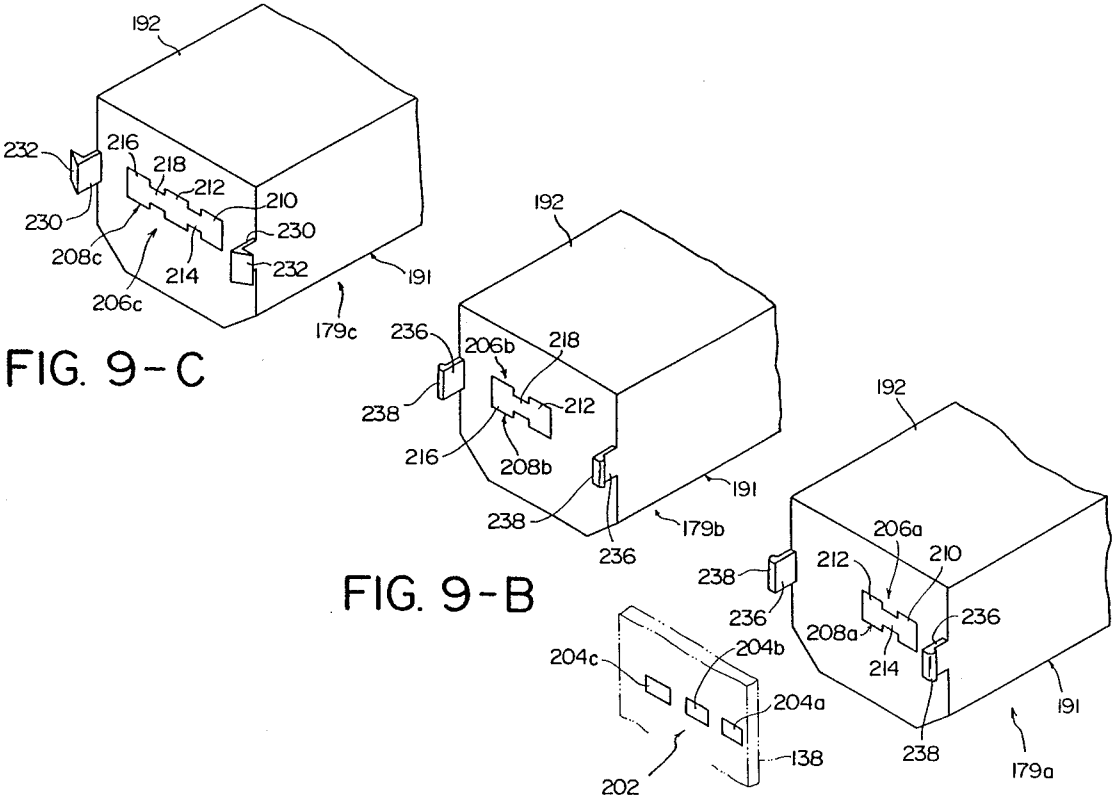
FIG. 9-A
FIG. 9-B
FIG. 9-C

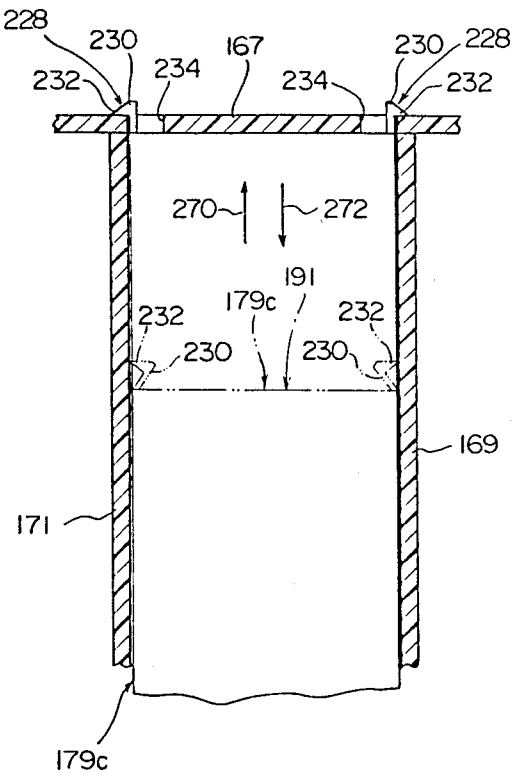
FIG. 10-B
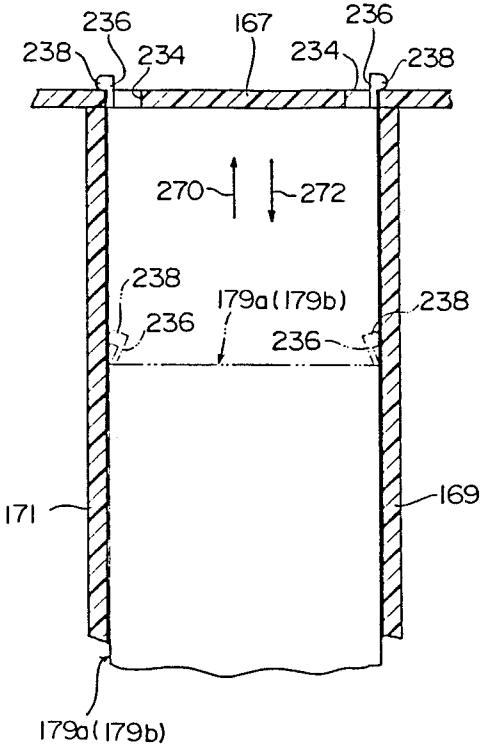
FIG. 10-A

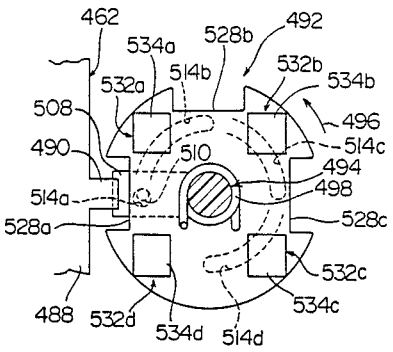
FIG. 19-A
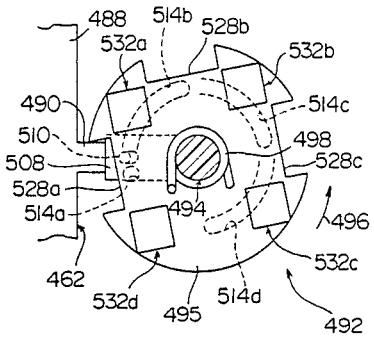
FIG. 19-B
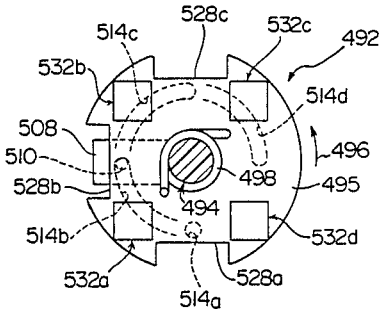
FIG. 19-C

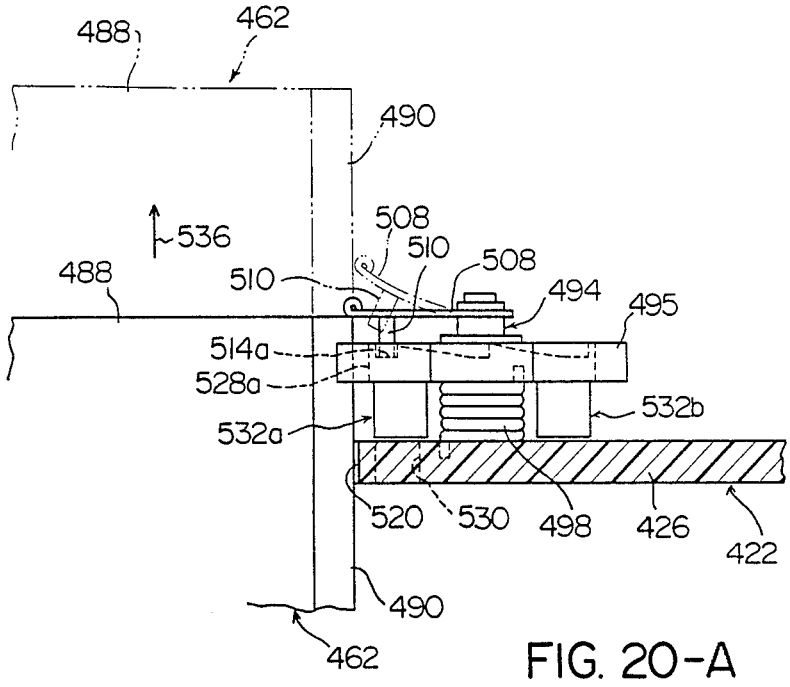
FIG. 20-A
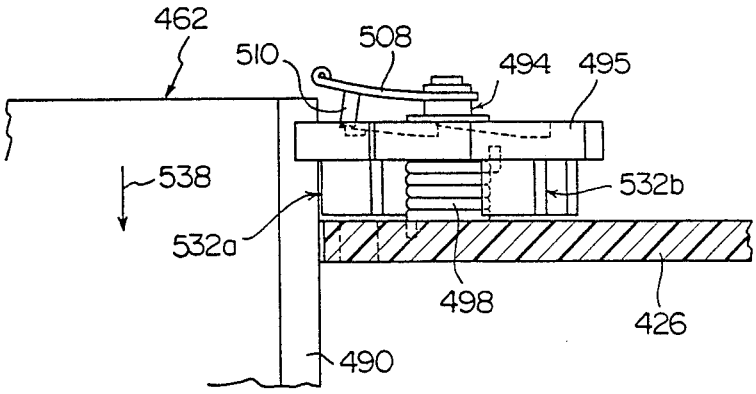
FIG. 20-B

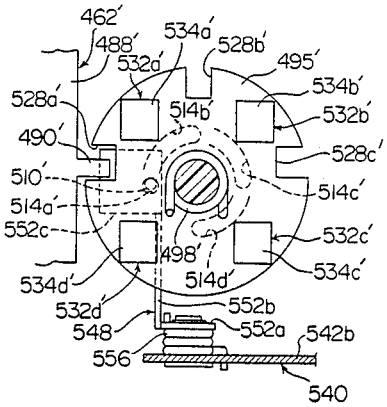
FIG. 22-A
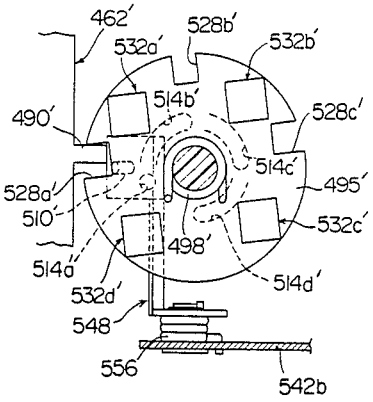
FIG. 22-B
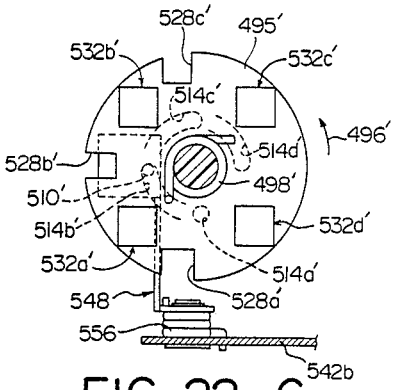
FIG. 22-C

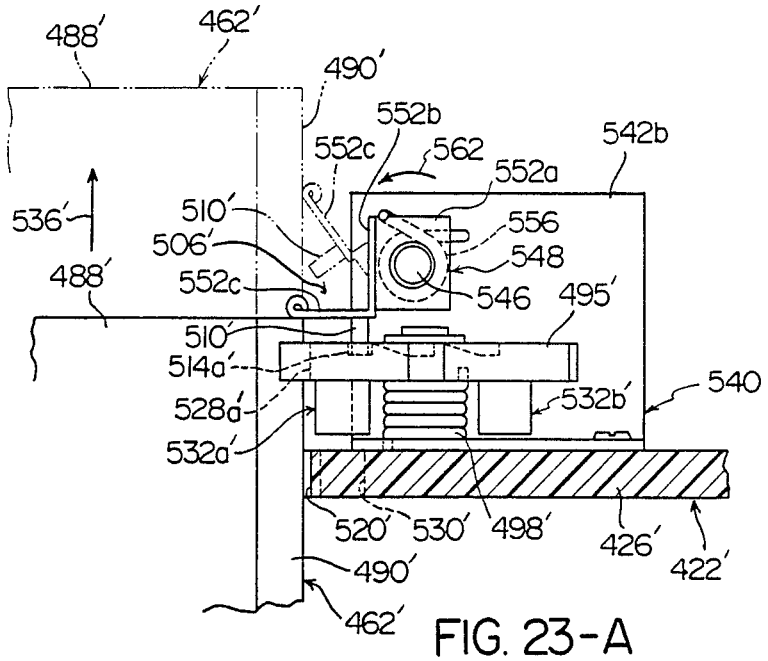
FIG. 23-A
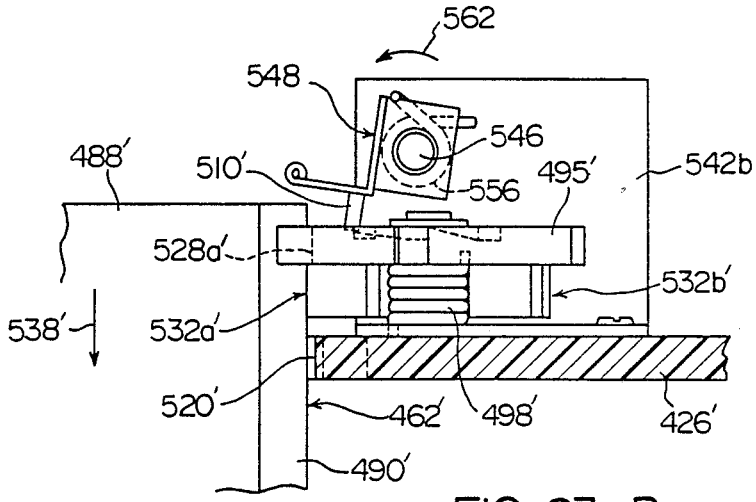
FIG. 23-B

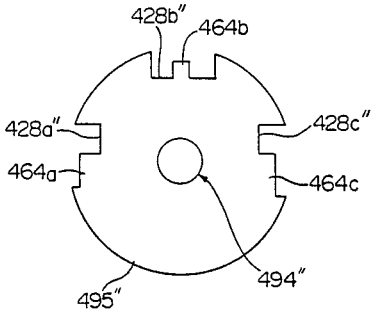
FIG. 24
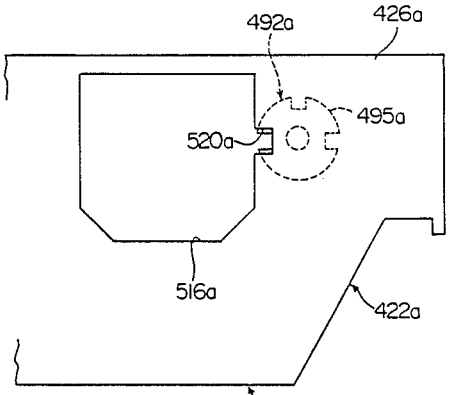
FIG. 25-A
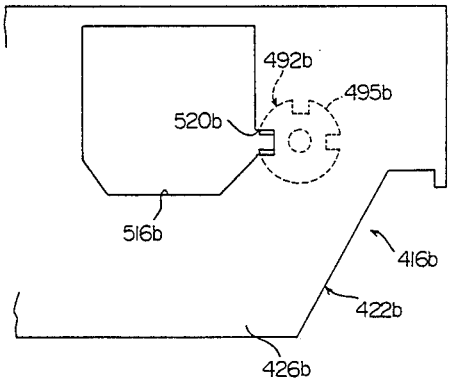
FIG. 25-B

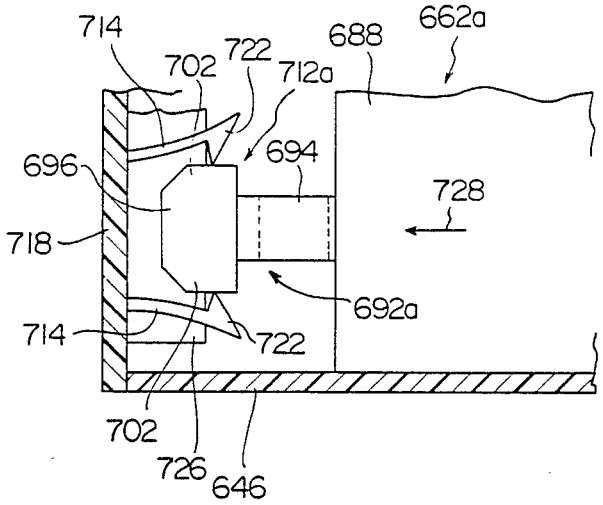
FIG. 30-A
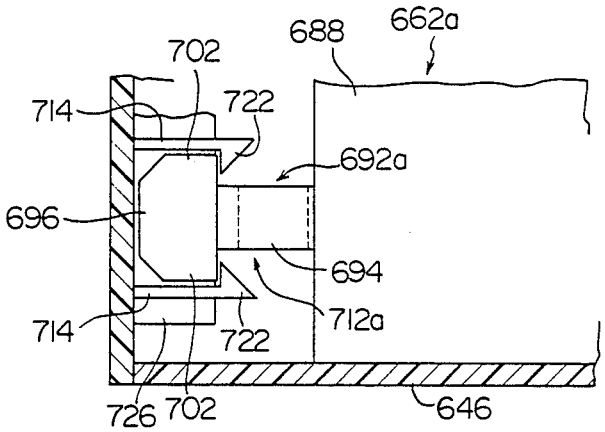
FIG. 30-B

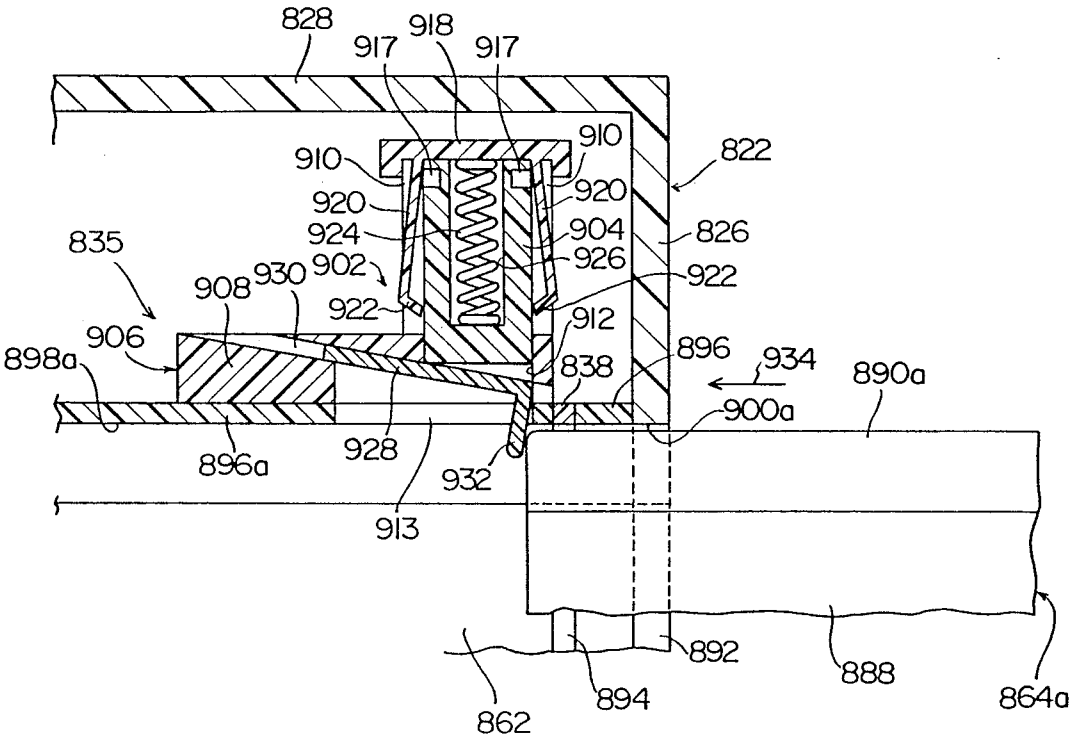
FIG. 35-A

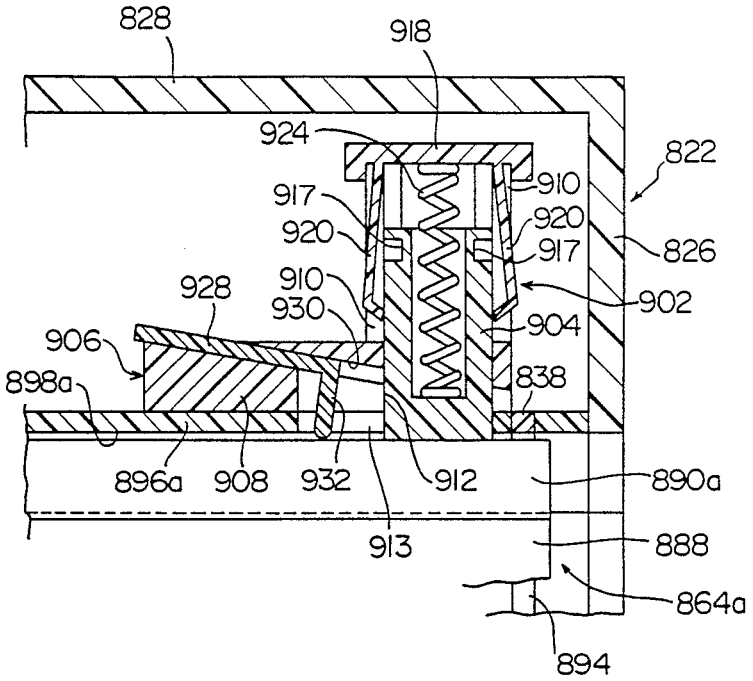
FIG. 35-B

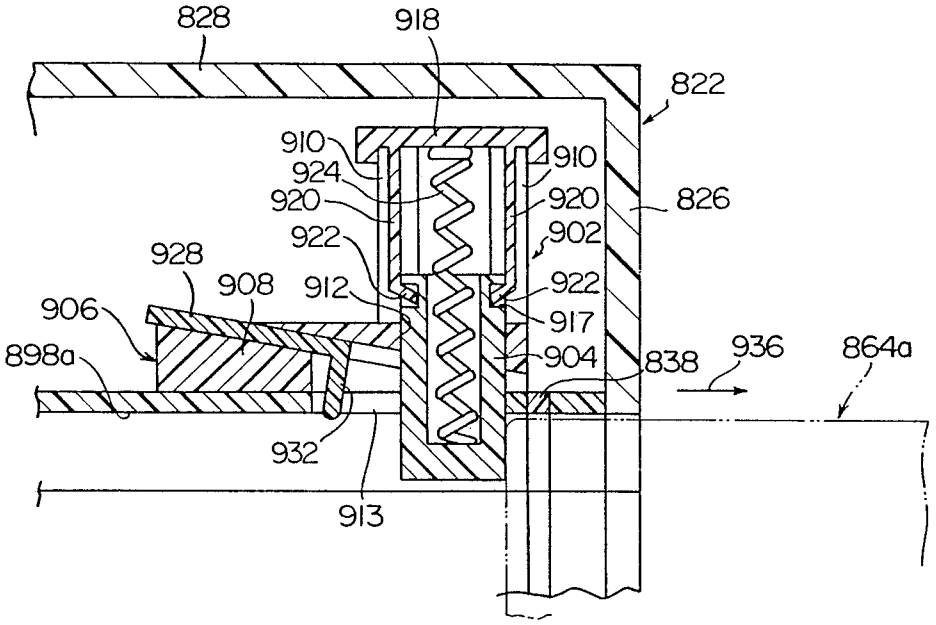
FIG. 35-C

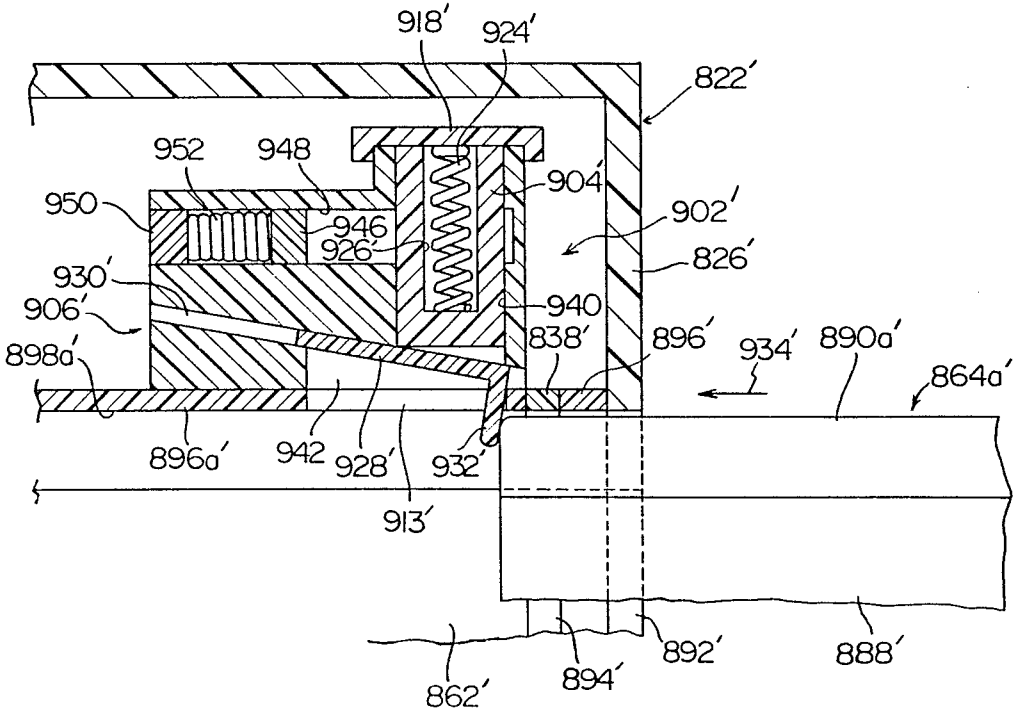
FIG. 38-A

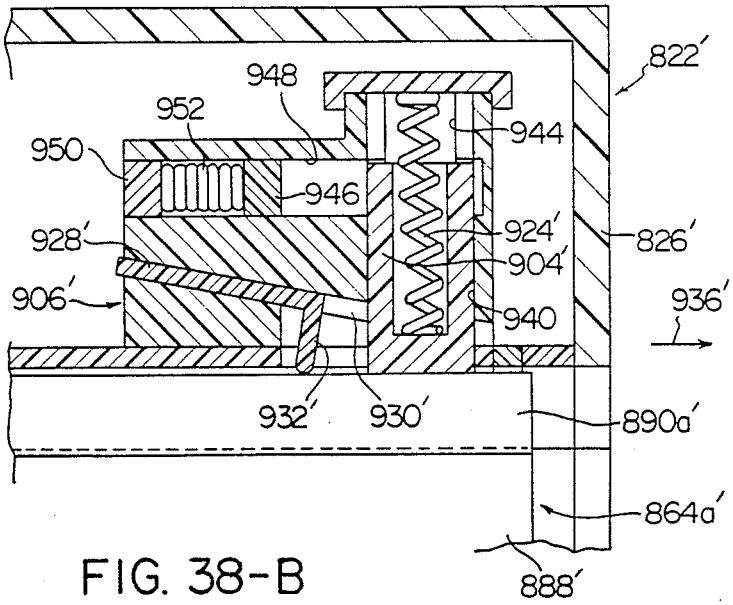
FIG. 38-B
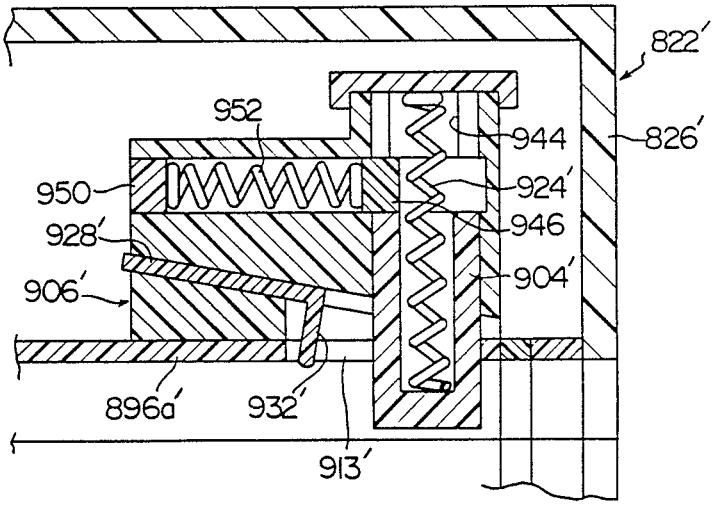
FIG. 38-C

REMOVABLE DEVELOPING UNITS FOR A COPYING MACHINE AND DISPLAY FOR INDICATING THE USEFUL LIFE OF THE MACHINE

FIELD OF THE INVENTION

This invention relates to an image-forming machine such as an electrostatic copying machine.

DESCRIPTION OF THE PRIOR ART

As is well known to those skilled in the art, an image-forming machine such as electrostatic copying machine or an electrostatic printing machine of the type adapted to form a latent electrostatic image on an electrostatographic material and develop the latent electrostatic image to toner image has been in widespread commercial use. The electrostatic copying machine as one example of the image-forming machine generally comprises image-bearing means such as a rotating drum having an electrostatographic material on its surface, means for forming a latent electrostatic image on the surface of the electrostatographic material, and a developing device for developing the latent electrostatic image. The developing device to be operated by using a two-component developer, for example, includes a main body having a developing chamber and a toner holding chamber, applicator means disposed in the developing chamber for applying a toner, and a plurality of toner cartridges selectively loaded in the toner holding chamber.

The conventional electrostatic copying machine, however, has not proved to be entirely satisfactory, and has various points still desired to be improved.

Firstly, the electrostatographic material becomes substantially useless upon long-term use. It is desired therefore to detect the end of its service life which may come during copying and to inform the operator of it. In this regard it is also desirable for the operator to easily perceive the remaining number of copies which can be produced before the electrostatographic material comes to the end of its service life.

Secondly, the electrostatographic material is generally fatigued as a result of performing copying. To obtain a stable image over an extended period of time, it is desired to adjust image-forming conditions so that they become adequate in relation to the performance of copying. This, however, is not limited to the above-described electrostatic copying machine.

Thirdly, in an electrostatic copying machine of the type in which the rotating drum and the developing device (in many cases, a cleaning device as well) are mounted on a common unit frame to form a replaceable process unit and the process unit is adapted to be mounted detachably on a housing, it is desirable to accurately detect the life of the process unit as a whole including the electrostatographic material and inform the operator of it.

Fourthly, in an electrostatic copying machine of the type in which the process unit also includes a cleaning device, even when the process unit is removed and stored for a long period of time, the action of toner removing means (such as a cleaning blade) of the cleaning device on the surface of the electrostatographic material results in a change in the properties of that part of the electrostatographic material on which the toner removing means acts. This is likely to degrade image quality when the process unit is used later.

Fifthly, when the life of the electrostatographic material substantially ends (the process unit substantially comes to the end of its life in the electrostatic copying machine of the type in which the process unit is detachably mounted), a good image cannot be obtained. It is therefore desired to accurately hamper the performance of image formation after its life comes to an end. This, however, is not limited to the aforesaid electrostatic copying machine alone.

SUMMARY OF THE INVENTION

A first object of this invention is to provide an image-forming machine in which the state of using an electrostatographic material can be easily recognized with a relatively simple construction.

A second object of this invention is to provide an image-forming machine in which image-forming conditions can be adjusted as is required in relation to the performance of copying.

A third object of this invention is to provide an image-forming machine in which the life of an electrostatographic material, i.e. the life of a process unit as a whole, can be accurately detected and made known to the operator.

A fourth object of this invention is to provide an image-forming machine wherein a change in the properties of an electrostatographic material which may occur during storage of a process unit can be effectively prevented.

A fifth object of this invention is to provide an image-forming machine in which when an electrostatographic material comes to the end of its life, loading of a new toner cartridge is made substantially impossible and thus image formation can be accurately hampered.

Other objects of this invention along with its characteristic features will become apparent from the following description.

BRIEF DESCRIPTION OF THE DRAWINGS

FIGS. 9-A to 9-C are perspective views showing cartridge discriminating means and the rear portions of toner cartridges in the electrostatic copying machine of FIG. 1;

FIGS. 10-A and 10-B are sectional views showing loading of a first (or second) toner cartridge and loading of a third toner cartridge, respectively;

FIGS. 19-A to 19-C are partly enlarged front views, partly in section, for explaining the motion of loading-hampering means and its related elements when a toner cartridge is loaded into, and detached from, the main body of the deveIoping device;

FIGS. 20-A and 20-B are partly enlarged top plan views, partly in section, for explaining the motion of loading hampering means and its related elements when a toner cartridge is loaded into, and detached from, the main body of the developing device;

FIGS. 22-A to 22-C are partially enlarged front elevations, partly in section, for explaining the motion of loading-hampering means and its related elements when a toner cartridge is loaded into, and detached from, the main body of the developing device in the modified embodiment shown in FIG. 21;

FIGS. 23-A and 23-B are partly enlarged top plan views, partly in section, for explaining the motion of the loading-hampering means and its related elements when a toner cartridge is loaded into, and detached from, the main body of the developing device in the modified embodiment shown in FIG. 21;

FIG. 24 is an enlarged front elevation showing a modified embodiment of the hampering plate in the loading-hampering means on an enlarged scale;

FIGS. 25-A and 25-B are front elevations showing part of a process unit provided with a modified embodiment of the developing device in a simplified form;

FIGS. 30-A and 30-B are partially enlarged sectional views for explaining actions performed when a first type of toner cartridge is loaded into the main body of the developing device;

FIG. 35-A to 35-C are sectional views showing the state of a toner cartridge as it is being loaded into, has been loaded into and has been detached from, the main body of the developing device in the process unit of FIG. 32;

FIGS. 38-A to 38-C are sectional view showing respectively the state of a toner cartridge as it is being loaded into, has been loaded, and has been detached from, the main body of the developing device provided with the modified example of the re-loading hampering means.

DETAILED DESCRIPTION OF PREFERRED EMBODIMENTS

The present invention will now be described in detail with reference to the accompanying drawings. While the invention will be described below with reference to an electrostatic copying machine as one example of the image-forming machine of this invention, it should be understood that the following description may apply equally to other image forming machine such as electrostatic printing machine.

Outline of Electrostatic Copying Machine in First Embodiment

Figure 1:
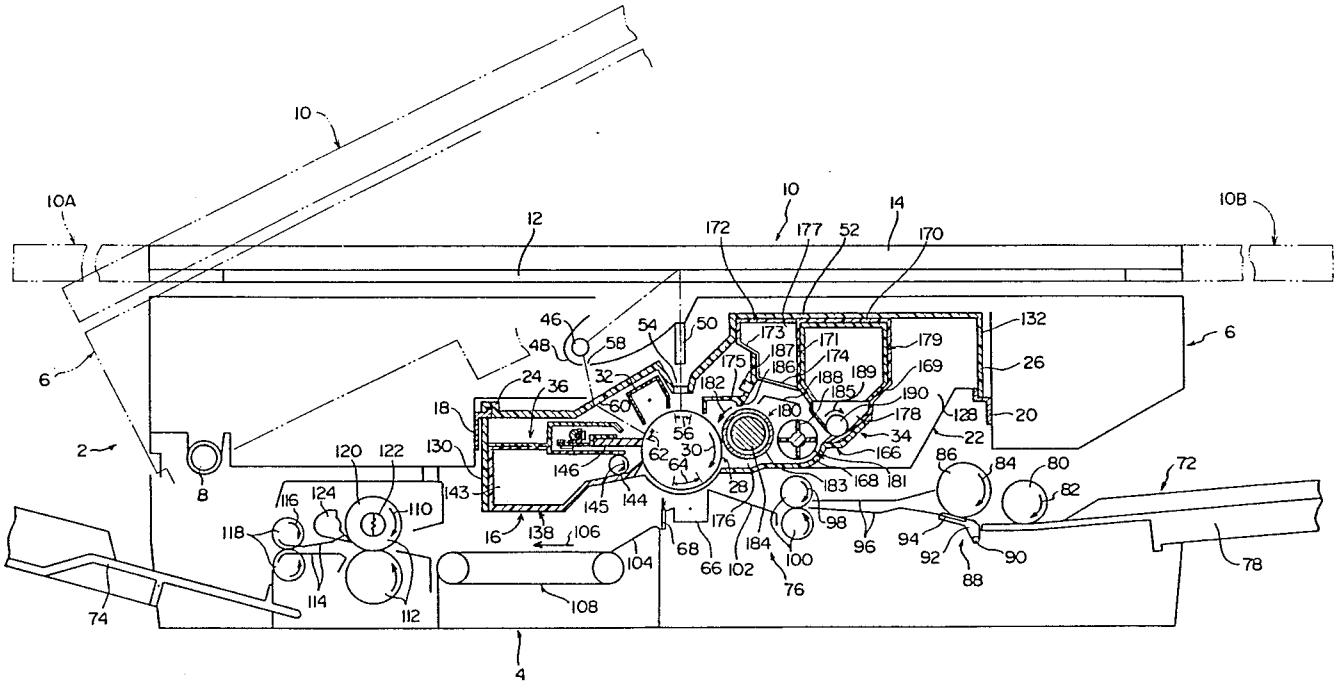
FIG. 1 is a simplified sectional view showing a first embodiment of an electrostatic copying machine as one example of the image forming machine constructed in accordance with this invention.

FIG. 1 is a sectional view showing in a simplified form a first embodiment of the electrostatic copying machine as one example of the image-forming machine in accordance with this invention.

The illustrated electrostatic copying machine has a nearly rectangular parallelpipedal housing shown generally at 2. The housing 2 is defined by a lower supporting frame 4 and an upper supporting frame 6. The lower part of the left end portion of upper supporting frame 6 is pivotably connected to the lower supporting frame 4 via a shaft 8, and the upper supporting frame 6 can pivot between a closed position shown by a solid line and an open position shown by a two-dot chain line.

On the upper surface of the housing 2, i.e. the upper surface of the upper supporting frame 6, is mounted document placing means 10 in such a manner as to be reciprocable in the left-right direction. The document placing means 10 includes a transparent plate 12 on which to place a document to be copied and an openable-closable document cover 14 for covering the transparent plate 12 and a document placed on it.

A process unit shown generally at 16 to be positioned nearly centrally in the housing 2 is detachably mounted on the upper supporting frame 6. In more detail, a pair of supporting rails 18 and 20 spaced from each other in the left-right direction and extending in the front-rear direction, i.e. in the direction perpendicular to the sheet surface, are fixed to the upper supporting frame 6. The process unit 16 has a unit frame 22, and supported rail portions 24 and 25 extending in a direction perpendicular to the sheet surface are formed on both left and right sides of the unit frame 22. By bringing the supported rail portions 24 and 26 of the unit frame 22 into engagement with the supporting rails 18 and 20 of the upper supporting frame 6 and sliding the unit frame 22 in a direction perpendicular to the sheet surface, the process unit 16 is mounted on and detached from the upper supporting frame 6. A rotating drum 28 constituting image-bearing means is rotatably mounted nearly centrally on the unit frame 22. A suitable electrostatographic material 29 (FIG. 4) is disposed on the peripheral surface of the rotating drum 28. Further mounted on the unit frame 22 are a charging corona discharger 32, a developing device shown generally at 34 and a cleaning device shown generally at 36 around the rotating drum to be driven in the direction of an arrow 30 in the order stated as viewed in the rotating direction of the rotating drum 28. The developing device 34 and the cleaning device 36 will be described in more detail hereinafter.

Above the process unit 16, an illuminating lamp 46, a reflecting plate 48 and an optical system 50 are also mounted on the upper supporting frame 6. The optical system is comprised of a number of elongate optical elements extending vertically (for example, rod-like lenses sold under the tradename "Selfoc Microlens" by Nippon Sheet Glass Co., Ltd.). Light from the illuminating lamp 46, as shown by a one-dot chain line, passes through the transparent plate 12 and irradiates a document placed on it. The reflecting light from the document passes through the optical unit 50 and an exposure opening 54 formed in the upper wall 52 of the unit frame 22, and is projected onto the peripheral surface of the rotating drum 28 in an exposure zone 56. Part of the light from the illuminating lamp 46, as likewise shown by a one-dot chain line, passes through an opening 58 formed in the under surface of the reflecting plate 48 and a charge eliminating opening 60 formed in the upper wall 52 of the unit frame 22, and is projected onto the peripheral surface of the rotating drum 28 in a charge eliminating zone 62.

A transfer corona discharger 66 which faces the peripheral surface of the rotating drum 28 in a transfer zone 64 and a peeling charge eliminator 68 positioned adjacent to and downstream of the transfer corona discharge 66 are mounted nearly centrally on the lower supporting frame 4.

Copying paper feed means shown generally at 72 is disposed on the right end portion of the lower supporting frame 4, and a copying paper receiving tray 74, on the left end portion of the lower supporting frame 4. A copying paper conveying system shown generally at 76 and used to convey copying paper through the transfer zone 64 is disposed between the paper feed means 72 and the paper receiving tray 74. The paper feed means 72 includes a paper stand 78, and a paper delivery roller 80 disposed above the downstream end portion of the paper stand 78. The paper delivery roller 80 is selectively elevated and lowered, and rotated in the direction shown by an arrow 82. The paper feed means 72 further comprises a paper feed roller 86 disposed downstream of the paper stand 78 and adapted to be rotated in the direction of an arrow 84 and paper separating means 88 provided below it. The paper separating means 88 has a supporting member 92 mounted pivotably by means of a pin 90 and a separation member 94 formed of a high friction material such as synthetic rubber and disposed on the upper surface of the supporting member 92. The supporting member 92 is elastically biased in the clockwise direction by suitable spring means (not shown), and thus, the separating member 94 is elastically pressed against the paper feed roller 86. In the paper feed means 72 described above, a layer of copying paper sheets having a predetermined size is manually put onto the paper stand 78. Every time the paper delivery roller 80 is lowered and rotated in the direction of arrow 82, the uppermost paper sheet in the layer is delivered and further advanced by the paper feed roller 86. The separating member 94 prevents advancing of paper sheets other than the uppermost sheet by the feed roller 86 when two or more paper sheets are delivered at a time by the paper delivery roller 80. By dint of the separation member 94, the paper sheets in the layer are delivered one by one to the paper conveying system 76. The paper conveying system 76 further includes a pair of guide plates 96, a pair of conveyor rollers 100 to be rotated in the direction shown by an arrow 98, guide plates 102 and 104, a conveyor belt mechanism 108 to be rotated in the direction shown by an arrow 106, a pair of heat fixing rollers 112 to be rotated in the direction shown by an arrow 110, a pair of guide plates 114, and a pair of discharge rollers 118 to be rotated in the direction shown by an arrow 116. The upper heating roller 120 of the pair of heat fixing rollers has disposed herein suitable heating means 122. A peeling member 124 for preventing wrapping of paper is annexed to the upper heating roller 120.

In the electrostatic copying machine described above, while the rotating drum 28 is rotated in the direction of arrow 30, the charging corona discharger 32 substantially uniformly charges the photosensitive material on the rotating drum 28 to a specific polarity. Then, in the exposure zone 56, the image of the document on the transparent plate 12 is scanned and exposed to the photosensitive material. As a result, a latent electrostatic image corresponding to the image of the document, is formed on the electrostatographic material by latent electrostatic image-forming means including the charging corona discharger 32 and the illuminating lamp 46. During the scanning and exposure, the document placing means 10 is moved from a start-of-scan position shown by a two-dot chain line 10A rightward to an end-of-scan position shown by a two-dot chain line 10B. Then, the latent electrostatic image on the electrostatographic material is developed to a toner image by the developing device 34, and thus, a toner image is formed by image-forming means including the latent electrostatic image-forming means and the developing device 34. Then, copying paper fed from the paper feed means 72 and conveyed by the paper conveying system 76 is brought into intimate contact with the peripheral surface of the rotating drum 28 in the transfer zone 64, and by the action of the transfer corona discharger 66, the toner image on the electrostatographic material is transferred to the copying paper. Then, the paper is peeled from the rotating drum 28 by the action of the charge eliminator 68. The peeled paper is conveyed through the pair of heat fixing rollers 112, and during this time, the toner image is heat-fixed onto the paper. The paper having the toner image fixed thereto is then discharged onto the paper receiving tray 74. In the meantime, the rotating drum 28 continues to rotate and by the action of the cleaning device 36, the toner remaining on the electrostatographic material after the transfer is removed. Then, in the charge eliminating zone 62, charge-eliminating light is irradiated onto the electrostatographic material and the residual charge on the electrostatographic material is erased.

The electrostatic copying machine described above is merely one example of the image-forming machine constructed in accordance with this invention. A detailed description of its structure and operation will therefore be omitted herein.

Figure 4:
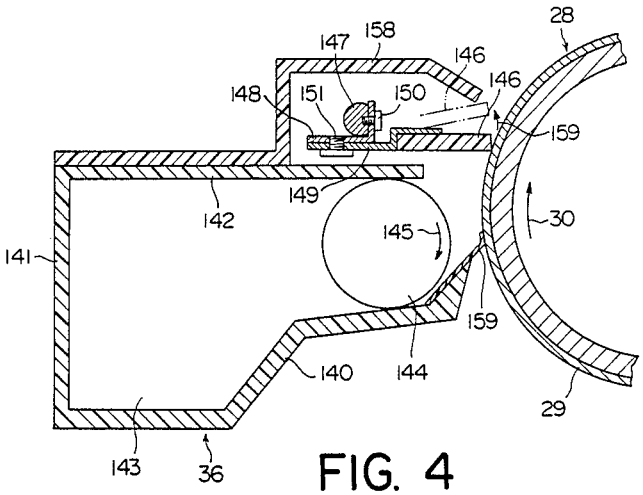
FIG. 4 is a sectional view showing on an enlarged scale a cleaning device and its vicinity in the electrostatic copying. machine of FIG. 1.

Cleaning Device and Related Elements in Electrostatic Copying Machine in First Embodiment Now, mainly with reference to FIGS. 2 and 4 together with FIG. 1, the illustrated cleaning device 36 and its related elements will be described in detail.

The unit frame 22 of the process unit 16 has a front wall 126 (FIG. 2) and a rear wall 128 (FIG. 1) spaced from each other in the front-right direction (the direction perpendicular to the sheet surface in FIG. 1, and the direction from right bottom to left top in FIG. 2), and between the front wall 126 and the rear wall 128 are fixed an upper wall 52, a left side wall 130 and a right side wall 132 (FIG. 1). In the illustrated embodiment, the rotating drum 28, the developing device 34 and the cleaning device 36 are disposed between the front wall 126 and the rear wall 128 of the unit frame 22. In the illustrated unit frame 22, a grip portion 134 is provided in the front surface of the front wall 126 to permit easy mounting and detachment of the unit frame 22 on and from the upper supporting frame 6. Furthermore, to place the unit frame 22 easily in a unit holding box 135 (FIG. 3) to be described, a suspension band 136 for suspending the process unit 16 is secured to the upper surface of the upper wall 52 by means of screws 137.

Figure 5:
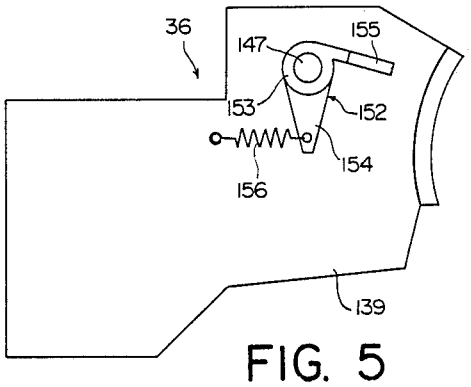
FIG. 5 is a side elevation showing the cleaning device of FIG. 4.

The illustrated cleaning device 36 includes a main body 138 mounted between the front wall 126 and the rear wall 128 of the unit frame 22. In the illustrated embodiment, the main body 138 of the cleaning device 36 has a pair of end walls 139 (only the end wall on the front side is shown in FIG. 5) disposed in spacedapart relationship in the aforesaid front-rear direction between the front wall 126 and the rear wall 128, and various walls 140, 141 and 142 extending in the frontrear direction are provided between these pairs of end walls 139. The end walls 139 and the walls 140, 141 and 142 define a toner recovery chamber 143. A toner delivery roller 144 is disposed in an opening portion formed in the toner recovery chamber 143. The toner delivery roller 144 is rotatably mounted between the pair of end walls 139 and adapted to be rotated in the direction shown by an arrow 145 by the action of a driving source (not shown).

Figure 6:
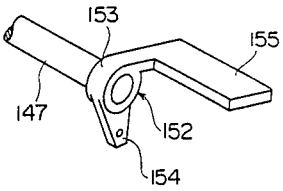
FIG. 6 is a perspective view showing on an enlarged scale an actuation member provided in the cleaning device of FIG. 4, and its vicinity.

The cleaning device 36 is further provided with a cleaning blade 146 constituting toner removing means. A rotating shaft 147 is mounted rotatably between the pair of end walls 139 and the cleaning blade 146 is mounted on the rotating shaft 147 via a pair of plate members 148 and 149. One end portion of one plate member 148 is fixed to the rotating shaft 147 with a screw 150, and the cleaning blade 146 is fixedly secured to one end portion of the other plate member 149 with an adhesive. The plate members 148 and 149 at their other end portions are linked to each other by means of a screw 151. One end portion of the shaft 147, as shown in FIG. 5, projects forwardly through one end wall 139 (one on the front side), and an actuation member 152 shown in FIGS. 5 and 6 are mounted on its projecting end portion. The illustrated actuation member 152 has a cylindrical base portion 153 mounted on the rotating shaft 147, an engaging portion 154 projecting from the base portion 153, and an actuating portion extending from the base portion 153. Between the engaging portion 154 and a predetermined site of the end wall 139 is interposed a coil spring 156 constituting elastic biasing means. The coil spring 156 is designed to bias the actuating member 152 elastically in the clockwise direction in FIG. 5, and therefore the cleaning blade 146 elastically in the clockwise direction in FIG. 4 about the rotating shaft 147 as a center. The free end portion of the actuating portion 155 extends forwardly, and as shown in FIG. 2, projects forwardly through a nearly rectangular opening 157 formed front wall 126 of the unit frame 22. Because of this structure, the actuation member 152 is free to pivot between a first angular position (shown in FIGS. 2 and 5) at which the actuating portion 155 is positioned at the lower end of the opening 157 formed in the front wall 126 and a second angular position (shown in FIG. 7) at which the actuating portion 155 is positioned at the upper end of the opening 157. When the actuation member 152 is held at the first angular position by the action the coil spring 156, the front end portion of the cleaning blade 146 is elastically pressed against the surface of the electrostatographic material 29 on the rotating drum 28, and consequently, the cleaning blade 146 is held at its operating position (shown by a solid line in FIG. 4). On the other hand, when the actuation member 152 is held at the second angular position against the action of the coil spring 156, the cleaning blade 146 pivots in the direction shown by an arrow 159 (FIG. 4) and moves away from the surface of the electrostatggraphic material 29. Thus, the cleaning blade 146 is held at its non-operating position (shown by a two-dot chain line in FIG. 4) at which it does not substantially act on the electrostatographic material 29.

In the illustrated embodiment, a cover member 158 is mounted on the upper surface of the wall 142 in order to cover the cleaning blade 146, the plate members 148 and 149, etc., and the front end portion of the ceaning blade 146 acts on the surface of the electrostatographic material 29 through an opening defined by the wall 142 and the cover member 158. A seal member 159 is provided at one end portion of the wall 140, and its forward end portion is kept in contact with the surface of the electrostatographic material 29. This seal member receives the toner removed from the surface of the electrostatographic material and conducts it to the toner recovery chamber 143, and prevents scattering of the toner.

Figure 3:
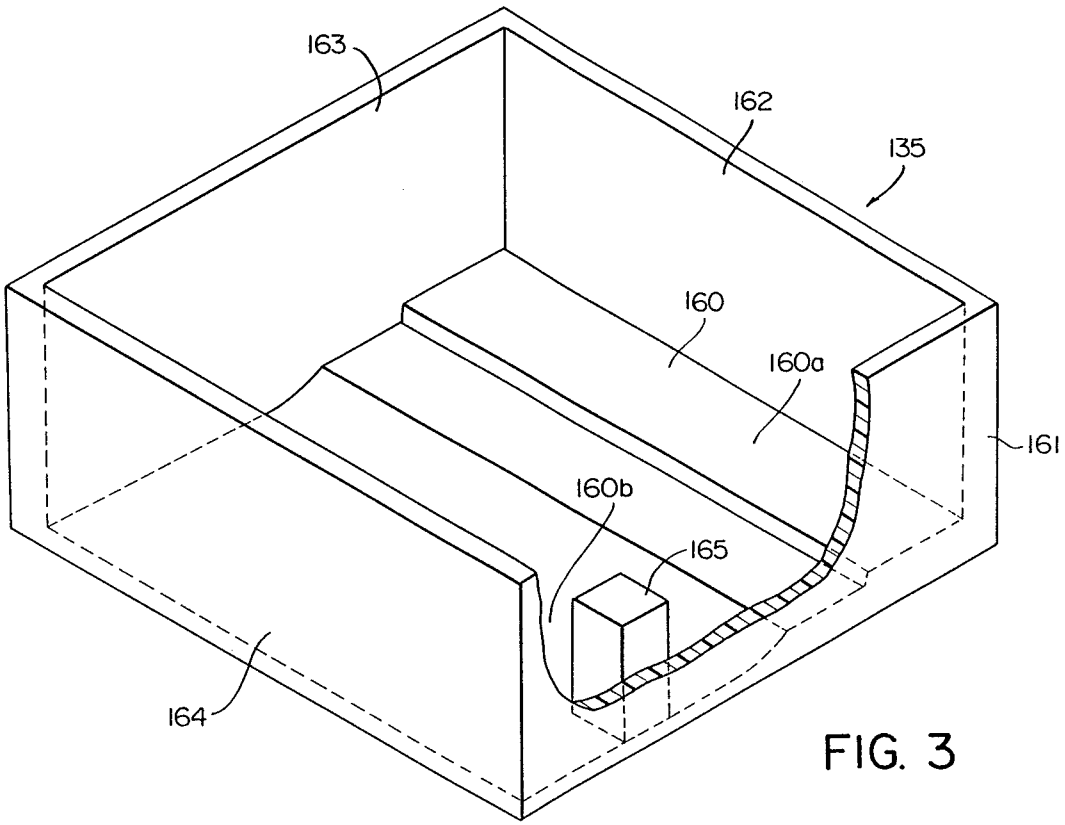
FIG. 3 is a perspective view, partly broken away, of a unit holding box for holding the process unit shown in FIG. 2.

During storage, the process unit 16 is detached from the upper supporting frame 6 and put in the unit holding box 135 shown in FIG. 3. The unit holding box 135 has a bottom wall 160 and four side walls 161, 162, 163 and 164 and is opened at its top. The right portion 160*a* of the bottom wall 160 projects slightly upwardly as compared with its left portion 160*b*. An actuating protrusion 165 projecting upwardly is provided at that site of the bottom wall 160 which is inwardly of the side wall 161 at the left portion 160*b*.

Figure 7:
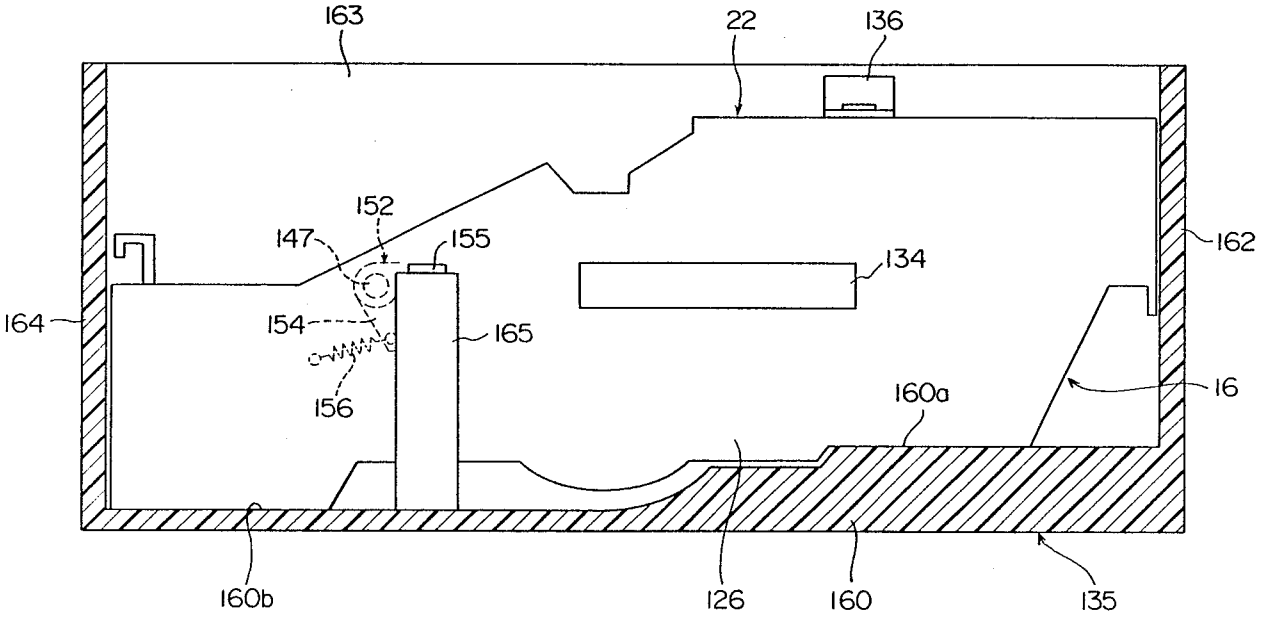
FIG. 7 is a sectional view showing the process unit as it is held in the unit holding box.

To place the process unit 16 in the unit holding box 135, the grip portion 134 in the unit frame 22 is held and moved forwardly to detach the process unit 16 from the upper supporting frame 6. Then, the suspension belt 136 mounted on the upper wall 52 of the unit frame 22 is gripped and the process unit 16 is put in position in the holding box 135 through its open top. As a result, as shown in FIG. 7, the actuating protrusion 165 provided in the box 135 acts on the actuation member 152 mounted on the rotating shaft 147 (more specifically, that end portion of the actuating portion 155 in the actuation member 152 which projects through the opening 157 of the front wall 126) to pivot the actuation member 152 counterclockwise in FIGS. 5 and 7 and hold it at the second angular position. As a result, the cleaning blade 146 is pivoted in the direction of arrow 157 via the rotating shaft 147 and the plate members 148 and 149, and moved from the operating position and held at the hon-operating position (shown by a two-dot chain line in FIG. 4). Thus, when the process unit 16 is placed in the unit holding box 135, the cleaning blade 146 of the cleaning device 36 moves away from the surface of the electrostatographic material 29 of the rotating drum 28. Hence, changes in the characteristics of the electrostatographic material 29 during storage can be avoided effectively, and the cleaning blade 146 can be prevented from deformation. Furthermore, when the process unit 16 is so held in the box 135, the right lower edges of the front wall 126 and the rear wall 128 of the unit frame 22 and the bottom surface of the developing device 34 are placed on the right portion 160*a* of the bottom wall 160 in the unit holding box 135 and the left lower edges of the front wall 126 and the rear wall 128 and the bottom surface of the cleaning device 36 are placed on the left portion 160*b* of the bottom wall 160, as shown in FIG. 7. Thus, some space exists between the rotating drum 28 mounted on the unit frame 22 and the bottom wall 160 of the unit holding box 135. After the process unit 16 has been put in the unit holding box 135, the top of the unit holding box 135 is closed by a closure (not shown).

To take out the process unit 16 from the unit holding box 135, the suspension belt 136 is gripped and lifted through the open top of the box 135. As a result, the actuating portion 155 of the actuation member 152 moves away from the actuating protrusion 165 of the unit holding box 135, and the actuation member 152 is held at the first angular position by the action of the coil spring 156. Consequently. the cleaning blade 146 is pivoted in a direction opposite to the direction of arrow 157 via the rotating shaft 147 and the plate members 148 and 149, and held at its actuating position shown by a solid line in FIG. 4. Thus, the front end portion of the cleaning blade 146 is elastically pressed against the surface of the electrostatographic material 29 of the rotating drum 28, and the toner remaining on the surface of the electrostatographic material 29 is removed by the action of the cleaning blade 146. The removed toner is recovered in the recovery chamber 143 by the action of the toner delivery roller 144 rotated in the direction shown by an arrow 145.

Developing Device and Related Elements in the Electrostatic Copying Machine in the First Embodiment Again, with reference to FIGS. 1 and 2, the illustrated developing device 34 and its related elements will be described in detail.

The illustrated developing device 34 has a main body 166 mounted between the front wall 126 and the rear wall 128 of the unit frame 22. In the illustrated embodiment, the main body 166 of the developing device 34 has a pair of end walls 167 (only one end wall positioned inwardly of the rear wall 128 is shown in FIGS. 10-A and 10-B) spaced from each other in the front-rear direction between the front wall 126 and the rear wall 128. Various walls 168, 169, 170, 171, 172, 173, 174 and 175 extending in the front-rear direction are provided between the pair of end walls 167. The main body 166 of the developing device 34 provided with the pair of end walls 167 and the various walls 168 to 175 is divided into three chambers, i.e. a developing chamber 176, a developer holding chamber 177 and a toner holding chamber 178. In the illustrated developing device 34, a so-called two-component developer composed of a carrier and a toner is used. The developer holding chamber 177 contains a "start developer" (a mixture of a carrier and a toner in a predetermined ratio) to be supplied to the developing chamber 176. a toner cartridge 179 to be described is loaded into the toner holding chamber 178, and the toner discharged from the toner cartridge 179 is held in the toner holding chamber 178.

Applicator means 180 and agitating means 181 are disposed in the developing chamber 176. The applicator means 180 is constructed of a cylindrical sleeve 183 to be rotated in the direction shown by an arrow 182 and a stationary permanent magnet 184 disposed within the cylindrical sleeve 183. The applicator means 180 holds the developer in the developing chamber 176 and carries it in the direction shown by an arrow 182. The developer so carried acts on the electrostatographic material 29 of the rotating drum 28 to develop the electrostatic latent image formed on its surface to a toner image. The agitating means 181 has a plurality of helical blades 185 by which the developer in the developing chamber 176 is agitated and supplied to the applicator means 180. Brush-length adjusting means 186 projecting toward the sleeve 183 of the applicator means 180 is formed in the wall 175 which defines the left upper wall of the developing chamber 176. The brushlength adjusting means 186 acts on the developer moved while being magnetically held on the surface of the sleeve 183, and removes the excess of the developer. A toner concentration detector 187 located above the brush length adjusting means 186 is provided on the wall 175. The detector 187, which may be of a known type, has a detecting surface exposed to the inside of the developing chamber 176 and detects the toner concentration of the developer removed from the applicator means 180. The excess of the developer removed from the applicator means 180 by the action of the brush length adjusting means 186 is allowed to flow downwardly toward the agitating means 181 over a guide plate 188 after its toner concentration has been detected by the detector 187.

A toner discharge opening communicating with the developing chamber 176 is provided at the bottom portion of the toner holding chamber 178, and a toner supply roller 190 to be rotated in the direction shown by an arrow 189 is provided at the toner discharge opening. The toner supply roller 190 is rotated by a driving source M1 (FIG. 11) such as a stepping motor, and by this rotation, supplies the toner to the developing chamber 176 through the toner discharge opening in the manner to be described. A toner cartridge 179 containing a toner is loaded into the upper part of the toner holding chamber 178.

Figure 8:
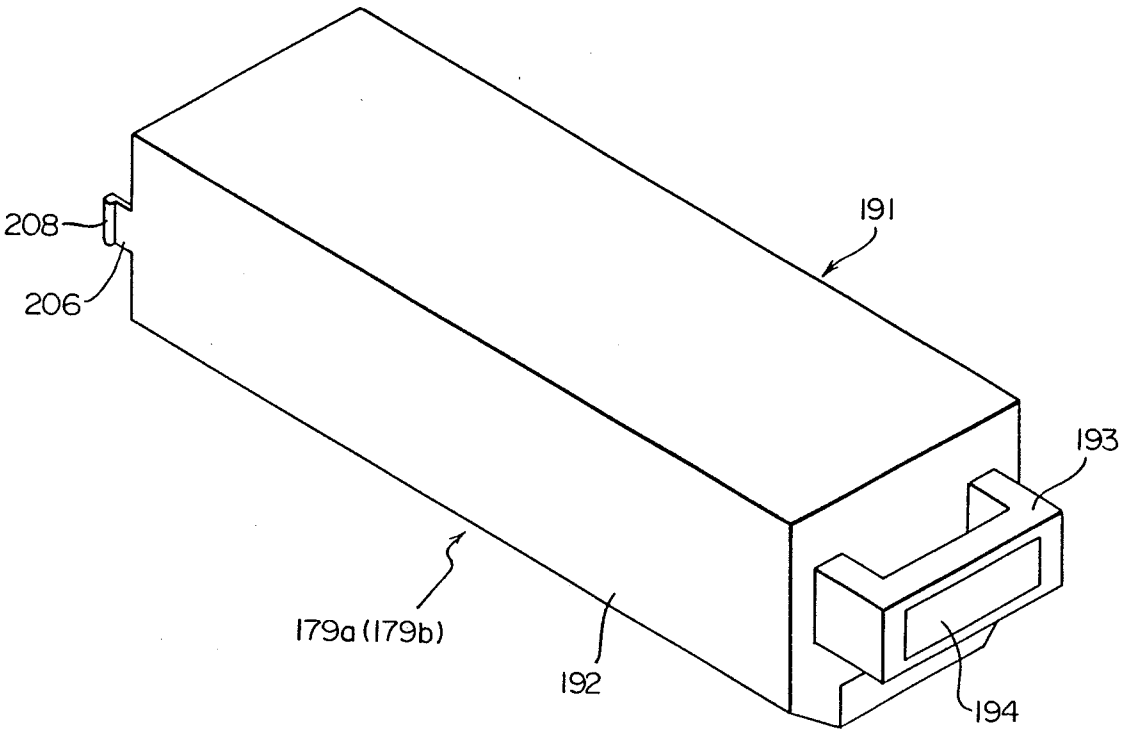
FIG. 8 is a perspective view showing one toner cartridge to be loaded into a toner holding chamber of a developing device in the electrostatic copying machine of FIG. 1.

With reference to FIGS. 8 and 9-A to 9-C also, the electrostatographic material 29 of the rotating drum 28 in the illustrated electrostatic copying machine has a service life corresponding to copying of about 6,000 prints. In relation to this, three toner cartridges 179 are provided for one process unit 16. In the illustrated embodiment, a toner required for producing about 2,000 copies is held in each toner cartridge 179, and the toner cartridges 179 are selectively loaded into the toner holding chamber 178. The toner cartridge 179 are of nearly the same structure and differ only in regard to locking means to be described. Each toner cartridge 179 has a receptacle 191 for holding a toner. The illustrated receptacle 191, as shown in FIG. 8, has a box-like main body 192 having a discharge opening (FIG. 1) formed at its under surface and a gripping portion 193 provided at one end surface of the main body 192. Preferably, a display portion 194 showing the sequence of loading into the toner holding chamber 178 is provided in the receptacle 191, for example at the front surface of the gripping portion 193 as shown in FIG. 8. It may, for example, be the display portion disclosed in the specification and drawings of Japanese Patent Application No. 21923/1986 filed on Sept. 19, 1986 (entitled: Developing Device for Image-Forming Machines) by the present applicant. The discharge opening formed in the main body 192 of the receptacle of the toner cartridge 179 is openably sealed by a seal member (not shown) such as an adhesive tape, and opened when it is to be loaded into the toner holding chamber 178 of the developing device 34.

Figure 2:
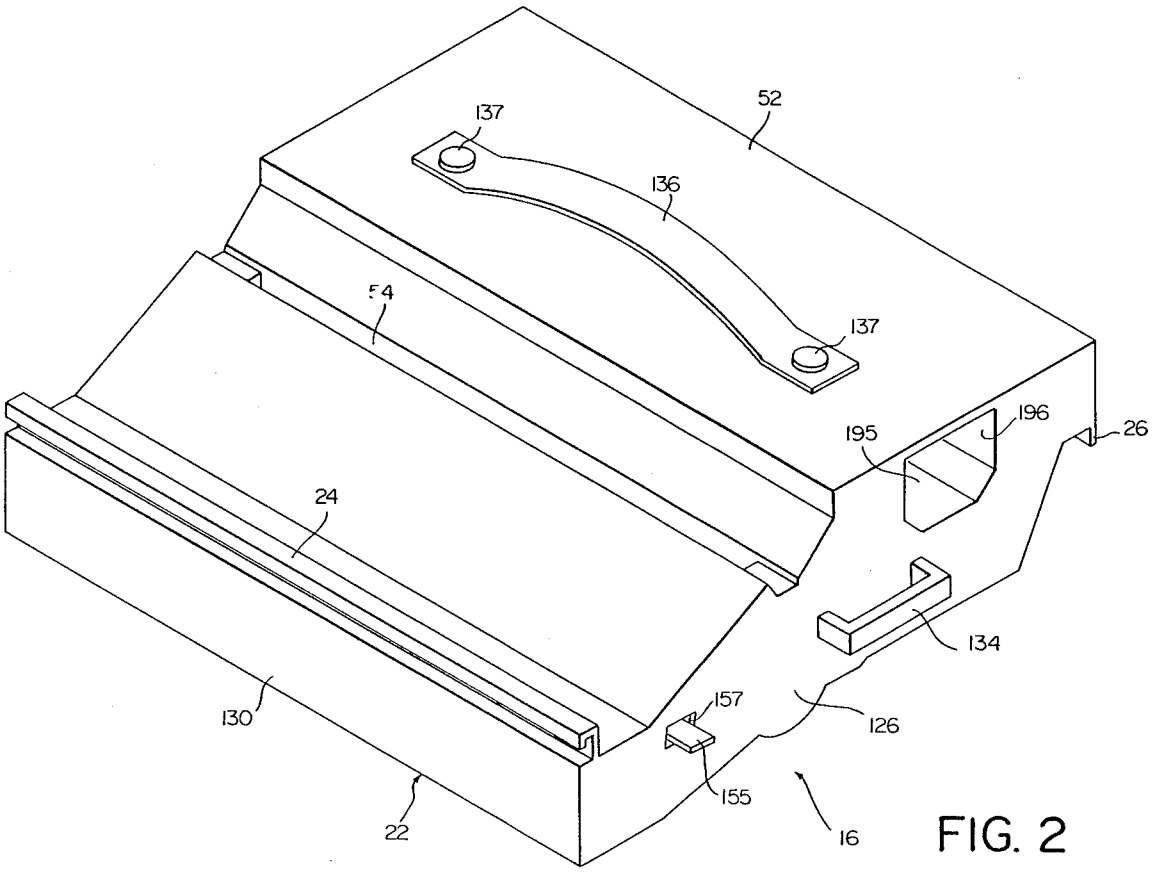
FIG. 2 is a perspective view showing a process unit in the electrostatic copying machine in FIG. 1.

In relation to the fact that the toner cartridges 179 can be selectively loaded into the toner holding chamber 178, an opening 195 (FIG. 2 shows the opening 195 formed in the front wall 126 of the unit frame 22) is formed at a required site in the front wall 126 of the unit frame 22 and a required site in the end wall 167 of the developing device 34 (the end wall located inwardly of the front wall 126 of the unit frame 22). In the specific embodiment, a guide wall 196 (FIG. 2) is provided between the opening 195 in the front wall 126 and the opening 195 (not shown) in the end wall 167 of the developing device 34 in order to prevent leakage of the toner from the toner cartridge 179 at the time of loading. Thus, each toner cartridge 179 is guided by the guide wall 196 through the opening 195 formed in the front wall 126 of the unit frame 22 and further by the walls 169 and 171 through the opening 195 (not shown) formed in the end wall 167 of the developing device 34, and loaded in position in the toner holding chamber 178.

In the illustrated electrostatic copying machine, the toner cartridge 179 loaded in the toner holding chamber 178 of the developing device 34 is adapted to be perceived by the operator.

With reference mainly to FIGS. 9-A to 9-C, the illustrated electrostatic copying machine is provided with cartridge discriminating means 198 (FIG. 11) for discriminating the cartridge 179 loaded in the toner holding chamber 178 and display means 200 for display on the basis of a signal from the cartridge discriminating means 198. In the illustrated embodiment, the cartridge discriminating means 198 includes detection means provided in each cartridge 179 and detecting means 202 for detecting the detection means. The detecting means 202 is provided in the end wall 167 on the rear side of the developing device 34, and includes three terminals 204*a*, 204*b* and 204*c* in relation to the selective loading of three toner cartridges 179. The terminals 204*a*, 204*b* and 204*c* are spaced from each other laterally (the left-right direction in FIG. 1, and the direction from right bottom to left top in FIGS. 9-A to 9-C), and their connecting surfaces are exposed to the inner surface of the end surface 138 of the main body 166 of the developing device 34.

The detection means provided in the toner cartridge 179 is comprised of a linking member linking the terminals 204*a*, 204*b* and 204*c* in a required manner. Specifically, the detection means 206*a* provided in a toner cartridge to be first loaded into the toner holding chamber 178 (to be designated by 179*a*) is comprised of a linking member 208*a* shown in FIG. 9-A. The linking member 208*a* has a terminal portion 210 disposed in coorespondence to the terminal 204*a*, a terminal portion 212 disposed in correspondence to the terminal 204*b*, and a linking portion 214 for linking the terminal portions 210 and 212, and is provided in the rear surface of the rear wall of the main body 192 of the receptacle in the toner cartridge 179*a*. Thus, when the toner cartridge 179*a* is loaded into the toner holding chamber 178 and held at a holding position in the manner to be described, the terminal 204*a* is linked to the terminal portion 210 and the terminal 204*b*, to the terminal portion 212. As a result, the terminals 204*a* and 204*b* provided in the main body 166 of the developing device are linked via the linking member 208*a* provided in the toner cartridge 179*a*. The detection means 206*b* provided in the toner cartridge to be loaded next into the toner holding chamber 178 (to be designated by 179*b*) is comprised of a linking member 208*b* shown in FIG. 9-B. The linking member 208*b* has a terminal portion 212 disposed in correspondence to the terminal 204*b*, a terminal portion 216 disposed in correspondence to the terminal 204*c*, and a connecting portion 218 connnecting the terminal portions 212 and 216, and is provided in the rear surface of the rear wall of the main body of the receptacle in the toner cartridge 179*b*. Thus, when the toner cartridge 179*b* is loaded into the toner holding chamber 178 and held at a holding position, the terminal 204*b* is connected to the terminal portion 212 and the terminal 204*c*, to the terminal portion 216. Consequently, the terminals 204*b* and the terminal 204*c* provided in the main body 166 of the developing device are linked via the linking member 208*b*. The detection means 206*c* provided in the toner cartridge to be loaded in the third place into the toner holding chamber 178 (to be designated by 179*c*) is comprised of a linking member 208*c* shown in FIG. 9-C. The linking member 208*c* has a terminal portion 210 disposed in correspondence to the terminal 204*a*, a terminal portion 212 disposed in correspondence to the terminal 204*c*, and a terminal portion 216 disposed in correspondence to the terminal 204*c*, and connecting portions 214 and 218 connecting the terminal portions 210, 212 and 216, and is provided in the rear surface of the rear wall of the main body 192 of the receptacle in the toner cartridge 179*c*. Thus, when the toner cartridge 179*c* is loaded into the toner holding chamber 178 and held at a holding position, the terminal 204*a* is linked to the terminal portion 210, the terminal 204*b* to the terminal portion 212, and further the terminal 204*c* to the terminal portion 216. Thus, the terminals 204*a*, 204*b* and 204*c* provided in the main body 166 of the developing device are linked to each other via the linking member 208*c* provided in the toner cartridge 179*c*.

Figure 11:
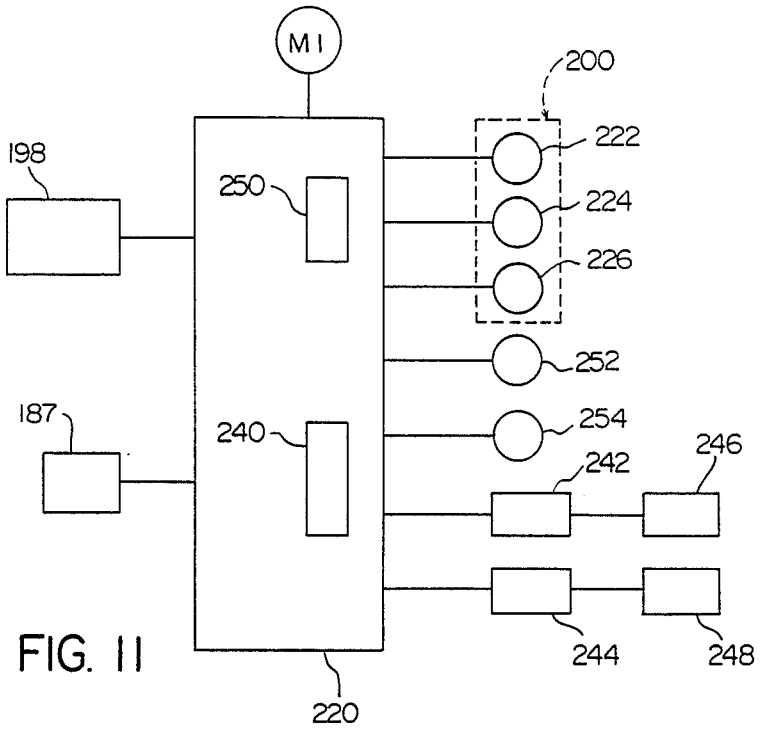
FIG. 11 is a view showing in a simplified form a control system in the electrostatic copying machine of FIG. 1.

A discrimination signal produced by the detecting means 202 provided in the main body 166 of the developing device and the detection means 206*a* (or 206*b* or 206*c*) provided in the toner cartridge 179*a* (or 179*b* and 179*c*) is fed to control means 220 shown in FIG. 11. On the other hand, the illustrated display means 200 includes three lamps provided in an operating panel (not shown) in the electrostatic copying machine, i.e., a first lamp 222, a second lamp 224 and a third lamp 226. The control means 220 turns on the first lamp 222 when the first cartridge 179*a* is loaded into the toner holding chamber 178 on the basis of the signal from the cartridge discriminating means 198 as will be described in detail hereinafter. Likewise, it turns on the second lamp 224 when the second cartridge 179*b* is loaded, and the third lamp 226 when the third cartridge 179*c* is loaded.

This electrostatic copying machine is so constructed that when the third toner cartridge 179*c* is loaded into the main body 166 of the developing device, it is virtually impossible to remove the third cartridge 179*c* from it. With reference mainly to FIGS. 9-C and 10-B, locking means 228 is provided in the main body 166 of the developing device and the third toner cartridge 179*c*. The locking means 228 is comprised of a first engaging portion provided in the toner cartridge 179*c* and an engagement portion provided in the end wall 167 (FIGS. 10-A and 10-B) of the main body 166 of the developing device. The first engaging portion consists of a pair of first unreleasable claw members 230 provided in both ends of the rear surface of the main body 192 of the receptacle in the toner cartridge 179*c*. The first claw members 230 have an elastically deformable base portion, and sharp unreleasable claw portions 232 at their front end portions. The engagement portion, on the other hand, has a pair of holes 234 (FIGS. 10-A and 10-B) formed in the end wall 167 of the main body 166 of the developing device in correspondence to the pair of first claw members 230. Hence, when the toner cartridge 179*c* is loaded into the main body 166 of the developing device and held at the holding position (shown by a solid line in FIG. 10-B), the claw portions 232 of the pair of first claw members 230 project outwardly through the holes formed in the rear wall 167 of the developing device 166, and engage part of the end wall 167 by the elastic recovering force of the base portions of the projecting claw portions 232. After this engagement, the two cannot substantially be disengaged because the claw portions 232 are sharp and pointed.

As shown in FIGS. 9-A, 9-B and 10-A, a second engaging portion is provided in the first toner cartridge 179*a* and the second toner cartidge 179*b* in relation to the pair of holes 234 in the end wall 167 of the main body 166 of the developing device. The second engaging portion is composed of a pair of releasable second claw members 236 provided at both ends of the rear surface of the main receptacle body 192 in each of the toner cartridges 179*a* and 179*b*. The second claw member 236 has an elastically deformable base portion with a releasable rounded claw portion 238 provided at its front end portion. Hence, when the toner cartridge 179*a* (or 179*b*) is loaded into the main body 166 of the developing device and held at a holding position at which it is received in place in the toner holding chamber 178 (the position shown by a solid line in FIG. 5-A). the claw portions 238 of the pair of second claw members 236 project outwardly through the holes 234 formed in the end wall 167 of the main body 166 in the developing device and engage part of the end wall 167 by the elastic recovery force of the base portions of the claw portions 238. On the other hand, when the toner cartridge 179*a* (or 179*b*) is moved forwardly from this state, the pair of second claw members 238 are disengaged relatively easily from the end wall 167 because the claw portions 238 are rounded, and the toner cartridge 179*a* (or 179*b*) can be detached from the main body 166 of the developing device.

The electrostatic copying machine described above is constructed such that in relation to a discrimination signal from the cartridge discriminating means 198, the image-forming conditions can be adjusted. With reference mainly to FIG. 11, the electrostatic copying machine is provided with means for adjusting image-forming conditions includes adjusting means 240 included in the control means 220, first voltage adjusting means 242 and second voltage adjusting means 244. The adjusting means 240 produces a first adjusting signal and a second adjusting signal on the basis of the discrimination signal from the cartridge discriminating means 198, and feeds the first and second adjusting signals to the first voltage adjusting means 242 and the second voltage adjusting means 244. The first voltage adjusting means 242 adjust the voltage fed to the illuminating lamp 46 from a lamp voltage source 246 and slightly increases this voltage on the basis of the first adjusting signal, and further increases the voltage slightly on the basis of the second adjusting signal. The second voltage adjusting means 244 adjusts a development bias voltage applied to the sleeve 170 of the applicator means 164 by a bias voltage source 248, and slightly increases the development bias voltage on the basis of the first adjusting signal and further increases the development bias voltage slightly on the basis of the second adjusting signal.

In the illustrated embodiment, the voltage fed to the illuminating lamp 46 (in other words, the exposure intensity of the illuminating lamp 46) and the development bias voltage as image-forming conditions are adjusted on the basis of the discrimination signal from the cartridge discriminating means 198. If adjustment of either one of them suffices, that condition alone may be adjusted as is required. Together with, or in addition to, these conditions, a voltage to be applied to the charging corona discharger 32 and/or the transfer corona discharger 66 may be adjusted.

The illustrated electrostatic copying machine is also constructed such that when the service life of the electrostatographic material 29 of the rotating drum 28 substantially ends, the operator will be informed of it. The control means 220 further includes life signal producing means 250 which produces a life signal on the basis of signals from the detector 187 and the cartridge discriminating means 198 (FIG. 11). The detector 187 (constituting first detection means) produces a toner supply signal when the concentration of the toner in the developer decreases below a predetermined value. The toner supply signal is fed to the control means 220, and the control means 220 energizes a driving source $M_1$ for rotating the toner supply roller 190 on the basis of the toner supply signal. The detector 187 further produces a cartridge replacement signal instead of the toner supply signal when in spite of the energization of the driving source $M_1$. it continues to produce the toner supply signal for a predetermined period of time (for example, 10 seconds). The cartridge replacement signal is also fed to the control means 220, and the control means 220 turns on a replacement display lamp 252 provided in an operating panel (not shown) on the basis of the cartridge replacement signal.

The cartridge discriminating means 198, particularly the terminals 204*a*, 204*b* and 204*c* provided in the main body 166 of the developing device (which constitute cartridge detecting means for detecting the third cartridge 179*c*) and the linking member 208*c* (constituting cartridge detection means) provided in the third toner cartridge 179*c*, also act as second detecting means for detecting the third final toner cartridge 179*c*. When the toner cartridge 179*c* is loaded into the toner holding chamber 178, the terminals 204*a*, 204*b* and 204*c* are linked via the linking member 208*c*, and consequently, the cartridge discriminating means 198 produces a final cartridge signal. The life signal producing means 250 of the control means 220 produces a life signal on the basis of the cartridge replacement signal from the detector 187 and the final cartridge signal from the cartridge discriminating means 198 (the signal produced particularly by the terminals 204*a*, 204*b* and 204*c* and the linking member 208*c*). In the illustrated embodiment, a life display lamp 254 (FIG. 11) is further provided in the operating panel (not shown), and the control means 220 turns on the life display lamp 254 on the basis of the life signal produced by the life signal producing means 250. Instead of turning on the life display lamp 254, it is possible to construct the electrostatic copying machine such that the entire machine will be stopped by deenergizing an electric motor (not shown) constituting a main driving source in the machine.

Figure 12:
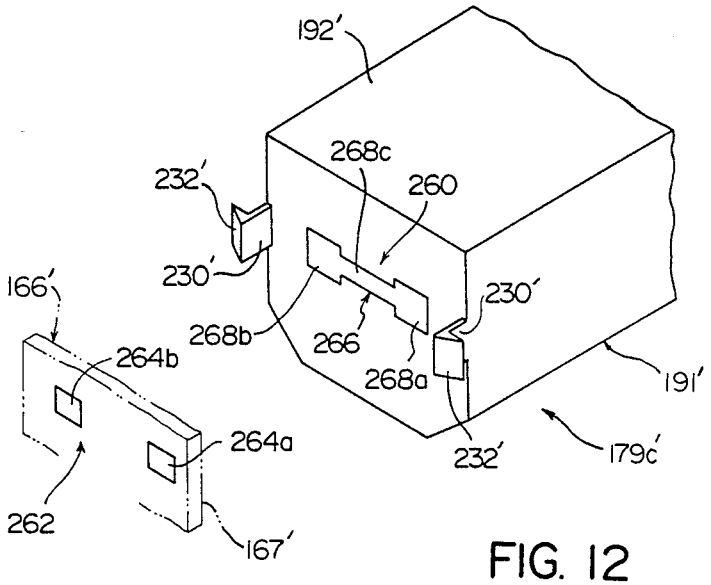
FIG. 12 is a perspective view showing second detecting means used instead of the cartridge discriminating means to detect a final toner cartridge, and elements related to it.

In the illustrated embodiment, the signal from the cartridge discriminating means 198 for discriminating the toner cartridge 179*a* (or 179*b*or 179*c*) loaded in the toner holding chamber 178 of the developing device 34 is utilized. When the electrostatic copying machine is not provided with the cartridge discriminating means 198, second detecting means, for example, the one shown in FIG. 12, may be used. With reference to FIG. 12, the illustrated second detecting means comprises cartridge detection means 260 provided in the third toner cartridge 179*c* and cartridge detecting means 262 provided in the end wall 167′ (the rear end wall) of the main body 166 of the developing device. The illustrated cartridge detecting means 262 has a pair of terminals 264*a* and 264*b* spaced from each other laterally on the inner surface of the end wall 167′. The illustrated cartridge detection means 260 is comprised of a linking member 266 provided in the rear surface of the rear wall of the main receptacle body 192′ in the toner cartridge 179*c*′. The linking member 266 has a terminal portion 268*a* disposed in correspondence to the terminal 264*a*, a terminal portion 268*b* disposed in correspondence to the terminal 264*b* and a linking portion 268*c* linking the terminal portions 268*a* and 268*b*. Thus, when the third toner cartridge 179*c*′ is loaded into the toner holding chamber and held at the holding position, the terminal 264*a* is linked to the terminal portion 268*a*, and the terminal 264*b*, to the terminal portion 268*b*. As a result, the terminals 264*a* and 264*b* provided in the main body 166′ of the developing device are linked to each other via the linking member 266 provided in the toner cartridge 179*c*′ and the second detecting means produces a final cartridge signal.

With reference mainly to FIGS. 1, 9-A to 9-C, 10-A, 10-B, and 11, when the electrostatic copying machine is to be used, the start developer held in the developer holding chamber 177 is supplied to the developing chamber 176. The first toner cartridge 179*a* is loaded into the main body 166 of the developing device 34 and held in the toner holding chamber 178. Loading of the toner cartridge 179*a* is effected by inserting the toner cartridge 179*a* into the upper part of the toner holding chamber 178 through the opening 195 formed in the end a wall 167 (not shown) of the developing device and the front wall 126 of the unit frame 22, as can be understood from FIGS. 2 and 9-A. After loading, a seal member (not shown) such as an adhesive tape applied to the discharge opening formed in the main receptacle body 192 of the toner cartridge 179*a* is peeled off to expose the discharge opening. When the toner cartridge 179*a* is inserted as far as the holding position shown by a solid line in the direction of arrow 270 in FIG. 10-A, the rear surface of the main receptacle body 192 of the toner cartridge 179*a* abuts against the inner surface of the end wall 167 of the developing device 34. Thus, the claw portions 238 of the second claw members 236 in the toner cartridge 179*a* releasably engage part of the end walls 167 through the holes 234 formed in the end walls 167 whereby the toner cartridge 179*a* is held in the aforesaid holding position. When the toner cartridge 179*a* is so loaded, the terminals 204*a* and 204*b* provided in the main body 166 of the developing device are linked via the linking member 208*a* provided in the first toner cartridge 179*a*, whereupon the cartridge discriminating means 198 produces a first cartridge signal. As a result, the first cartridge signal is fed to the control means 220, and the control means 220 turns on the first lamp 222 on the basis of the first cartridge signal. Hence, the first lamp 222 indicates that the first toner cartridge 179*a* is loaded in the toner holding chamber 178, and the operator can perform a number of copying cycles until the electrostatographic material 29 and therefore the process unit 16 substantially come to the end of their lives (at least about 4,000 copies can be produced further).

When the aforesaid initial preparatory operation has been carried out, the latent electrostatic image can be developed by the developing device 34.

When thereafter, the toner concentration of the developer decreases with the performance of copying, the detector 187 detects it and produces a toner supply signal. On the basis of the toner supply signal, the control means 220 energizes the driving source $M_1$ to rotate the toner supply roller 190 in the direction of arrow 189. As a result, the toner discharged from the toner cartridge 179*a* and held in the toner holding chamber 178 is supplied to the developing chamber 176 through the toner discharge opening and the toner concentration of the developer is increased.

When about 2,000 copies are produced in the illustrated embodiment, substantially all toner in the toner cartridge 179*a* is consumed. As a result, the toner concentration is decreased, and even when the toner supply roller 190 is rotated on the basis of the toner supply signal, no toner is supplied to the developing chamber 176 from the toner holding chamber 178 and the toner supply signal continues to be produced. When the toner supply signal is continuously produced for a predetermined period of time (for example, 10 seconds), a cartridge replacement signal is produced instead of the toner supply signal. The cartridge replacement signal is then fed to the control means 220. The control means 220 thus turns on the replacement display lamp 252 on the basis of the cartridge replacement signal and informs the operator that the toner cartridge 179*a* should be replaced.

The second toner cartridge 179*b* may be loaded after the toner cartridge 179*a* is detached from the main body 166 of the developing device. Specifically, the gripping portion 193 of the toner cartridge 179*a* is held and moved in the detaching direction shown by arrow 272 to disengage the claw portions 238 of the second claw members 236 from part of the end walls 167. The toner cartridge 179*a* is further moved in the direction of arrow 272 and detached from the toner holding chamber 178. Thereafter, the second toner cartridge 179*b* is detachably loaded in the same manner as in the case of the first toner cartridge 179*a*. Specifically, as can be understood from FIGS. 2 and 10-A, the toner cartridge 179*b* is inserted into the toner holding chamber 178 through the opening 195 formed in the front wall 126 of the unit frame 22 and the end walls 167 in the developing device 34. After loading, the seal member applied to the discharge opening of the main receptac.le body 192 is peeled off to expose the discharge opening. When the toner cartridge 179*b* is inserted likewise as far as the holding position shown by a solid line in the direction of arrow 270 as shown in FIG. 10-A, the rear surface of the main receptacle body 192 in the toner cartridge 179*b* abuts against the inner surface of the end wall 167 in the developing device 34. Thus, claw portions 238 of the second claw members 236 engage part of the end walls 167 through the holes 234 formed in the end walls 167, whereby the toner cartridge 179*b* is held at the holding position. When the toner cartridge 179*b* is so loaded, the terminals 204*b* and 204*c* provided in the main body 166 of the developing device are linked to each other via the linking member 208*b* provided in the second toner cartridge 179*b*, whereupon the cartridge discriminating means 198 produces a second cartridge signal. The second cartridge signal is fed to the control means 220, and the control means 220 turns on the second lamp 224 on the basis of the second cartridge signal. Hence, the second lamp 224 indicates that the second toner cartridge 179*b* is loaded in the toner holding chamber 178, and the operator can perform copying until the electrostatographic material 29, and therefore the process unit 16, substantially come to the end of their lives (at least about 2,000 copies can be produced). Furthermore, the adjusting means 240 in the control means 220 produces a first adjusting signal on the basis of the second cartridge signal, and the first adjusting signal is fed to the first and second voltage adjusting means 242 and 244. When the first adjusting signal is fed to the first voltage adjusting means 242, the first voltage adjusting means 242 slightly increases the voltage fed to the illuminating lamp 46 from the lamp voltage source 246, for example from 70 V to 72 V, and slightly increases the exposure intensity of the illuminating lamp 46. When the first adjusting signal is fed to the second voltage adjusting means 244, the second voltage adjusting means 244 slightly increases the development bias voltage applied to the sleeve 170 of the applicator means 164 by the bias voltage source 248, for example, from 200 V to 220 V. As a result, the degradation of image quality owing to the fatigue of the electrostatographic material 29 of the rotating drum 28 with the performance of copying can be remedied by slightly changing the voltage to be supplied to the illuminating lamp 46 and the development bias voltage.

When about 2,000 copies are further produced after replacement of the cartridge with the cartridge 179*b* (therefore, about 4,000 copies have been produced from the start of using the machine), substantially all toner in the toner cartridge 179*b* is consumed. As a result, the toner concentration is decreased, and even when the toner supply roller 190 is rotated on the basis of the toner supply signal from the detector 187, no toner is supplied to the developing chamber 176 from the toner holding chamber 178, and the toner supply signal continues to be produced. When the toner supply signal is produced continuously for a predetermined period of time (for example, 10 seconds), a cartridge replacement signal is produced in place of the toner supply signal. Consequently, the control means 220 turns on the replacement display lamp 252 on the basis of the cartridge replacement signal, and informs the operator that the toner cartridge 179*b* should be replaced.

The toner cartridge 179*b* is detached and the third final cartridge 179*c* is loaded. Specifically, by holding the gripping portion 193 of the toner cartridge 179*b*, the cartridge 179*b* is moved in the detaching direction shown by arrow 272 to disengage the claw portions 238 of the second claw member 236 from part of the end walls 167. It is further moved in the direction of arrow 272 and detached from the toner holding chamber 178. Then, the third toner cartridge 179*c* is loaded into the toner holding chamber 178 through the opening 195 formed in the front wall 126 of the unit frame 22 and the end walls 167 of the developing device 34 as can be seen from FIGS. 2 and 10-B. After loading, the seal member applied to the discharge opening of the main receptacle body 192 is peeled off to expose the discharge opening. When the toner cartridge 179*c* is inserted as far as the holding position shown by a solid line in FIG. 10-B in the loading direction shown by an arrow 270, the rear surface of the main receptacle body 192 of the toner cartridge 179*c* abuts against the inner surface of the end wall 167 of the developing device 34. Thus, the claw portions 232 of the first claw members 230 of the toner cartridge 179*c* engage part of the end walls 167 through the holes 234 formed in the end walls 167, whereby the toner cartridge 179*c* is held at the holding position. Furthermore, as a result of this loading, the terminals 204*a*, 204*b* and 204*c* provided in the main body 166 of the developing device are linked to each other via the linking member 208*c* provided in the third toner cartridge 179*c*, whereupon the cartridge discriminating means 198 produces a final cartridge signal. The final cartridge signal is fed to the control means 220, and turns on the third lamp 226 on the basis of the final cartridge signal. Hence, the third lamp 226 indicates that the third toner cartridge 179*c* is loaded in the toner holding chamber 178, and the operator can easily learn from it that the electrostatographic material 29, and therefore the process unit 16, have little service life left. Furthermore, as a result of the above action, the adjusting means 240 in the control means 220 produces a second adjusting signal on the basis of the final artridge signal, and the second adjusting signal is fed to the first and second voltage adjusting means 242 and 244. When the second adjusting signal is fed to the first voltage adjusting means 242, the first voltage adjusting means 242 further increases the voltage supplied to the illuminating lamp 46 from the lamp voltage source 246, for example by 2 V from 72 V to 74 V, and further slightly increases the exposure intensity of the illuminating lamp. When the second adjusting signal is fed to the second voltage adjusting means 244, the second voltage adjusting means 244 further increase the development bias voltage applied to the sleeve 170 of the applicator means 164 by the bias voltage source 248, for example by 20 V from 220 V to 240 V. As a result, the degradation of image quality owing to the fatigue of the electrostatographic material 29 of the rotating drum 28 with the performance of copying can be remedied by again lightly changing the voltage to be supplied to the illuminating lamp 46 and the development bias voltage.

When after loading the third toner cartridge **179*c* about 2,000 copies are further produced (about 6,000 copies have been produced in total from the start of using the machine), substantially all toner in the cartridge 179*c* is consumed. As a result, in spite of the decreasing of the toner concentration, no toner is supplied from the toner holding chamber 178 and the toner supply signal continues to be produced. When this toner supply signal is continuously produced for a predetermined period of time (for example, 10 seconds), a cartridge replacement signal is again produced in place of the toner supply signal. Consequently, the life signal producing means 250 in the control means 220 produces a life signal on the basis of the cartridge replacement signal from the detector 187 and the final cartridge signal from the cartridge discriminating means 198. When the life signal is so produced, the control means 220 turns on the life display lamp 254 on the basis of the life signal, and informs the operator that the process unit 16 substantially comes to the end of its life, and should be replaced by a new process unit 16. In the illustrated embodiment, the life display lamp 254 is turned on in place of the replacement display lamp 252 when the electrostatographic material substantially comes to the end of its life. If desired, the control means 220 may be constructed such that the replacement display lamp 252** is simultaneously turned on.

In the illustrated embodiment, engagement of the first claw members 230 with part of the end walls 167 of the toner cartridge **179*c* cannot substantially be cancelled. Hence, no new toner cartridge can be loaded in place of the toner cartridge 179*c*. This also permits confirmation of the substantial end of the life of the electrostatographic material 29 and therefore the process unit 16**. Further, by hampering loading of a new cartridge, subsequent performance of image formation can be accurately hampered. Thus, formation of an undesirable image can be prevented.

In the illustrated embodiment, the cartridge discriminating means 198 includes the terminals **204*a*, 204*b* and 204*c* provided in the main body 166 of the developing device and the linking members 208*a*, 208*b* and 208*c* provided in the toner cartridges 179*a*, 179*b* and 179*c* respectively. Alternatively, it is possible to provide three detectors in the main body 166 of the developing device and detection members corresponding to the detectors in the toner cartridges 179*a*, 179*b* and 179*c***.

Furthermore, in the first embodiment, the second claw members 236 are provided in the first toner cartridge **179*a* and the second toner cartridge 179*b* so as to hold the cartridges detachably at the holding position. These second claw members 236** may be omitted when the cartridges can be held at the holding position in the required manner without them.

Figure 21:
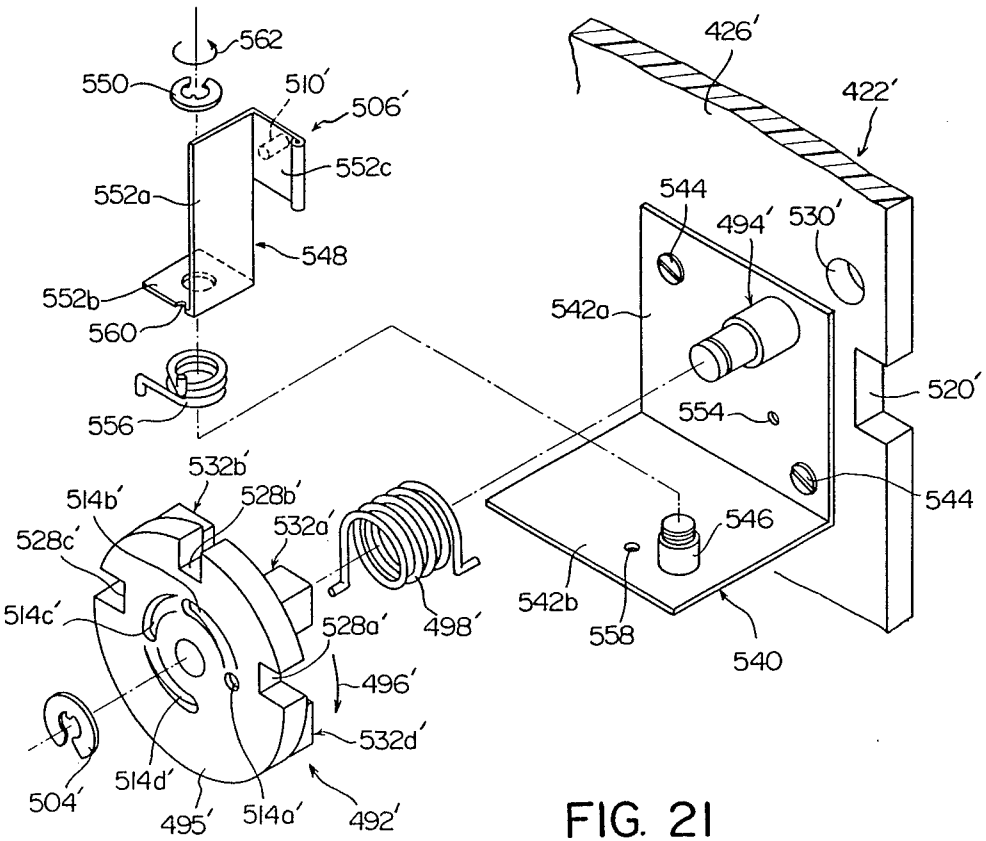
FIG. 21 is an exploded perspective view showing a modified embodiment of loading-hampering means provided in the process unit and its related elements in an exploded form as viewed from the rear side.

In the first embodiment, the locking means 228 for preventing detachment of the third toner cartridge **179*c* is provided. Hence, when the third toner cartridge 179*c* is erroneously loaded in place of the first or second toner cartridge 179*b* or 179*c*, performance of copying becomes substantially impossible after consuming the toner in the toner cartridge 179*c* in spite of the fact that the service life of the electrostatographic material 29 has not come to an end yet (and therefore, the process unit 16 should be replaced). Preferably, therefore, a mechanism (to be described) having a hampering plate, as shown in FIGS. 21 to 23**, is provided in order to prevent erroneous loading of the toner cartridge mentioned above.

The first embodiment is constructed such that when the toner supply signal is produced continuously for a predetermined period of time, the detector 187 produces a cartridge replacement signal. Instead of this, it may be so constructed that when there is produced a predetermined concentration lower than that at which the toner supply signal is produced, the detector 187 produces a toner cartridge replacement signal.

Furthermore, in the first embodiment, the life signal is produced on the basis of the signal from the cartridge discriminating means 198 for discriminating the toner cartridge loaded in the main body 166 of the developing device and the detector 187. Alternatively, it is possible to provide detecting means for detecting the number of toner cartridges loaded into the main body 166 of the developing device, detect the final toner cartridge by this detecting means and produce a life signal on the basis of the signals from the detecting means and the aforesaid detector 187.

Electrostatic Copying Machine in Second Embodiment

In the first embodiment of the electrostatic copying machine described above, the life signal producing means 250 produces the life signal on the basis of the final cartridge signal from the cartridge discriminating means 198 and the cartridge replacement signal from the detect or 187. Preferably, the life signal producing means 250 produces the life signal in the following manner.

In the second embodiment of the electrostatic copying machine is provided with third detecting means which produces a rotation signal when the rotating number of the rotating drum 28 constituting the image-bearing means exceeds a predetermined value, in addition to the detector 187 (constituting the first detector for producing a cartridge replacement signal when the toner concentration decreases) and the cartridge discriminating means 198, particularly the terminals **204*a*, 204*b* and 204*c* provided in the end walls 167 of the main body 166 of the developing device and the linking member 208*c* provided in the main receptacle body 192 of the third toner cartridge 179*c* (constituting the second detecting means for producing a final cartridge signal by detecting the final toner cartridge 179*c***).

Figure 13:
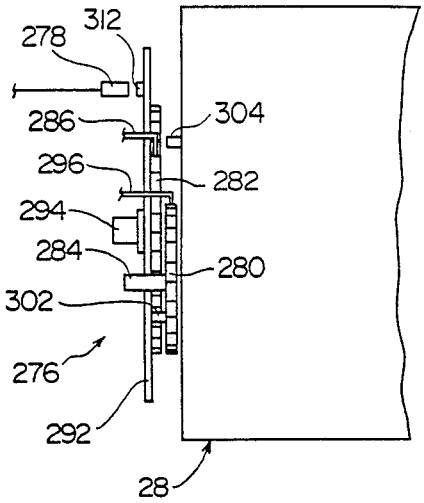
FIG. 13 is a side elevation showing the front portion of a rotating drum in a second embodiment of the electrostatic copying machine as one example of the image-forming machine in accordance with this invention.
Figure 14:
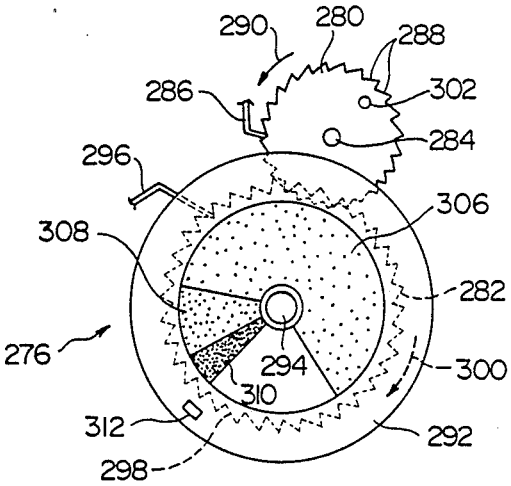
FIG. 14 is a view showing a measuring mechanism in the second embodiment of the electrostatic copying machine of FIG. 13.

The third detecting means is, for example, of the structure shown in FIGS. 13 and 14. In FIGS. 13 and 14 showing the rotating drum and its vicinity in the second embodiment of the electrostatic copying machine, the third detecting means includes a measuring mechanism 276 for measuring the rotation number of the rotating drum 28, and a detector 278 for producing a predetermined rotation signal in relation to the measuring mechanism 276. The measuring mechanism 276 is provided with a small ratchet wheel 280 and a large ratchet wheel 282. The small ratchet wheel 280 is rotatably mounted on a pin 284 implanted in the inner surface of the front wall (not shown) of the unit frame. The small ratchet wheel 280 further has an engaging member 286 annexed thereto, and the engaging member 286 is biased by biasing means (not shown) such as a spring member so as to come into engagement with a pawl 288. Hence, the engaging member 286 permits rotation of the small ratchet wheel in the direction shown by an arrow 290 (FIG. 14), but accurately hampers its rotatin in a direction opposite to the direction of arrow 290. In the illustrated embodiment, the large ratchet wheel 282 is fixed to the inner surface of a rotating member 292 constructed of a circular plate, and the rotating member 292 and the large ratchet wheel 282 are rotatably mounted on a pin 294 implanted in the inner surface of the front wall (not shown) of the unit frame. The large ratchet wheel further has an engaging member 296 annexed thereto, and the engaging member 296 is also biased so as to engage a pawl 298 by biasing means (not shown) such as a spring member. Accordingly, the engaging member 296 permits rotation of the large ratchet wheel 282 in the direction shown by an arrow 300 (FIG. 14), but accurately hampers its rotation in a direction opposite to the direction of arrow 300. In the measuring system 276, an actuation pin 302 engageable with the pawl 298 of the large ratchet wheel 282 is implanted in the outside surface (the left surface in FIG. 13) of the small ratchet wheel 280. An actuation pin 304 (FIG. 13) engageable with the pawl 288 of the small ratchet wheel 280 is also implanted in the front end surface of the rotating drum 28. Because of the above structure, when the rotating drum 28 rotates through one turn, the actuation pin 302 acts on the pawl 288 of the small ratchet wheel 280 to rotate it by a predetermined angle in the direction shown by arrow 290 (namely, rotate it by one pawl). After one turn of the small ratchet wheel 280, the actuation pin 302 acts on the pawl 298 of the large ratchet wheel 282 to rotate it by a predetermined angle in the direction of arrow 300 (by one pawl).

In relation to the above structure, a first display portion 306, a second display portion 308 and a third display portion 310 are provided in a fan-like arrangement on the outside surface (the left surface in FIG. 13) of the rotating member 292. The first display portion 306 is colored green, for example; the second display portion 308 is colored yellow, for example; and the third display portion 310 is colored red, for example. A detection member 312 which may be constructed of a permanent magnet, for example, is provided outwardly of one side end (the upstream end as viewed in the rotating direction shown by arrow 300) of the third display portion 310. The detector 278 which can be formed of a reed switch, for example, is disposed in relation to the detection member 312. In the second embodiment, the rotating drum 28 is adapted to rotate through about 4 turns, for example, in order to perform one copying cycle, and in relation to this, the detection member 312 is designed to come to a position (shown in FIG. 13) opposite to the detector 278 with the rotation of the rotating member 292 when the rotating drum 28 has rotated throug 24,000 turns. It is possible to know the remaining copying cycles by utilizing the first display portion 306, the second display portion 308 and the third display portion 310 provided in the rotating member 292.

Figure 15:
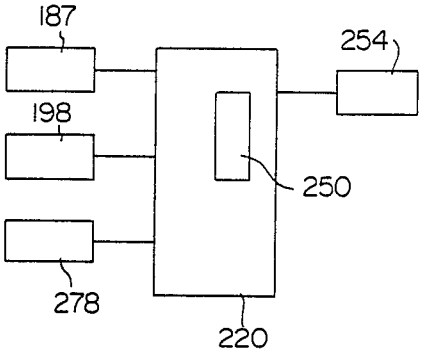
FIG. 15 is a view showing part of a control system in the electrostatic copying machine of FIG. 13 in a simplified form.

With reference to FIG. 15 also, in the second embodiment, when the rotating drum 28 has substantially rotated through 24,000 turns, the rotating member 292 is rotated with the rotation of the rotating drum 28, and the detection member 312 provided in the rotating member 292 is brought to a position (shown in FIG. 8) opposite to the detector 278. As a result, the detector 278 detects the detection member 312 and produces a predetermined rotation signal. At this time, the third toner cartridge is loaded in the toner holding hamber of the developing device (when the rotating drum 28 has substantially rotated through 24,000 turns, the copying has been performed through about 6,000 cycles. Hence, all of the toners in the first and second toner cartridges have been consumed, and the toner in the third toner cartridge is being used), and the cartridge discriminating means 198 is producing a final cartridge signal. Hence, when the third detecting means produces a predetermined rotation signal, both the rotation signal and the final cartridge signal are fed into the life signal producing means 250 of the control means 220, and the life signal producing means 250 produces a life signal. In the second embodiment, when the detector 187 produces a cartridge replacement signal as described above instead of the third detecting means which produces a predetermined rotation signal, the life signal producing means 250 produces a life signal on the basis of the final cartridge signal and the cartridge replacement signal. When the life signal is so produced, the control means 220 turns on a life display lamp 254 (FIG. 15) on the basis of the life signal and informs the operator that the process unit 16 has substantially come to the end of its service life.

When as in the first embodiment, the life signal is adapted to be produced only on the basis of the final cartridge signal and the cartridge replacement signal, inconvenience might occur. Specifically, when a number of relatively bright documents are copied, the amount of the toner consumed is relatively small, and a life signal might not be produced even when the electrostatographic material has substantially come to the end of its life. This inconvenience can be avoided accurately by producing a life signal based on the final cartridge signal and the cartridge replacement signal or on the predetermined rotation signal, whichever is produced earlier, as in the second embodiment.

Electrostatic Copying Machine in the Third Embodiment

Now, the third embodiment of the electrostatic copying machine will be described with reference to FIGS. 16 to 20.

Figure 16:
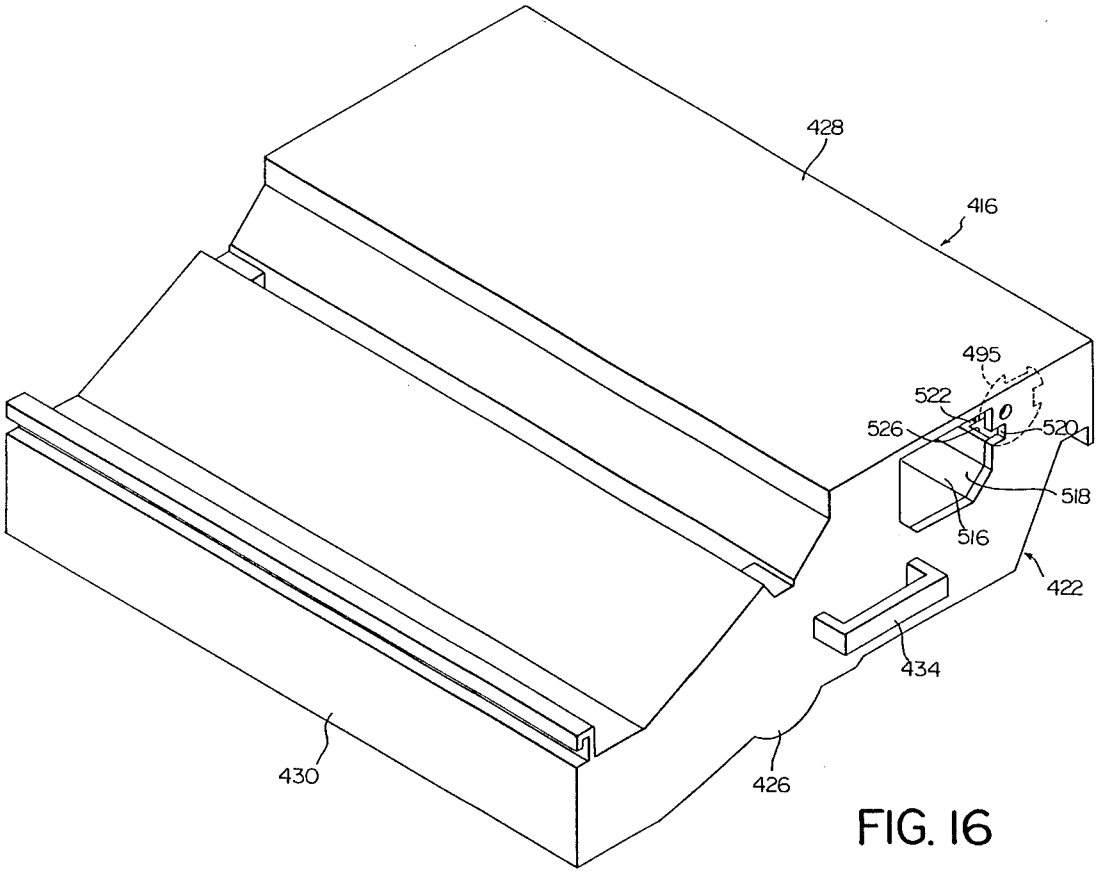
FIG. 16 is a perspective view showing a process unit in a third embodiment of the electrostatic copying machine as one example of the image-forming machine in accordance with this invention.

With reference mainly to FIG. 16, a process unit 416 in the third embodiment has a unit frame 422, and a rotating drum, a developing device and a cleaning device (not shown) are mounted on the unit frame 422 as in the first embodiment. The rotating drum, developing device and cleaning device may, for example, be the same as those in the first embodiment. The process unit 416 of this structure is detachably mounted on an upper supporting frame (not shown) in an electrostatic copying machine of the same structure as the electrostatic copying machine in the first embodiment.

The unit frame 422 of the illustrated process unit 416 has a front wall 426 and a rear wall (not shown) disposed in spaced-apart relationship in the front-rear direction (the direction from right bottom to left top in FIG. 16), and between the front wall 426 and the rear wall, an upper wall 428, a left side wall 430 and a right side wall are provided. The rotating drum, developing device and cleaning device are mounted between the front wall 426 and the rear wall. A gripping portion 434 is provided in the front wall 426 of the unit frame 422 in order to permit easy mounting and detachment on and from the upper supporting frame.

The developing device mounted on the unit frame 422, although not shown, may be of substantially the same structure as in the first embodiment, and the main body of the developing device provided with various walls defines three chambers, i.e. a developing chamber, a developer holding chamber and a toner holding chamber. In the developing device in the third embodiment, a two-component developer composed of a carrier and a toner is used. In the developer chamber, a "start developer" to be supplied to the developing chamber in use is contained. A toner cartridge 462 (FIG. 18) to be described is loaded into the toner holding chamber and a toner discharged from the toner cartridge 462 is held in it. In the developing chamber, applicator means for applying a toner to the surface of the electrostatographic material on the rotating drum and agitating means for agitating the developer are disposed. A detailed description of the developing device is omitted herein.

Figures 17, 18:
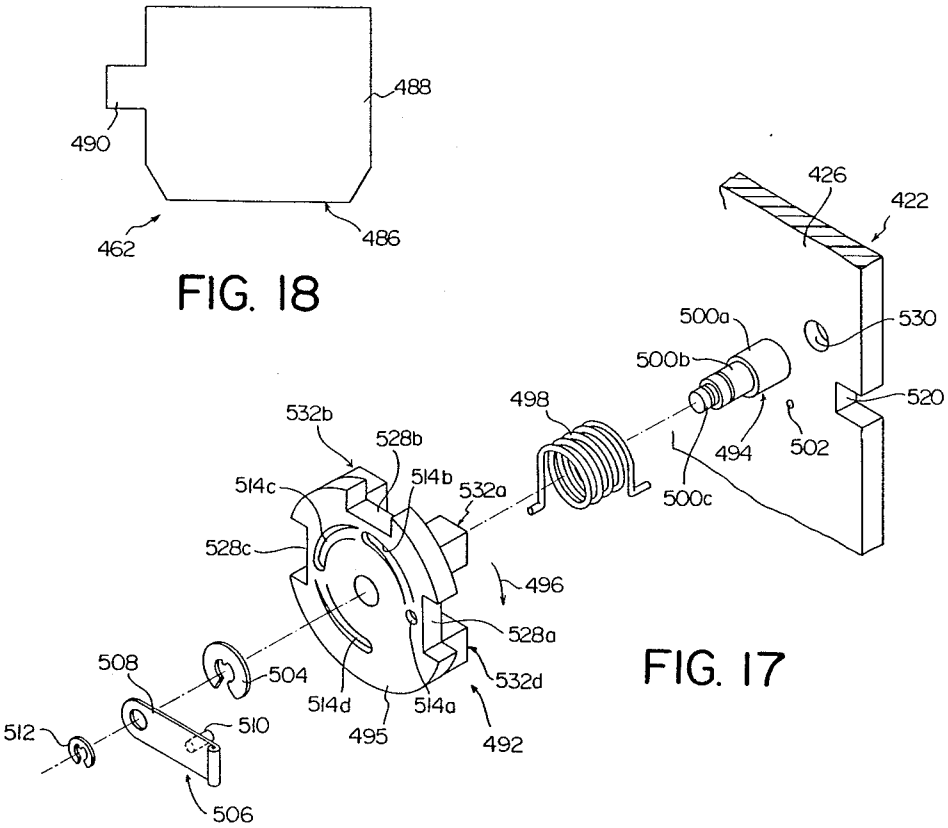
FIG. 17 is an exploded perspective view showing loading-hampering means and related elements mounted on the process unit of FIG. 16 in an exploded form as viewed from the back.
FIG. 18 is a rear view of a toner cartridge to be loaded into the main body of the developing device in the process unit of FIG. 16, as viewed from the rear side.

In the electrostatic copying machine of the third embodiment, the number of loadings of the toner cartridge 462 corresponds substantially to the life of the electrostatographic material of the rotating drum, and therefore to the life of the process unit 416, and when the toner cartridge 462 has been loaded three times, the process unit 416 comes to the end of its service life. With reference to FIGS. 17 and 18, the electrostatographic material of the rotating drum (not shown) comes to the end of its life when about 6,000 copies have been proposed. In relation to this, three toner cartridges 462 are provided for one process unit 416. In the third embodiment, too, each toner cartridge 462 is filled with toner in an amount required for producing about 2,000 copies, and the toner cartridges 462 are selectively loaded into the toner holding chamber (not shown) of the main body of the developing device. The toner cartridges 462 are substantially of the same structure and are each provided with a receptacle 486 holding toner. The illustrated receptacle 486 has a box-like main body 488 having a discharge opening (not shown) formed at its under surface and a gripping portion (not shown) provided in one end surface (front surface) of the main body 488. In the illustrated embodiment, a longitudinally (in the direction perpendicular to the sheet surface in FIG. 18) extending protrusion 490 is provided integrally on one side surface of each toner cartridge 462.

The process unit 416 in the illustrated embodiment further includes loading hampering means shown generally at 492. With reference mainly to FIG. 17, the loading hampering means 492 has a hampering plate 495 in the form of a disc. A supporting shaft 494 projecting inwardly is implanted in the inner surface of the front wall 426 of the unit frame 422, and the hampering plate 495 is rotatably mounted on the supporting shaft 494. In relation to the fact that three toner cartridges 462 are to be selectively loaded into the main body of the developing device, the hampering plate 495 is adapted to be rotated substantially through 90 degrees at the time of loading and/or detaching the toner cartridge 462, as will be described hereinbelow. In relation to the hampering plate 495, biasing means for biasing the hampering plate 495 in the direction shown by an arrow 496 (in the clockwise direction in FIG. 17, and in the counterclockwise direction in FIGS. 19-A to 19-C) is provided. The biasing means is comprised of a torsion coil spring 498 and fitted over the large-diameter portion 500*a* of the supporting shaft 494. One end of the torsion coil spring 498 is connected to the front wall 426 of the unit frame 422 (by inserting one end into a hole 502 formed in the front wall 426), and its other end is connected to the hampering plate 495 (by inserting the other end into a recessed portion formed on the outside surface of the hampering plate 495) (FIGS. 20-A and 20-B). The hampering plate 495 is rotatably mounted on the medium-diameter portion 500*b* of the supporting shaft 494, and an engaging member 504 for preventing detachment of the hampering plate 495 is mounted on the outside end portion of the medium-diameter portion 500*b*. Locking means 506 is also provided in relation to the hampering plate 495. The locking means 506 contains an elastically deformable plate member 508 such as a plate spring, and a lock pin 510 is provided at one end portion of the plate member 508. The other end portion of the plate member 508 is mounted on the small-diameter portion 500*c* of the supporting shaft 494, and an engaging member 512 for preventing detachment of the plate member 508 is mounted on the outside end portion of the small-diameter portion 500*c*. On the other hand, four recessed portions 514*a*, 514*b*, 514*c* and 514*d* are formed in the inner surface of the hampering plate 495 in relation to the fact that three toner cartridges 462 are to be loaded into the main body of the developer. The recessed portion 514*a* is circular, and when the lock pin 510 is received in it, the hampering plate 495 is held at a first angular position shown in FIG. 19-A. On the other hand, the recessed portions 514*b*, 514*c* and 514*d* extend in an arcuate shape and become increasingly deep in depth in a direction opposite to the biasing direction shown by an arrow 496. When the lock pin 510 is received in one end (the deepest site) of the recessed portion 514*b*, the hampering plate is held at a second angular position shown in FIG. 19-C. When the lock pin 510 is received at one end (the deepest site) of the recessed portion 514*c*, the hampering plate 495 is held at a third angular position. Furthermore, when the lock pin 510 is received at one end (deepest site) of the recessed portion 514*d*, the hampering plate 495 is held at a hampering position.

In the illustrated embodiment, loading of the toner cartridge 462 is hampered when the hampering plate 495 is held at the hampering position. Again with reference to FIG. 16, and an opening 516 is formed at a predetermined site in the front wall 426 of the unit frame 422 and a predetermined site in one end wall (the end wall located inwardly of the front wall 426) of a the developing device (FIG. 16 shows only one opening 516 formed in the front wall 426), and a cylindrical guide wall 518 is provided between the opening 516 in the front wall 426 and the opening 516 in the end wall (not shown). At the sites defining the openings 516 in the front wall 426 and the end wall, cuts 520 permiting passage of the protrusions 490 in the toner cartridge 462 during its loading are formed (in FIGS. 16 and 17, only the cut 520 formed in the front wall 426 is shown). Furthermore, in relation to this, a guide groove 522 for guiding the protrusion 490 is defined in the guide wall 518 as shown in FIG. 16. An opening 526 is formed at part of the site defining the guide groove 522 in the guide wall 518 so as to allow part of the hampering plate 495 to project into the guide wall 518.

On the other hand, three nearly rectangular cuts 528*a*, 528*b* and 528*c* are provided on the hampering plate 495 circumferentially at intervals of substantially 90 degrees. These cuts 528*a*, 528*b* and 528*c* are of substantially the same shape, and are constructed so as to allow passage of the protrusions 490 in the toner cartridges 462 therethrough. When the hampering plate 495 is at the first angular position, the cut 528*a* comes into alignment with the cut 520 in the front wall 426 in the front-rear direction. When the hampering plate 495 is at the second angular position, the cut 528*b* comes into alignment with the cut 520 of the front wall 426 in the front-rear direction. When the hampering plate 495 is at the third angular positon, the cut 528*c* comes into alignment with the cut 520 of the front wall 426 in the front-rear direction. Accordingly, it will be easily seen that at these angular positions, the protrusion 490 of the toner cartridge can move through the cut 520 of the front wall 426 and the cut 528*a* (or 528*b* or 528*c*) of the hampering plate 495, and loading of the toner cartridge 462 into the main body of the developing device is permitted. On the other hand, when the hampering plate 495 is at the hampering position, the peripheral part of the hampering plate 495 in which no cut is present (namely, that part which faces the cut 528*b*) is situated rearwardly of the cut 520 of the front wall 426. At this position, the protrusion 490 of the toner cartridge 462 can pass through the cut 520 of the front wall 426 but abuts against the aforesaid peripheral edge part of the hampering plate 495 to thereby hamper loading of the toner cartridge 462 into the main body of the developing device.

In the third embodiment, cartridge loading display means is further provided in the hampering plate 495 (which also acts as a moving member to be moved in relation to the loading and/or detachment of the toner cartridge 462). With reference mainly to FIGS. 17 and 19-A, the illustrated cartridge loading display means is provided on the outside surface of the hampering plate 495 (that surface which is opposite to the surface on which the recessed portions 514*a* to 514*d* are formed), and in relation to this, an opening 530 acting as a display window is formed in the front wall 426 of the unit frame 422. The cartridge loading display means includes four display portions 532*a*, 532*b*, 532*c* and 532*d* since the hampering plate 495 is selectively held at the first to third angular positions and the hampering position. In the illustrated embodiment, four rectangular protrusions 534*a*, 534*b*, 534*c* and 534*d* spaced from each other by an angle of subtantially 90 degrees are formed integrally on the outside surface of the hampering plate 495. The protrusion 534*a* acting as the display portion 532*a* is positioned inwardly of the opening 530 when the hampering plate 495 is at the first angular position (and therefore the end surface of the protrusion 534*a* can be visually observed through the opening 530) (see FIG. 20-A). The protrusion 534*b* acting as the display portion 532*b* is positioned inwardly of the opening 530 when the hampering plate 495 is at the second angular position. The protrusion 534*c* acting as the display portion 532*c* is positioned inwardly of the opening 530 when the hampering plate 495 is at the third position. The protrusion 534*d* acting as the display portion 532*d* is positioned inwardly of the opening 530 when the hampering plate 495 is at the hampering position. In the illustrated embodiment, the end surface of the protrusion 534*a* is marked "1"; the end surface of the protrusion 534*b* is marked "2"; hhe end surface of the protrusion 534*c* is marked "3"; and the end surface of the protrusion 534*d* is coated with a red color (which may be a red paint or a red tape). Accordingly, the cartridge loading display means displays the number of loadings of the toner cartridge 462 into the main body (not shown) of the developing device from the start of use, and the protrusion 534*d* marked red informs the operator that loading of another toner cartridge 462 is substantially impossible. Alternatively, the number of loadings of the toner cartridge 462 may be displayed by colors by, for example, marking the end surfaces of the protrusions 534*a* and 534*b* green, the end surface of the protrusion 534*c* yellow, and the end surface of the protrusion 534*d* red (by using a paint or a tape). In this case, the remaining number of loadings of the toner cartridge till the end of the life of the electrostatographic material and therefore the process unit 416 can be recognized by colors. If it is desired to attach importance to the remaining number of loadings of the toner cartridges till the end of the life of the process unit 416, it is possible to mark the end surface of the protrusion 534*a* "3", the end surface of the protrusion 534*b* "2", the end surface of the protrusion 534*c* "1" and the end surface of the protrusion 534*d* red.

In the electrostatic copying machine equipped with the process unit 416 described above, loading of the toner cartridge 462 is achieved by inserting the receptacle 486 into the upper part of the toner holding chamber (not shown) through the opening 516 formed in the front wall 426 of the unit frame 422, the interior of the guide wall 518 and the opening (not shown) formed in the end wall of the main body of the developing device. At the time of starting the use of the copying machine, the loading hampering meass 492 is in the state shown in FIG. 19-A and also by a solid line in FIG. 20-A. Specifically, the lock pin 510 provided in the plate member 508 is received in the recessed portion 514*a* formed in the hampering plate 495, and the hampering plate 495 is held at the first angular position shown in FIGS. 19-A and 20-A. When the hampering plate 495 is at the first angular position, the display portion 532*a* is exposed through the opening 530 formed in the front wall 426, and the operator can easily learn from the numeral "1" at the display portion 532*a* that the first toner cartridge 462 is to be loaded into the main body of the developing device. Accordingly, when the hampering plate 495 is held at the first angular position and the toner cartridge 462 is inserted as stated above, the protrusion 490 provided in the toner cartridge 462 abuts against one end portion of the plate member 508 through the cut 520 formed in the front wall 426 of the unit frame 422 and the cut 528*a* formed in the hampering plate 495 as shown by a solid line in FIG. 20-A. By the movement of the toner cartridge 462 in the loading direction shown by an arrow 536 (FIG. 20-A), the plate member 508 is elastically deformed slightly in FIG. 20A. As a result, the lock pin 510 provided in the plate member 508 comes out of the recessed portion 514*a* and the locking means 506 is released. The hampering plate 495 is thus biased in the direction of arrow 496 by the action of the torsion coil spring 498, whereby as shown in FIG. 19-B, the hampering plate 495 slightly rotates until part of it which defines the cut 528*a* abuts against the upper surface of the protrusion 490 of the toner cartridge 462, and is thus held at that position. Preferably, at this position to which the hampering plate 495 is brought by rotation, the display portion 532*a* is exposed through the opening 530 formed in the front wall 426. By so doing, the loading sequence of the toner cartridge in the main body of the developing device can be easily determined.

When about 2,000 copies are produced and substantially all the toner in the cartridge 462 loaded in the main body of the developing device is used up, the cartridge 462 is detached and a fresh toner cartridge 462 having toner filled therein is loaded. In detaching the toner cartridge 462, the gripping portion (not shown) provided in the front surface of the main receptacle body 488 is gripped and moved in the detaching direction shown by an arrow 538 (FIG. 20-B). When the toner cartridge 462 is so moved, the protrusion 490 first departs from one end portion of the plate member 508 as shown in FIG. 20-B. Further movement results in detachment of the protrusion 490 from the unit frame 422 through the cut 528*a* of the hampering plate 495 and the cut 520 of the front wall 426. As a result, it is easily seen that by the elastic recovering force of the plate member 508, the free end of the lock pin 510 is pressed against the inner surface of the hampering plate 495 and the hampering plate 495 is permitted to rotate in the direction of arrow 496. Thus, by the action of the torsion coil spring 498, the hampering plate 495 is rotated in the direction of arrow 496 to the second angular position shown in FIG. 19-C (at this time, the lock pin 510 moves relatively from the other end to one end within the recessed portion 514*b*). When the lock pin 510 is positioned at the aforesaid one end of the recessed portion 514*b* (more specifically when the lock pin 510 abuts against the site defining the one end of the recessed portion 514*b*), the hampering plate 495 is held at the second angular position. When the hampering plate 495 is held at the second angular position, the display portion 532*b* is exposed through the opening 530 formed in the front wall 426, and the operator can easily learn from the numeral "2" attached to the display portion 532*b* that a new toner cartridge 462 to be loaded next into the mainbody of the developing device is the second one from the start of using the process unit 416.

When the new toner cartridge 462 is then inserted as stated above, the protrusion 490 formed in the new toner cartridge 462 acts on one end portion of the plate member 508 through the cut 520 formed in the front wall 426 and the cut 528*b* of the hampering plate 495, and the plate member 508 is slightly deformed elastically. The locking means 506 is again released. As a result, by the action of the torsion coil spring 498, the hampering plate 495 is slightly rotated in the direction of arrow 496 and the part defining the 528*b* abuts against the protrusion 490 of the toner cartridge 462 whereby the hampering plate 495 is held at the rotated position. At this rotated position, too, it is preferred to expose the display portion 532*b* through the opening 530 formed in the front wall 426.

When about 2,000 copies are further produced, the toner in the second toner cartridge 462 is used up, and the toner cartridge 462 should be replaced. When the toner cartridge 462 is detached from the main body of the developing means, the hampering plate 495 is rotated in the direction of arrow 496 to the third angular position by the action of the torsion coil spring 498 (at this time, the lock pin 510 moves from the other end to one end relatively within the recessed portion 514*c*), and is held at the third angular position by the lock pin 510. As a result, the display portion 532*c* is exposed through the opening 530 formed in the front wall 426, and the operator can easily learn from the numeral "3" at the display portion 532*c* that a new toner cartridge to be loaded next is the third one from the start of using the process unit 416.

When the new toner cartridge 462 is then loaded as stated above, the locking means 506 is released and by the action of the torsion coil spring 498, the hampering plate 495 is slightly rotated. Its part defining the cut 528*c* abuts against the protrusion 490 of the toner cartridge 462 to hold the hampering plate 495 at the so rotated position. At this rotated position, too, it is preferred to expose the display portion 532*c* through the opening 530 formed in the front wall 426.

When additional 2,000 copies or so are produced the toner in the third toner cartridge 462 is also used up. When the toner cartridge 462 is then detached from the main body (not shown) of the developing device, the hampering plate 495 is rotated in the direction of arrow 496 to the aforesaid hampering position by the action of the torsion coil spring 498 (at this time, the lock pin 510 moves relatively from the other end to one end within the recessed portion 514*d*), and held at the hampering position by the lock pin 510. At the hampering position, that part of the hampering plate 495 which does not have the cuts is positioned rearwardly of the cut 520 of the front wall 426. Consequently, even when the toner cartridge 462 is inserted, its protrusion 490 abuts against the aforesaid site of the hampering plate 495 and its loading is accurately hampered. From this, the operator can easily and exactly know that the life of the electrostatographic material and therefore the life of the entire process unit 416 come to an end. Furthermore, subsequent performance of a copying process becomes substantially impossible. Furthermore, when the hampering plate 495 is brought to the aforesaid hampering position, the display portion 532*d* is exposed through the opening 530 formed in the front wall 426. The display portion 532*d* is marked red unlike the display portions 532*a*, 532*b* and 532*c*. It is possible therefore to learn from this display that the life of the process unit 416 as a whole comes to an end.

In the third embodiment, the display portion 532*a* (or 532*b*, 532*c* or 532*d*) formed in the hampering plate 495 is observed with the unaided eye through the opening 530 formed in the front wall 426. Alternatively, it is possible to detect the angular position of the hampering plate 495, and electrically display the sequence of the cartridge loaded in the main body of the developing device on the basis of the detected angular position.

Modified Embodiment of Loading Hampering Means and Related Elements

FIGS. 21 to 23 show a modified embodiment of the loading hampering means and elements related thereto, With reference to FIGS. 21 and 22-A, the loading hampering means 492' in the modified embodiment is also provided with a hampering plate 495' in the form of a circular plate. The hampering plate 495' is rotatably mounted on the small-diameter portion of supporting shaft 494' implanted in the inner surface of the front wall 426' of the unit frame 422', and an engaging member 504' is mounted on the end portion of the small-diameter portion. In the modified embodiment, a supporting member 540 is further mounted on the front wall 426'. The supporting member 540 has a base portion 542*a* and a projecting portion 542*b* extending substantially perpendicularly from the base portion 542*a*, and the base portion 542a is fixed to the inner surface of the front wall 426' by means of a screw 544. A short shaft 546 is implanted in the upper surface of the projecting portion 542b of the supporting member 540, and a rotating member 548 is rotatably mounted on the short shaft 546. An engaging member 550 is mounted on the forward end portion of the short shaft 546 to prevent detachment of the rotating member 548. The rotating member 548 has a main body portion 552a, a fitting projection 552b provided at one end of the main body portion 552a, and an actuating projection 552c provided at other end of the main body portion 552a. The fitting projection 552b is rotatably mounted on the short shaft 546, and a lock pin 510' projecting towad the hampering plate 495' is provided in the actuating projection 552c. A torsion coil spring 498' is fitted over the large-diameter portion of the supporting shaft 494', and one end of the torsion coil spring 498' is connected to the base portion 542a of the supporting member 540 mounted on the front wall 426' (by inserting one end into a hole 554 formed in the base portion 542a) while its other end is connected to the hampering plate 495' (by inserting the other end into a recessed portion formed in the outside surface of the hampering plate 495'). The torsion coil spring 498' serves to act on the hampering plate 495' and bias it in the direction shown by an arrow 496' (the clockwise direction in FIG. 21 and the couterclockwise direction in FIGS. 22-A to 22-C). A torsion coil spring 556 is fitted over the short shaft 546. One end of the torsion coil spring 556 is connected to the projection 542b of the supporting member 540 (by inserting one end into a hole 558 formed in the projecting portion 542b), and its other end is connected to the fitting projection 552b of the rotation member 548 (by bringing the other end into engagement with a cut 560 formed in the fitting projection 552b). The torsion coil spring 556 acts on the rotating member 548 and biases it in the direction shown by an arrow 562 (in the counterclockwise direction in FIGS. 21, 23-A and 23-B).

In the modified embodiment, three cuts 528a', 528b' and 528c' are provided in the hampering plate 495'. The sites of provision of these recesses 528a' to 528c' slightly differ. As can be easily understood by referring to FIGS. 21 and 22-A to 22-C, when the hampering plate 495' is at the first angular position, the cut 528a' of the hampering plate 495' is positioned inwardly of the upper part of the cut 520' formed in the front wall 426' (namely, the cut 528a' is positioned slightly above the substantially horizontal central axis of the hampering plate 495'). When the hampering plate 495' is at the second angular position, the cut 528b' of the hampering plate 495' is positioned inwardly of the substantially central part of the cut 520' of the front wall 426' (namely, the cut 528b' is positioned on the substantiallyhorizontal central axis of the hampering plate 495'). When the hampering plate 495' is at the third angular position the 528c' of hampering plate 495'). When the hampering plate 495' is at the third angular position, the cut 528c' of the hampering plate 495' is positioned inwardly of the lower part of the cut 520' of the front wall 426' (namely, the cut 528c' is positioned slightly below the substantially horizontal central axis of the hampering plate 495'). (In relation this, the cut 520' of the front wall 426' have an increased width in the vertical direction.) In relation to the difference in the sites of provision of the cuts 528a', 528b' and 528c', three toner cartridges 462' of different types are used in the modified embodiment. A toner cartridge 462' of a first type is of such a structure that a protrusion 490' exists in the upper part of one side surface of its main receptacle body 488'. Only when the hampering plate 495' is at the first angular position, its protrusion 490' passes throught he cut 528a', and loading of this toner cartridge of the first type into the main body of the developing device is permitted. A toner cartridge 462' of a second type is of such a structure that a protrusion 490' exists slightly below the position of the protrusion 490' in the first type of toner cartridge 462'. Only when the hampering plate 495' is at the second angular position, the protrusion 490' passes through the cut 528b' and loading of the toner cartridge 462' of the second type into the main body of the developing device is permitted. A toner cartridge 462' of a third type is of such a structure that a protrusion 490' exists further slightly below the position of the protrusion 490' in the second type of toner cartridge 462'. Only when the hampering plate 495' is at the third angular position, the protrusion 490' passes through the cut 528c', and loading of the third type of toner cartridge 462' into the main body of the developing device is permitted.

In loading the three toner cartridges 462' in a predetermined sequence, it is preferred that the cartridge loading display means display a new toner cartridge 462' to be next loaded when the previously toner cartridge 462' is detached. In relation to this, the loading sequence is preferably attached to the toner cartridges 462' by attaching displays corresponding to the displays of the loading display means. Specifically, it is preferred, for example, to mark the gripping portion of the first type of toner cartridge 462' "1" when the display portion 532a' is marked "1"; mark the gripping portion of the second type of toner cartridge 462' "2" when the display portion 532b' is marked "2"; and mark the gripping portion of the third type of toner cartridge 462' "3" when the display portion 532c' is marked "3". Instead of numerals, colors may be used for display.

The other structures of the modified embodiment are substantially the same as in the third embodiment in FIGS. 16 to 20.

Instead of varying the sites of provision of the cuts 528a', 528b' and 528c' in the hampering plate 495', it is possible to vary the shapes of the cuts 528a'', 528b'' and 528c'' as shown in FIG. 24. For example, as shown in FIG. 24, in the cut 528a'' which is positioned inwardly of the recess formed in the front wall when the hampering plate 495'' is at the first angular position, a protrusion 564a is provided at its lower part. In the cut 528'' which is located inwardly of the above cut when the hampering plate 495'' is at the second angular position, a protrusion 564b is provided at its central part. In the cut 528c'' which is positioned inwardly of the above cut when the hampering plate 495'' is at the third angular position, a protrusion 264c is provided at its upper part.

When the loading hampering means 492' of this modified embodiment is applied, substantially the same operation and results as in the third embodiment shown in FIGS. 16 to 20 can be achieved. With reference to FIGS. 22-A to 22-C and 23-A and 23-B, when the hampering plate 495' is held at the first angular position shown in FIGS. 22-A and 23-A, and the first type of toner cartridge 462' is loaded into the main body of the developing device, the protrusion 490' provided in the toner cartridge 462' abuts against the actuating projection 554c of the rotating member 548 through the cut 520' formed in the front wall 426' of the unit frame 422' and the cut 528a' formed in the hampering plate 495', and by the movement of the toner cartridge 462' in the direction shown by arrow 536' (FIG. 23-A), the rotating member 548 is slightly rotated in a direction opposite to the direction of arrow 562 against the biasing force of the torsion coil spring 556. As a result, the lock pin 510' provided in the rotating member 548 comes out of the recessed portion 514' of the hampering plate 495' and the locking means 506' is released. The hampering plate 495' is biased in the direction of arrow 496' by the action of the torsion coil spring 498'. When so biased, the hampering plate 495' slightly rotates until its part defining the cut 528a' abuts against the upper surface of the projecting portion 490' of the toner cartridge 462', and is held at the so rotated position.

On the other hand, when the cartridge 462' is then detached from the main body of the developing device, the movement of the toner cartridge 462' in the detaching direction shown by arrow 538' (FIG. 23-B) first causes the protrusion 490' to depart from the actuating projection 552c of the rotating member 548 as shown in FIG. 23-B, and thereafter, the protrusion 490' is detached from the unit frame 422' through the cut 528a' of the hampering plate 495' and the cut 520' of the front wall 426'. Thus, as can be easily understood, the action of the torsion coil spring 556 causes the rotating member 548 to rotate in the direction shown by arrow 562 and the free end of the lock pin 510' is elastically pressed against the hampering plate 495'. Thus, rotation of the hampering plate 495' in the direction of arrow 496' is permitted, and by the action of the torsion coil spring 498', the hampering plate 495' is rotated to the second angular position shown in FIG. 22-C in the direction of arrow 496' (at this time, the lock pin 510' moves relatively from the other end to one end within the recessed portion 514b'), and is held at the second angular position by positioning of the lock pin 510' at the aforesaid one end of the recessed portion 514b' (more specifically, by the abutting of the lock pin 510' against thesite defining one end of the recessed portion 514b'.)

Accordingly, substantially as in the embodiment described hereinabove, when the first type of toner cartridge 462' is loaded into the main body of the developing device and then detached from it, the hampering plate 495' is rotated substantially by 90 degrees in the direction of arrow 496' and brought to the second angular position from the first angular position. Then, when the second type of toner cartridge 462' is loaded into the main body of the developing device and then detached from it, the hampering plate 495' is further rotated substantially by 90 degrees in the direction of arrow 496', and brought to the third angular position from the second angular position. Then, when the third type of toner cartridge 462' is loaded into the main body of the developing device and then detached from it, the hampering plate 495' is further rotated substantially by 90 degrees and brought to the hampering position from the third angular position. After the toner in the three types of toner cartridges 462' has all been used up, the hampering plate 495' at the hampering position accurately hampers loading of another toner cartridge 462'.

Other Modified Embodiments

When copying of different colors (so-called monocolor copying) is made possible by replacing the entire process unit in the electrostatic copying machine, it is preferred to construct the process unit as described below.

For example, in a process unit 416a using black toner as shown in FIGS. 25-A and 25-B, the hampering plate 495a of the loading hampering means 492a is disposed nearly centrally in the vertical direction in one side portion of the opening 516a formed in the front wall 426a of the unit frame 422a (FIG. 25-A). In a process unit 416b using red toner, the hampering plate 495b of the loading hampering means 492b is disposed in the lower part of one side portion, in the vertical direction, of the opening 516b formed in the front wall 426b of the unit frame 422b (FIG. 25-B). Hence, the sites of provision of the protrusions in the toner cartridges differ depending upon the sites of provision of the hampering plate 495a and 495b. In other words, it is preferred to vary the sites of provision of the hampering plates 495a and 495b of the loading hampering means 492a and 492b according to the colors of the toner used. By so doing loading of a toner cartridge in which the color of the toner is different from the intended one can be accurately prevented.

In the third embodiment, the hampering plate 495 is rotated by a predetermined angle in relation to the loading and detachment of the toner cartridge 462. This is not limitative, and the hampering plate 495 may be adapted to move linearly a predetermined amount in a predetermined direction in relation to the loading and/or detachment of the toner cartridges 462. This can be achieved, for example, by energizing an electromagnetic solenoid when the toner cartridge 462 has been detached from the main body of the developing device, and thus moving the hampering plate 495 a predetermined amount.

Furthermore, in the third embodiment, the cartridge loading display means is disposed in the hampering plate 495 of the loading hampering means 492. Instead, it is possible to provide it separately from the hampering means 492. In this modification, a moving member adapted to move in relation to the loading and/or detachment of the toner cartridges 462 is provided separately from the hampering plate 495, and the cartridge loading display means is provided in the moving member.

In the third embodiment, both the loading hampering means 492 and the cartridge loading display means are provided. But when only the cartridge loading display means is to be applied, the following arrangement is preferred. Specifically, in relation to the final toner cartridge 462 to be loaded into the main body of the developing device (when all the toner in it is consumed, the life of the entire process unit 416 comes to an end), the final toner cartridge 462 is adapted to be substantially impossible of detachment once it is loaded into the main body of the developing device.

Electrostatic Copying Machine in Fourth Embodiment

FIGS. 26 to 31 show a process unit in a fourth embodiment of the electrostatic copying machine.

Figure 26:
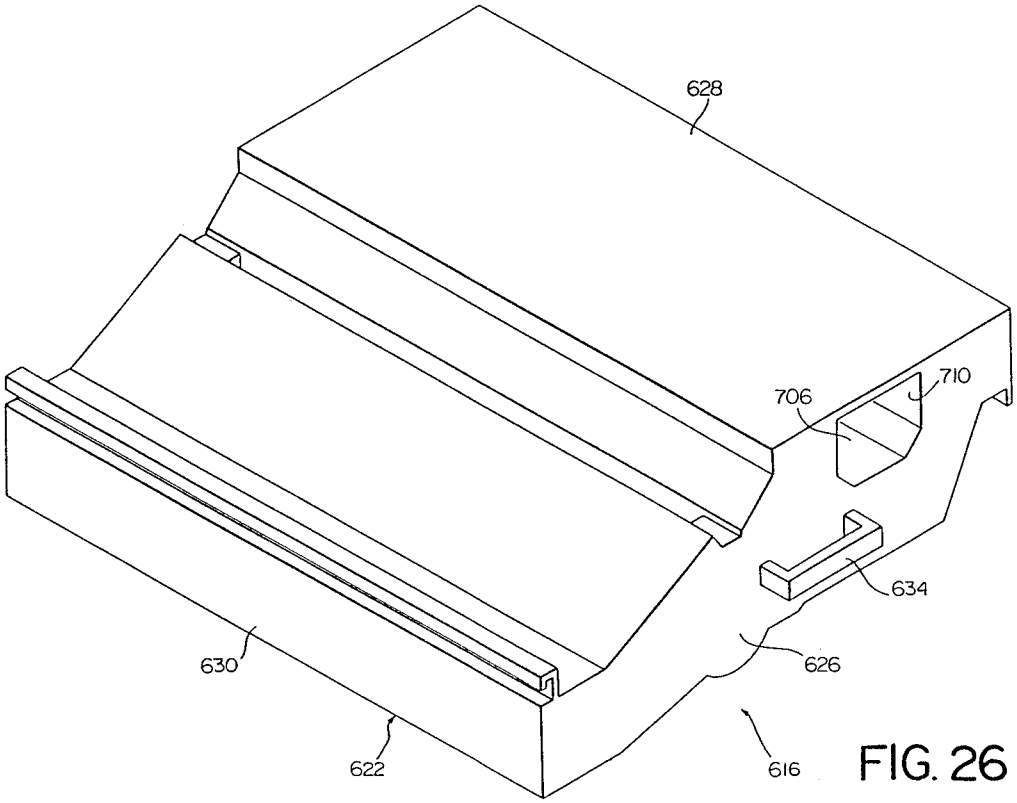
FIG. 26 is a perspective view showing a process unit in a fourth embodiment of the electrostatic copying machine as one example of the image-forming machine in accordance with this invention.

With reference mainly to FIG. 26, the illustrated process unit 616 has a unit frame 622, and a rotating drum, a developing device and a cleaning device (only part of the developing device is shown while omitting the others) which may be substantially the same as in the first embodiment are mounted on the unit frame 622. The process unit 616 of this structure is detachably mounted on an upper supporting frame (not shown) in an electrostatic copying machine having the same structure as in the first embodiment.

The unit frame 622 has a front wall 626 and a rear wall (not shown) spaced from each other in the front-rear direction (the direction from right bottom to left top in FIG. 26), and between the front wall 626 and the rear wall, an upper wall 628, a left side wall 630 and a right side wall (not shown) are provided. The rotating drum, developing device and cleaning device are disposed between the front wall 626 and the rear wall of the unit frame 622. A gripping portion 634 is provided in the front surface of the front wall 626 to permit easy loading and detachment of the unit frame 622 into and from the upper supporting frame.

Figure 31:
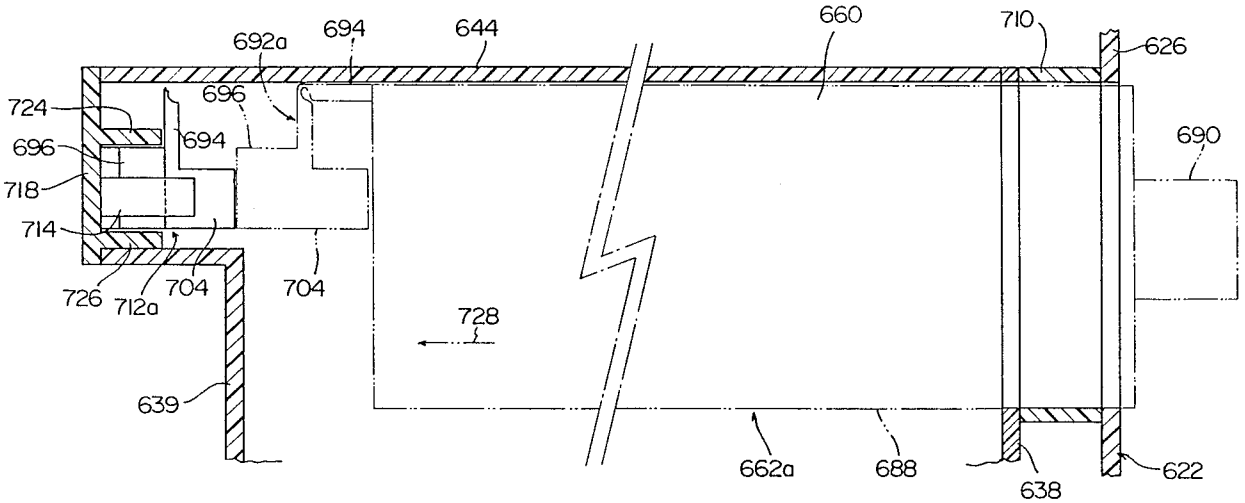
FIG. 31 is a sectional view showing the first type of toner cartridge as it is detached from the main body of the developing device.

The developing device mounted on the unit frame 622 is of substantially the same structure as in the first embodiment. It is equipped with a main body 635 having a pair of end walls 638 and 639 provided in spaced-apart relationship in the front-rear direction and various walls 644 provided between the end walls 638 and 639, and the main body 635 of the developing device defines three chambers, i.e. a developing chamber (not shown), a developer holding chamber (not shown) and a toner holding chamber 660 (FIG. 31). See FIGS. 29 and 31 in particular. In the developing device of the fourth embodiment, too, a two-component developer composed of carrier and toner is used. The developer holding chamber holds a "start developer" to be supplied to the developing chamber in use. A toner cartridge 662 to be described is loaded into the toner holding chamber 660, and the toner discharged from the toner cartridge 662 is also held in the toner holding chamber 660. Applicator means and agitation means are disposed in the developing chamber.

Figure 27:
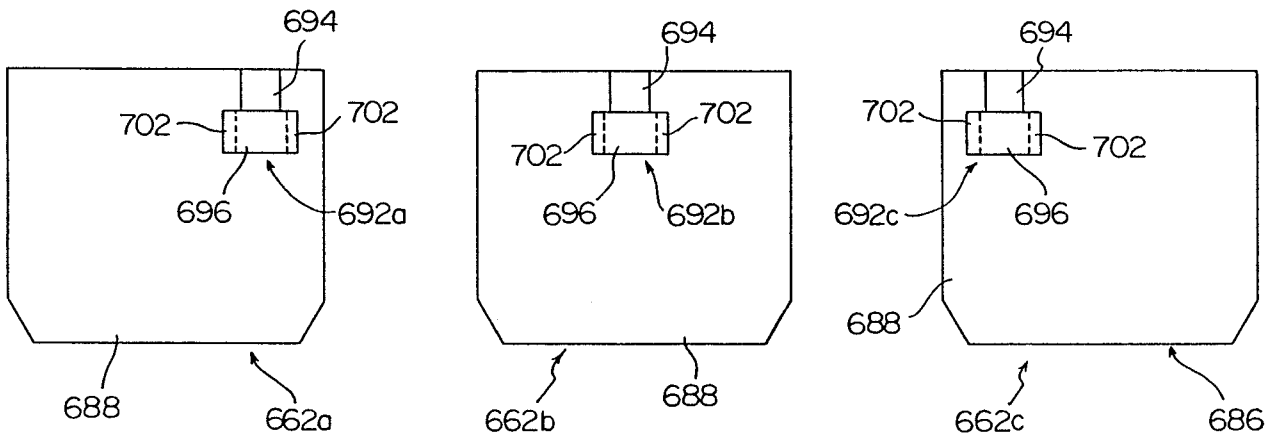
FIG. 27 is a rear view of three types of toner cartridges to be loaded into the main body of the developing device in the process unit of FIG. 26, as viewed from the rear side.
Figure 28:
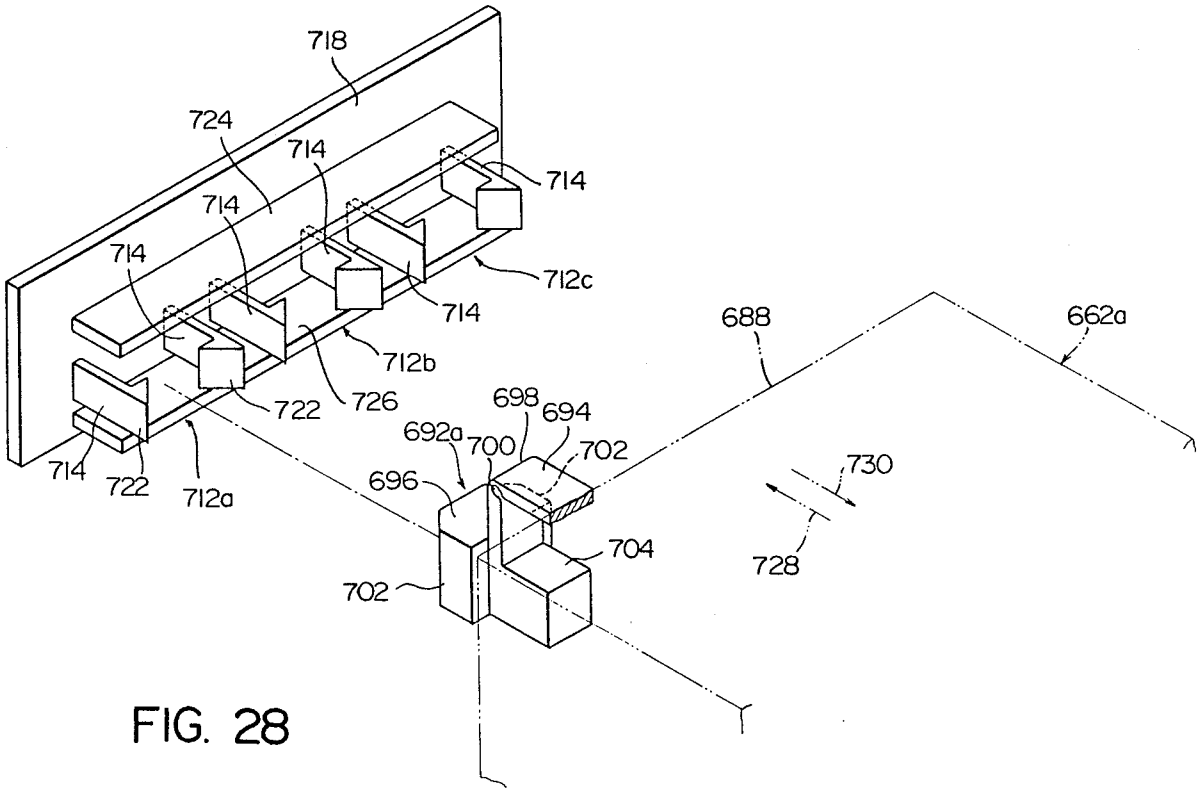
FIG. 28 is a perspective view showing a loading-hampering member provided in a first type of toner cartridge and a receiving section provided in the main body of the developing device in the process unit of FIG. 26.
Figure 29:
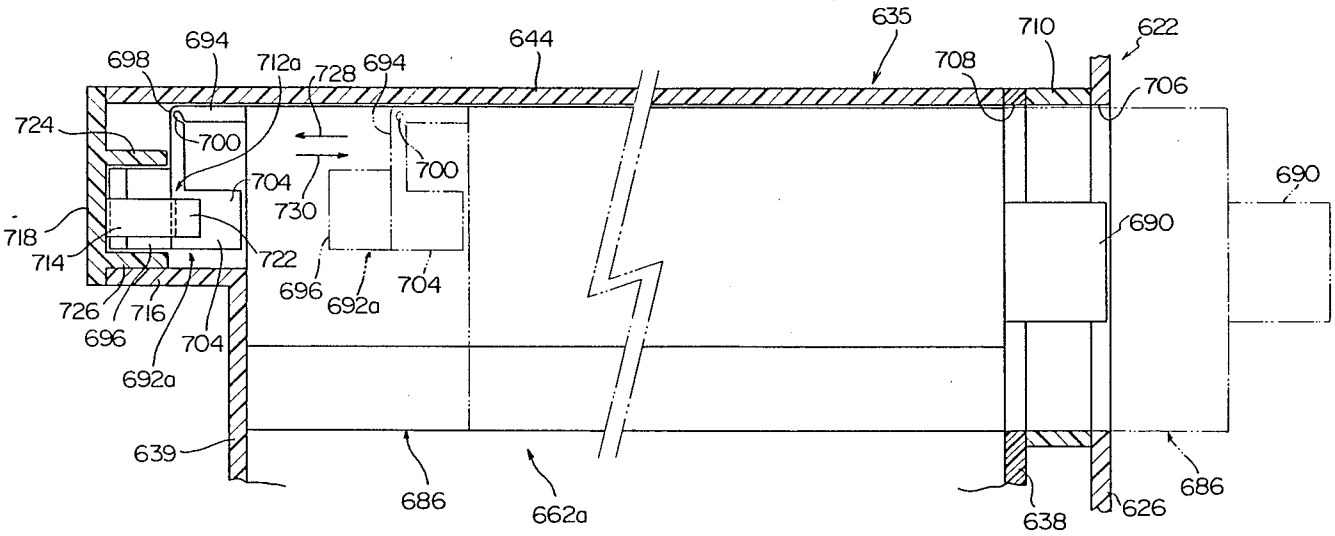
FIG. 29 is a sectional view showing the state of a first type of toner cartridge loaded into the main body of the developing device in the process unit of FIG. 26.

In the fourth embodiment of the electrostatic copying machine, too, the number of loadings of the toner cartridge 662 substantially corresponds to the service life of the electrostatographic material and therefore the life of the process unit 616, and the life of the electrostatographic material (and therefore the life of the process unit 616) end after three toner cartridges have been loaded. With reference to FIGS. 26 and 27, in the illustrated embodiment, the electrostatographic material of the rotating drum is such that its service life ends after about 6,000 copies have been produced. In relation to this fact, three toner cartridges 662 are provided for one process unit 616. Specifically, in the illustrated embodiment, each of the toner cartridges 662 contains toner in an amount required for producing about 2,000 copies, and the toner cartridges 662 are selectively loaded into the toner holding chamber 660 (FIG. 31). The toner cartridges 662 are of nearly the same structure (only that part at which the loading hampering member is provided is different), and are each provided with a holding receptacle 686 in which to hold toner as shown in FIGS. 27 and 29. The illustrated holding receptacle 686 is provided with a box-like main body having a discharge opening formed at its under surface and a gripping portion 690 provided at one surface (front surface) of the main receptacle body 688. A loading hampering member is further provided in the main receptacle body 688, and according to the site of provision of this hampering member, the toner cartridges 662 have three distinct types. As clearly shown in FIG. 27, a toner cartridge of a first type (to be designated as 662*a*) is of such a structure that as is shown in the left side of FIG. 27, a loading hampering member 692*a* is provided at the right part in FIG. 27 of the other end surface (rear surface) of the main receptacle body 688. A toner cartridge of a second type (designated as 662*b*) is of such a structure that as shown at the center in FIG. 27, a loading hampering member 692*a* is provided at the central part of the other end surface (rear surface) of the main receptacle body 688. A toner cartridge of a third type (to be designated as 662*c*) is of such a structue that as shown in the right side of FIG. 27, a loading hampering member 692*c* is provided in the left part in FIG. 27. With reference to FIGS. 28 and 29, the loading hampering members 692*a*, 692*b* and 692*c* are substantially of the same structure, and each has a connecting portion 94 connected to the end wall (rear wall) of the main receptacle body 688 and an engagement portion 696 provided at the front end part of the connecting portion 694. In the illustrated embodiment, the connecting portion 694 is connected to the upper end portion of the end wall (rear wall) of the main body 688. It extends from its base portion connected to the end wall toward its end rearwardly and then rearwardly and downwardly, and a weakened portion 698 having a weaker strength than the other is provided at an L-shaped bent site. In the illustrated embodiment, a cut 700 is formed in the inner surface of the bent site, and this cut forms the weakened portion 698. The engagement portion 696 formed at the end of the connecting portion 694 is of nearly parallelpipedal, and engagement projections 702 projecting on both sides are provided at its both side portions. The outside surface (rear surface) of each engagement projection 702 is inclined inwardly in the rear direction (in the left direction in FIG. 29). (see FIGS. 30-A and 30-B also). An auxiliary protrusion 704 is further provided in the inner surface (front surface) of the engagement portion 696. This auxiliary protrution 704 may be omitted when it is possible to prevent damage of the weakened portion 698 which may occur during loading of the toner cartridge 662*a* (or 662*b* or 662*c*). In the illustrated embodiment, each of the loading hampering members 692*a*, 692*b* and 692*c* is formed as a unit with the main receptacle body 688 of each of the toner cartridges 662*a*, 662*b* and 662*c*.

On the other hand, in relation to the fact that the toner cartridges 662*a*, 662*b*, and 662*c* can be selectively loaded into the toner holding chamber 660, an opening 706 and an opening 708 are formed respectively in a predetermined site of the front wall 626 of the unit frame 622 and a predetermined site of the end wall 638 of the developing device (see FIG. 29). In the illustrated embodiment, a cylindrical guide wall 710 is provided between the opening 706 of the front wall 626 in the unit frame 622 and the opening 708 of the end wall 638 in the developing device in order to prevent leakage of the toner in the toner cartridges 662*a*, 662*b*, and 662*c* at the time of loading or detachment. Accordingly, each of the toner cartridges 662*a*, 662*b* and 662*c* is loaded into the toner holding chamber 660 through the opening 706 formed in the front wall 626, the guide wall 710, and the opening 708 formed in the end wall 638. In the illustrated embodiment, a plurality of receiving portions 712*a*, 712*b* and 712*c* are provided in the main body 635 of the developing device in correspondence to the loading hampering members 692*a*, 692*b* and 692*c* in the toner cartridges 662*a*, 662*b* and 662*c*. These receiving portions 712*a*, 712*b* and 712*c* are substantially of the same structure, and are each defined by a pair of engaging portions 714 disposed in spaced-apart relationship in the laterial direction (the direction from left bottom to right top in FIG. 28, and the direction perpendicular to the sheet surface in FIG. 29) (thus, 6 engaging portions 714 are provided in total). In the illustrated embodiment, a rearwardly projecting wall portion 716 (FIG. 29) is provided in the end wall 639 of the main body of the developing device, and to the rear end of the projecting wall portion 716, a rectangular auxiliary end wall 718 is fixed. The six engaging members 714 in total defining the receiving portions 712*a*, 712*b* and 712*c* are provided integrally on the inner surface of the auxiliary end wall 718 in spaced-apart relationship in the longitudinal direction. The pair of engaging members 714 defining each of the receiving portions 712*a*, 712*b* and 712*c* at its forward end has a claw portion 722 sharply projecting inwardly. The claw portion 722 is adapted to be engageable with the loading hampering member 692*a* (or 692*b* or 692*c*) in the toner cartridge 662*a* (or 662*b* or 662*c*), and after engagement, the loading hampering member 692*a*, 692*b* or 692*c* substantially fails to be detached. In the illustrated embodiment, an upper auxiliary wall 724 and a lower auxiliary wall 726 extending in the aforesaid longitudinal direction are disposed above and below the engaging member 714. The upper auxiliary wall 724 and the lower auxiliary wall 726 cooperate with there sets of a pair of engaging members 714 and define the receiving portions 712*a*, 712*b* and 712*c*. The upper auxiliary wall 724 and the lower auxiliary wall 726 accurately hamper the vertical movement of the loading hampering members 692*a*, 693*b* and 692*c* separated from the toner cartridges 662*a*, 662*b* and 662*c* in the manner to be described.

In the electrostatic copying machine equipped with the above process unit 616, the first type of toner cartridge 662*a* (or the second type of toner cartridge 662*b*, or the third type of toner cartridge 662*c*) is loaded into the main body 635 of the developing device when the machine begins to be used. Loading of the toner cartridge 662*a* is performed by inserting the main receptacle body 688 in the loading direction shown by an arrow 728 through the opening 706 formed in the front wall 626 of the unit frame 622, the guide wall 710, and the opening 708 formed in the end wall 638 of the developing device, as can be seen from FIGS. 26, 28 and 29. When the toner cartridge 662*a* is moved in the direction shown by arrow 728 to a holding position (the position shown by a solid line in FIG. 29) at which the rear surface of the main receptacle body 688 abuts against the inner surface of the end wall 639 of the developing device, the claw portion 722 of the pair of engaging member 714 defining the receiving portion 712*a* engages the engagement protrusion 702 of the loading hampering member 692*a* provided integrally in the main receptacle body 688. As shown on an enlarged scale in FIGS. 30-A and 30-B, when the toner cartridge 662*a* is moved in the direction of arrow 728 to near the holding position, the rearwardly inclined surface of the engagement protrusion 702 existing in the engagement portion 696 of the loading hampering member 692*a* acts on the claw portion 722 of the pair of engaging members 714 and elastically deforms it outwardly as shown in FIG. 30-A. When the toner cartridge 662*a* is moved to the holding position, the engagement protrusion 702 of the engagement portion 696 goes beyond the claw portion 722 of the pair of engaging members 714 and the pair of engaging members 714 elastically recover their original state, whereby the claw portion 722 engages the engagement protrusion 702 of the loading hampering member 692*a*. Thus, the loading hampering member 692*a* provided in the toner cartridge 662*a* is received in the receiving portion 712*a*, and the toner cartridge 662*a* is locked into the holding position at which it is held in the toner holding chamber 660. Since the claw portion 722 projects sharply, detachment of the loading hampering member 692*a*, particularly the engagement portion 696, from the receiving portion 712*a* becomes substantially impossible. In the illustrated embodiment, when the engagement protrusion 722 of the loading hampering member 692*a* goes beyond the claw portion 722 of the engaging members 714, the front end surface (the right surface in FIG. 29) of the auxiliary protrusion 704 abuts against the rear surface of the main receptacle body 688 and thereby suppresses elastic deformation of the connecting portion 694. Thus, damage of the weakened portion 698 can be accurately prevented.

In the illustrated embodiment, when about 2,000 copies are produced, substantially all the toner in the toner cartridge 662*a* is used up, and the toner cartridge 662*a* should be replaced. Replacement is effected by detaching the toner cartridge 662*a* from the main body 635 of the developing device, and then loading the toner cartridge 662*b* of the second type or the toner cartridge 662*c* of the third type into the main body 635. To detach the toner cartridge 662*a*, the gripping portion 690 provided in the front surface of the main receptacle body 688 is held and moved in the detaching direction shown by an arrow 730. As a result, the weakened portion 698 of the loading hampering member 692*a* is broken as the main receptacle body 688 is moved in the direction of arrow 730, and the loading hampering member 692*a* separates from the toner cartridge 662*a* and remains in the main body 635 of the developing device while being received in the receiving portion 712*a* as shown by a solid line in FIG. 31. In contrast, the main receptacle member 688 is moved in the direction of arrow 730, and detached from the main body 635 of the developing device. Hence, after the toner cartridge 662*a* has been detached as above, an attempt to re-load the same type of toner cartridge as the toner cartridge 662*a* as shown by a two-dot chain line in FIG. 31 fails. Since the loading hampering member 692*a* remains in the receiving portion 702*a*, it is easily seen from FIG. 21 that the engagement portion 696 of the loading hampering member 692*a* in the first type of toner cartridge 662*a* abuts against the auxiliary protrusion 704 of the hampering member 692*a* remaining in the receiving portion 712*a*, and therefore, re-loading of the first type of toner cartridge 662*a* is accurately hampered.

When the second type of toner cartridge 662*b* is then loaded, the loading hampering member 692*b* in the toner cartridge 662*b* is received in the receiving portion 712*b* defined in the main body 635 of the developing device, and the claw portion 722 of the pair of engaging members 714 engages the engagement protrusion 702 of the loading hampering member 692*b*. As a result, the toner cartridge 662*b* is locked into the holding position and substantially fails to be detached from the receiving portion 712*b* of the engagement portion 696. When the toner in the toner cartridge 662*b* is used up and then the toner cartridge 662*b* is moved in the detaching direction shown by arrow 730 in order to detach it from the main body 635 of the developing device, the weakened portion 698 of the loading hampering member 692*b* is broken with the above movement as stated above, and the loading hampering member 692*b* separates from the toner cartridge 662*b* and remains in the main body 635 of the developing device while being received in the receiving portion 712*b*. In contrast, the main receptacle body 688 is moved in the direction of arrow 730 and detached from the main body 635 of the developing device. Accordingly, since the loading hampering member 692b remains in the receiving portion 712b after the detachment of the toner cartridge 662b, re-loading of the second type of toner cartridge 662b can also be accurately hampered.

When the third type of toner cartridge 662c is loaded in place of the second type of toner cartridge 662b, the loading hampering member 692c in the toner cartridge 662c is received in the receiving portion 712c defined in the main body 635 of the developing device and the claw portion 722 of the pair of engaging members 714 engages the engagement protrusion 702 of the loading hampering member 692c. As a result, the toner cartridge 662c is locked into the holding position, and detachment of the engagement portion 696 from the receiving portion 712c becomes substantially impossible. When the toner in the toner cartridge 662c is used up and the toner cartridge 662c is moved in the detaching direction shown by arrow 730 in order to detach it from the main body 635 of the developing device, the weakened portion 698 of the loading hampering member 692c is broken in the same way as stated above. Thus, the loading hampering member 692c separates from the cartridge 662c and remains in the main body 635 of the developing device while being received in the receiving portion 712c, while the main receptacle body 688 is moved in the direction of arrow 730 and is detached from the main body 635 of the developing device. Accordingly, since the loading hampering member 692c remains in the receiving portion 712c after detachment of the toner cartridge 662c, re-loading of the third type of toner cartridge 662c is also accurately hampered.

When all three types of toner cartridges 662a to 662c have been used, the loading hampering members 692a to 692c separated from the toner cartridges 662a to 662c remain in all of the receiving portions 702a to 702c defined in the main body 635 of the developing device. Thus, it is substantially impossible to load a new toner cartridge 662a (or 662b or 662c) into the main body 635 of the developing device, and the operator can learn that the electrostatographic material, and therefore, the entire process unit 616, come to the end of their lives. Furthermore, subsequent performance of the copying process becomes substantially impossible.

In the fourth embodiment, the loading hampering members 692a to 692c are formed as a unit with the main body 688 of the holding receptacle, and when the main receptacle body 688 is detached, they are partly broken and remain in the receiving portions 712a to 712c. This is not limitative, and it is possible to mount the loading hampering members detachably on the main receptacle bodies, detach them from the main receptacle bodies by detaching the receptacle bodies from the main body of the developing device, and thus cause them to remain in the receiving portions substantially undetachably.

When a plurality of differently colord toners can be used, it is preferred to vary the positions of provision of the loading hampering members (and the positions of the receiving portions) according to the color of each toner. This can accurately prevent erroneous loading of the cartridges.

Electrostatic Copying Machine in Fifth Embodiment

Figure 33:
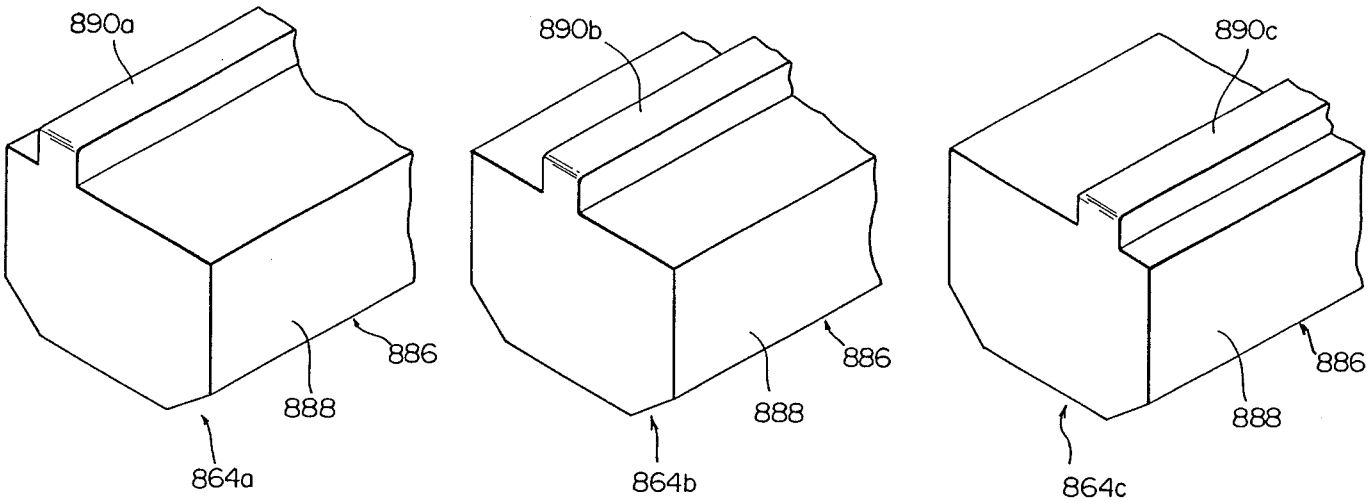
FIG. 33 is a perspective view showing partly three types of toner cartridge to be loaded into the main body of the developing device in the process unit of FIG. 32.
Figure 34:
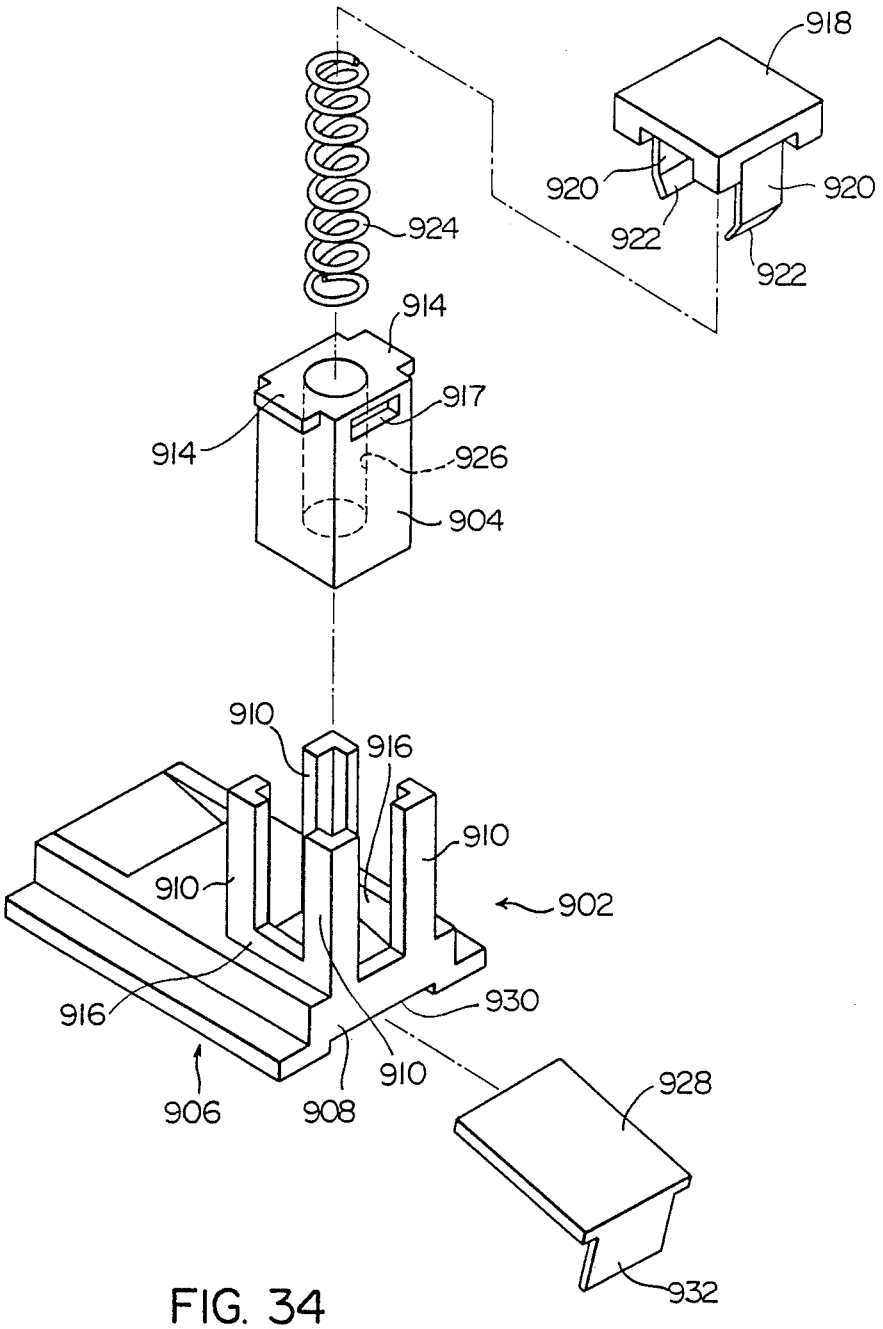
FIG. 34 is a perspective view showing in an exploded form re-loading hampering means provided in the process unit of FIG. 32.

FIGS. 33 to 35 shows a process unit in a fifth embodiment of the electrostatic copying machine.

Figure 32:
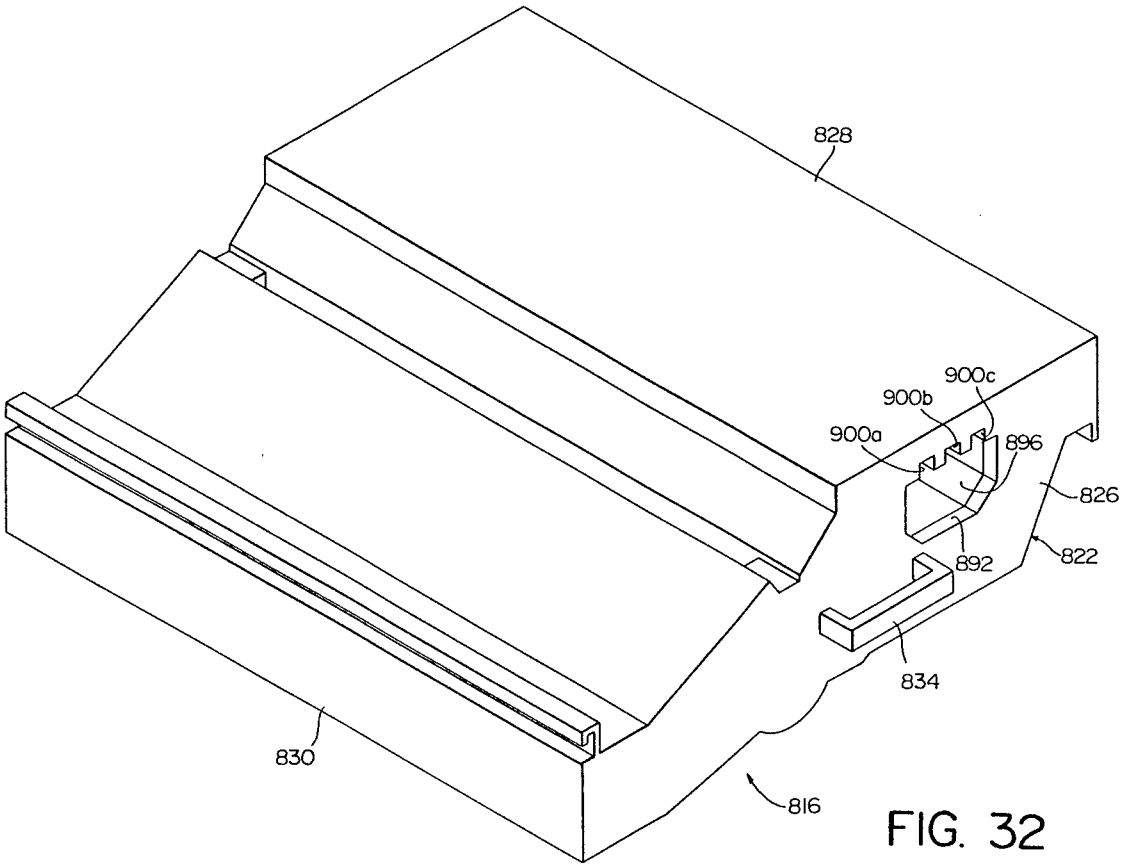
FIG. 32 is a perspective view showing a process unit in a fifth embodiment of the electrostatic copying machine as one example of the image-forming machine in accordance with this invention.

With reference mainly to FIG. 32, the illustrated process unit 816 has a unit frame 822, and a rotating drum, a developing device and a cleaning device (only part of the developing device is shown while the others are omitted) which may be substantially the same as those in the first embodiment are mounted on the unit frame 822. The process unit 816 of such a structure is detachably mounted on an upper supporting frame (not shown) in the electrostatic copying machine which may be the same as in the first embodiment.

The illustrated unit frame 822 has a front wall 826 and a rear wall (not shown) spaced from each other in the front-rear direction (the direction from right bottom to left top in FIG. 32), and between the front wall 826 and the rear wall, an upper wall 828, a left side wall 830 and a right side wall (not shown) are provided. The rotating drum, the developing device and cleaning device are disposed between the front wall 826 and the rear wall of the unit frame 822. In the unit frame 822, a gripping portion 834 is provided in the front surface of the front wall 826 in order to permit easy loading and detachment of the unit frame 822 into and from the upper supporting frame.

The developing device mounted on the unit frame 822 is of substantially the same structure as in the first emboidment and is provided with a main body 835 (FIG. 35-A) having a pair of end walls 838 (only one of which is shown in FIG. 35-A) spaced from each other in the front-rear direction and various walls provided between the pair of end walls 838. The main body 835 is divided into three chambers, i.e., a developing chamber (not shown), a developer holding chamber (not shown) and a toner holding chamber 862 (FIG. 35-A). In the developing device of the fifth embodiment, too, a two-component developer composed of a carrier and a toner is used, and in the developer holding chamber, a "start developer" to be supplied to the developing chamber in use is held. A toner cartridge 864 to be described is loaded into the toner holding chamber 860, and a toner discharged from the toner cartridge 864 is also held therein. Applicator means and agitating means are disposed in the developing chamber.

In the electrostatic copying machine of the fifth embodiment, too, the number of loadings of the toner cartridge 864 substantially corresponds to the life of the electrostatographic material of the rotating drum, and therefore to the life of the process unit 816, and the electrostatographic material and therefore the process unit 816, come to the end of their lives when the toner cartridge 864 has been loaded three times. With reference to FIGS. 32 and 33 also, in the fifth embodiment, the electrostatographic material of the rotating drum is such that its life ends when about 6,000 copies have been produced. In relation to this, three toner cartridges 864 are provided for one process unit 816. In the illustrated embodiment, each of the toner cartridge 864 is filled with a toner in an amount required to produce about 2,000 copies, and the toner cartridges 864 are selectively loaded into the toner holding chamber 862. The toner cartridges 864 are of nearly the same structure (the only difference is in the site of provision of a guided portion to be described), and are each provided with a holding receptacle 886. The illustrated holding receptacle 886 is provided with a box-like main body 888 having a discharge opening formed at its under surface and a gripping portion (not shown) provided in one end surface (front surface) of the main body 888. A guided protrusion constituting a guided portion is also provided in the main receptacle body 888, and the toner cartridges 864 are of three types according to the site of providing the guided protrusion. Specifically, as is clearly shown in FIG. 33, a first type of toner cartridge (to be designated as 864a) has a guided protrusion 890a provided on the upper surface of the left portion in FIG. 33 of the upper wall of the main body 888, as shown in the left side of FIG. 33. In the illustrated embodiment, the guided protrusion 890a is rectangular in cross section and extends linearly from one end (front end) to the other end (rear end) of the main body 888. In a second type of toner cartridge (to be designated as 864b), a guided protrusion 890b is provided in the upper surface of the central portion of the upper wall in the main body 888 as shown in the center of FIG. 33. The guided protrusion 890b is also rectangular in cross section, and extends linearly from one end to the other of the main body 888. In a third type of toner cartridge (to be designated as 864c), a guided protrusion 890c is provided in the upper surface in the right portion in FIG. 33 of the upper wall in the main body 888. This guided protrusion 890c is also rectangular in cross section, and extends linearly from one end to the other of the main body 888. The guided protrusions 890a, 890b and 890c in the toner cartridges 864a, 864b and 864c may be provided only in the front portions of the main receptacle bodies 888. When loading hampering means to be described hereinbelow is disposed in the rear part of the main body 835 of the developing device, the desired effect to be described can be achieved only by providing them at the rear parts of the main receptacle bodies 888.

In relation to the fact that the toner cartridges 864a to 864c can be loaded selectively into the toner holding chamber 862 (FIG. 35-A), opening 892 and 894 are formed respectively at a predetermined site of the front wall 826 of the unit frame and a predetermined site of one end wall 838 of the developing device (see FIGS. 35-A to 35-C).

In the illustrated embodiment, a cylindrical guide wall 896 is provided between the opening 892 in the front wall 826 of the unit frame 822 and the opening 894 in the end wall 838 of the developing device in order to prevent leakage of toners from the inside of the toner cartridges 864a, 864b and 864c at the time of loading. Furthermore, in correspondence to the guided protrusions 890a, 890b and 890c in the toner cartridges 864a, 864b and 864c, three guide portions 896a, 896b and 896c are provided in the main body 835 of the developing device. With reference mainly to FIGS. 35-A to 35-C, the guide portion 896a is provided in correspondence to the guided protrusion 890a in the first type of toner cartridge 864a and difines a guide channel 898a extending in the front-rear direction and guiding the guided protrusion 890a. The guide portion 896b is disposed in correspondence to the guided protrusion 890b in the second type of toner cartridge 864b, and defines a guide channel 898b extending in the front-rear direction and guiding the guided protrusion 890b. The guide portion 896c is disposed in correspondence to the guided protrusion 890c in the third type of toner cartridge 864c, and defines a guide channel 898c extending in the front-rear direction and guiding the guided protrusion 890c. In the illustrated embodiment, as shown in FIG. 32, auxiliary guide channels 900a, 900b, and 900c joining the guide channels 898a, 898b and 898c in the main body 835 of the developing device are provided in the front wall 826 of the unit frame 822 and the guide wall 896.

In the fifth embodiment, once each of the toner cartridges 864a to 864c has been detached from the main body 835 of the developing device, the same type of toner cartridge as that detached cannot substantially be re-loaded into the main body 835 of the developing device. Specifically, three re-loading hampering means 902 are provided in relation to the guide portions 896a, 896b and 896c provided in the main body 835 of the developing device. The re-loading hampering means 902 are of substantially the same structure. With reference to FIGS. 34 and 35-A to 35-C, the re-loading hampering means 902 disposed in relation to the guide member 896a will be described.

The illustrated re-loading hampering means 902 is provided with a loading hampering member 904 which abuts against the guided portion 890a of the toner cartridge 864a and can hamper its reloading. The loading hampering member 904 is formed of a square pillar-like member. On the other hand, a supporting body 906 is mounted on the upper surface of the main body 835 of the developing device (more specifically, the upper surface of a wall defining the guide channel 898a). The illustrated supporting body 906 has a base portion 908 secured to the aforesaid wall of the main body 835 of the developing device and four guiding projections 910 extending upwardly from the upper surface of the base portion 908, and an L-shaped guide surface is defined in the inside surface of each of the four guiding projections 910. The loading hampering member 904 is vertically movably mounted among the four guide projections 910. The loading hampering member 904 is free to move between a non-operating position shown in FIG. 35-A and a hampering position shown in FIG. 35-C. In relation to this, openings 912 and 913 permitting passage of the lower part of the loading hampering member 904 are provided respectively in the base portion 908 of the supporting body 906 and the aforesaid wall of the main body 835 of the developing device. In the illustrated embodiment, stop means for accurately hampering movement of the loading hampering member 904 beyond the hampering position and first locking means for locking the loading hampering member 904 into the hampering position are also provided. The illustrated stop means is comprised of a pair of abutment pieces 914 provided integrally in the upper ends of two opposing side surfaces of the loading hampering member 904 and a pair of abutting portions 916 provided in the supporting body 906 (more specifically, provided between the base portions of the pair of guide projections 910 at left bottom and between the base portions of the pair of guide projections 910 at right top). When the loading hampering member 904 is held at the hampering position, the abutting portions 916 of the supporting body 906 acts on the abutment pieces 914 of the loading hampering member 904 and accurately hamper the downward movement of the hampering member 904 beyond the hampering position. The illustrated first locking means is comprised of depressed portions 917 provided respectively in the upper parts of the two remaining facing side surfaces of the loading hampering member 904 and a pair of engaging members 920 provided integrally in a closure portion 918 whose four corner parts are fixed to the upper surfaces of the four guide projections 910 of the supporting body 906. Each of the pair of engaging members 920 has an elastically deformable base portion, and a claw portion 922 engageable with the depressed portion 910 of the hampering member 904 is provided in the end portion of the engaging member 920. Thus, when the loading hampering member 904 is brought to the hampering position, the claw portions 922 of the pair of engaging members 920 engage the depressed portions 916 of the loading hampering member 904 to lock the hampering member 904 exactly into the hampering position. In the illustrated embodiment, biasing means for biasing the loading hampering member 904 toward the hampering position is also provided. The illustrated biasing means is comprised of a coil spring 924 and received in a receiving depression 926 provided centrally in the loading hampering member 904 and extending downwardly. One end portion of the coil spring 924 acts on the loading hampering member 904, and the other end portion, on the closure portion 918. In the illustrated embodiment, second locking means is also provided for locking the loading hampering member 904 releasably into the non-operating position. The second locking means is comprised of a moving plate 928 mounted on the base portion 908 of the supporting body 906. A guide channel 930 extending slightly upwardly and rearwardly in the front-rear direction (in the rear direction is the direction from right bottom to left top in FIG. 34, and the left or right direction in FIGS. 35-A to 35-C) is formed in the base portion 908 of the supporting body 906. The moving plate 928 is fitted in the guide channel 930 so as to be free to move between a locking position shown in FIG. 35-A and a lock releasing position shown in FIGS. 35-B and 35-C. A projecting actuation piece 932 extending downwardly is provided integrally in one end of the moving plate 928. In the second locking means, when the moving plate 928 is the locking position (it is locked in the locking position when the projecting actuation piece 932 abuts against the opening edge of the opening 913 formed in the aforesaid wall), the moving plate 928 is positioned below the loading hampering member 904 and substantially closes the opening 912 formed in the base portion 908 of the supporting body 906. Hence, the loading hampering member 904 is held at the non-operating position as a result of its lower end abutting against the moving plate 928. When the loading hampering member 904 is at the non-operating position, it is received within the supporting body 906. Therefore, its lower end portion does not project into the guide channel 898*a* defined in the main body 835 of the developing device, and loading of the toner cartridge 964*a* (or 964*b* or 964*c*) is permitted. When the moving plate 928 is at the locking position, the projecting actuation piece 932 projects downwardly into the guide channel 898*a* through the opening 912 formed in the supporting body 906 and the opening 913 formed in the aforesaid wall. Thus, when the first type of toner cartridge 864*a* is loaded, the moving plate 928 is moved toward the lock releasing position by the guided protrusion 890*a* during loading. On the other hand, when the moving plate 928 is held at the lock releasing position in the manner to be described (held in the lock releasing position when the projecting actuation piece 932 has been moved to a position at which it does not substantially project into the guide channel 898*a*), the moving plate 928 moves along the guide channel 930 to open the opening 912 formed in the supporting body 906 and consequently, the loading hampering member 904 is biased toward the hampering position by the action of the coil spring 924. When the loading hampering member 904 is held at the hampering position, the lower part of the loading hampering member 904 projects into the guide channel 898*a* through the opening 912 in the supporting body 906 and the opening 913 in the aforesaid wall as shown in FIG. 35-C, and consequently, loading of the first type of toner cartridge 864*a* is accurately hampered by the loading hampering member 904.

In starting to use the electrostatic copying machine equipped with the process unit described above, the first-type toner cartridge 864*a* (or the second-type toner cartridge 864*b* or the third-type toner cartridge 864*c*) is loaded into the main body 835 of the developing device. The loading is effected by inserting the toner cartridge 864*a* into the upper part of the toner holding chamber 862 through the opening 892 formed in the front wall 826 of the unit frame 822 as can be seen from FIGS. 32, 35-A and 35-B. When the main receptacle body 888 in the toner cartridge 864*a* is positioned at the opening 892 and the guided protrusion 890*a* provided in the main receptacle body 888, in the guide channel 898*a* defined in the main body 835 of the developing device, and then the toner cartridge 864*a* is moved in the loading direction shown by an arrow 934 (FIG. 35-A), the rear end of the guided protrusion 890*a* of the main receptacle body 888 abuts against the projecting actuation piece 932 projecting into the guide channel 898*a*, and the movement of the toner cartridge 864*a* in the loading direction causes the moving plate 928 to recede along the guide channel 930. When the toner cartridge 864*a* is inserted in this manner as far as the holding position shown in FIG. 35-B (at the holding position, the rear surface of the main receptacle body 888 of the toner cartridge 864*a* abuts against the inner surface of the other end surface (not shown) of the developing device), the moving plate 928 is brought to the lock releasing position from the above lock position (it is held at the lock releasing position by the abutment of the lower end of the projecting actuation piece 932 against the upper surface of the guided protrusion 890*a*). As a result, the locked state of the moving plate 928 is cancelled, and the loading hampering member 904 is elastically biased downwardly by the action of the coil spring 924, and as shown in FIG. 35-B, its under surface is maintained in abutment against the guided protrusion 890*a*.

In this embodiment, too, substantially all the toner in the toner cartridge 864*a* is used up when about 2,000 copies have been produced, and at this time, the toner cartridge 864*a* must be replaced by a new one.

Replacement of the toner cartridge 864*a* is carried out by detaching the toner cartridge 864*a* from the main body 835 of the developing device and then loading the second-type toner cartridge 864*b* (or the third-type toner cartrige 864*c*) into the main body 835. The toner cartridge 864*a* may be detached by holding the gripping portion (not shown) provided in the front surface of the main receptacle body 888 and moving the toner cartridge 864*a* in the detaching direction shown by an arrow 936 (FIG. 35-C). Upon detachment in this manner, the loading hampering member 904 is further moved downwardly by the coil spring 924 and held at the hampering position shown in FIG. 35-C by the abutment of its abutment piece 914 on the abutting portion 916 of the supporting body 906. Consequently, the claw portion 922 of the engaging member 920 provided in the closure portion 918 engages the depression 916 formed in the loading hampering member 904, and the loading hampering member 904 is restricted in its vertical movement and locked into the hampering position. Thus, when the first-type toner cartridge 864*a* is loaded into the main body 835 of the developing device and then detached from it, the hampering member 904 disposed in relation to the guide channel 898*a* projects into the guide channel 898*a* and is held at the hampering position. Hence, the first-type toner cartridge 864*a* is accurately prevented from being re-loaded.

When the second-type toner cartridge 864*b* is loaded after detachment of the first-type toner cartridge 864*a*, locking of the loading hampering member 904 (disposed in relation to the guide groove 898*b* of the main body 835 of the developing device) into the non-operating position in the same way is cancelled as stated hereinabove. When the toner in the toner cartridge 864*b* is used up and the toner cartridge 864*b* is detached from the main body 835 of the developing device, the loading hampering member 904 is locked into the hampering position in the same way as stated hereinabove, and consequently, re-loading of the second-type toner cartridge 864*b* is accurately hampered.

When the second-type toner cartridge 864*b* is detached and the third-type toner cartridge 864*c* is loaded, locking of the loading hampering member 904 (disposed in relation to the guide channel 898*c* formed in the main body 835 of the developing device) into the non-operating position is cancelled in the same way as stated hereinabove. When the toner in the third-type toner cartridge 864*c* is used up and the toner cartridge 864*c* is detached from the main body 835 of the developing device, the loading hampering member 904 is locked into the hampering position in the same way as stated hereinabove. Accordingly, loading of the third-type toner cartridge 864*c* is also accurately hampered.

When all three types of toner cartridges 864*a*, 864*b* and 864*c* detachably loaded selectively into the main body 835 of the developing device have been used, all the loading hampering members 904 disposed in relation to the guide channels 898*a*, 898*b* and 898*c* are held at the hampering positions. Thus, it is substantially impossible to load a new toner cartridge 864*a* (or 864*b* or 864*c*) into the main body 835 of the developing device, and the operator can thus learn that the electrostatographic material, and therefore the process unit 816 as a whole, come to the end of their lives. Furthermore, performance of subsequent copying cycles substantially fails.

As shown in the illustrated embodiment, it is preferred to provide the loading hampering member 904 at the front end portion (the right end portion in FIGS. 35-A to 35-C) of the main body 835 of the developing device, and by this arrangement, it can be easily determined whether the loading of the toner cartridge 864*a*, 864*b* or 864*c* into the main body 835 of the developing device is possible or not. It is also possible to mark the lower part of the loading hampering member 904 in colors, for example a red color. In this case, the colored lower part of the loading hampering member 904 at the hampering position projects into the guide channel 898*a*, 898*b* or 898*c* and the projecting colored lower part can be easily observed visually. This makes it easier to know the loadability of the toner cartridge 864*a*, 864*b* or 864*c* without the need to load it actually. In the illustrated embodiment, the loading hampering members 904 are disposed in the main body 835 of the developing device. Alternatively, they may be provided in the unit frame 822 or the guide wall 896.

Modified Embodiment of the Loading Hampering Means and Related Elements

Figure 36:
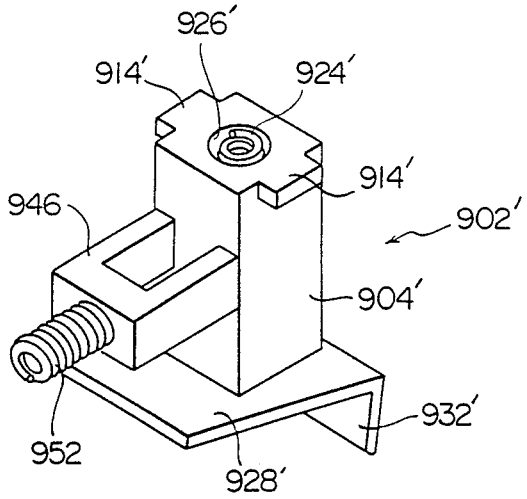
FIG. 36 is a partial perspective view showing the essential parts of a modified example of the re-loading hampering means when the loading hampering member is at a non-operating position.
Figure 37:
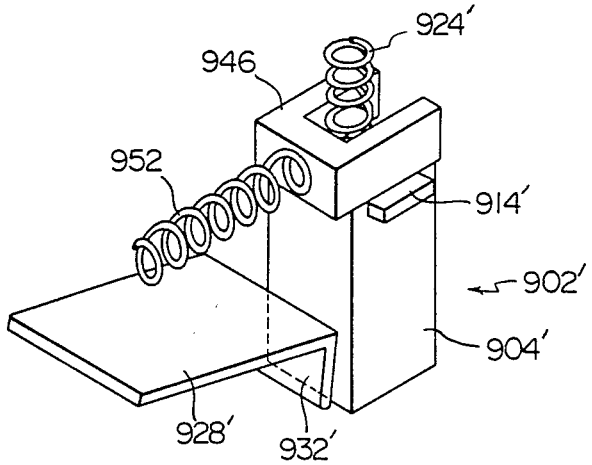
FIG. 37 is a partial perspective view showing the essential parts of the re-loading hampering means of FIG. 36 when the loading hampering member is at a hampering position.

FIGS. 36, 37 and 38-A to 38-C show a modified embodiment of the loading hampering means and its related elements.

With reference mainly to FIGS. 36 and 38-A, the re-loading hampering means 902' in this modified example is provided with a loading hampering member 904' comprised of a square pillar-like member. A supporting body 906' is mounted on the upper surface of the main body 835' of the developing device (more specifically on the upper surface of a wall defining a guide groove 898*a*'). A vertically extending through-hole 940 is formed in the supporting body 906', and the loading hampering member 904' is fitted in the through-hole 940 vertically movably.

In this modified embodiment, too, the loading hampering member 904' is free to move between a non-operating position (the position shown in FIGS. 36 and 38-A) at which it is received in the supporting body 906' and a hampering position (the position shown in FIGS. 37 and 38-C) at which its lower part projects into the guide channel 898*a*' through a depression 942 formed in the lower part of the supporting body 906' and an opening 913' formed in the aforesaid wall. In relation to this, stop means, first locking means and second locking means are also provided.

The stop means in the modified embodiment is comprised of a pair of abutment pieces 914' provided at the upper end of the loading hampering member 904' and an abutting portion (not shown) provided in the inside surface of the through-hole 940 of the supporting body 906' (in the illustrated modified embodiment, depressions 944 (FIGS. 38-B and 38-C) for receiving the pair of abutment pieces 914' vertically movably are provided in the upper part of the through-hole 940, and stepped portions (not shown) located at the lower ends of the depressions 944 constitute the abutting portion). Thus, when the loading hampering member 904' is held at the aforesaid hampering position, the abutment pieces 914' abut the abutting portion provided in the supporting body 906', and the movement of the loading hampering member 904' beyond the hampering position can be accurately arrested.

The first locking means in the modified embodiment is comprised of a movement hampering member 946. A receiving depression 948 extending in the front-rear direction (the left-right direction in FIG. 38-A) and crossing the through-hole 940 is formed in the supporting body 906', and the movement hampering member 946 movable between a non-locking position shown in FIGS. 38-A and 38-B and a locking position shown in FIG. 38-C is received in the receiving depression 948. In the modified embodiment, the open portion of the receiving depression 948 is closed by a member 950, and between the member 950 and the movement hampering member 946 is mounted a coil spring 952 for biasing the movement hampering member 946 toward the locking position. Thus, when the hampering member 904' is at the non-operating position, the front end of the movement hampering member 946 abuts against the side surface of the loading hampering member 904', and the movement hampering member 946 is held at the non-locking position. On the other hand, when the loading hampering member 904' is held at the hampering position in the manner to be described, the movement hampering member 946 passes above the loading hampering member 904' and held in the locking position at which its front end abuts against the bottom surface of the receiving depression 948. As a result, the front end portion of the movement hampering member 946 is positioned within the through-hole 940 and the upward movement of the loading hampering position 904' is accurately arrested, and the loading hampering member 904' is locked into the hampering position. In the modified embodiment, the movement hampering member 946 is composed of a ]-shaped member. Hence, the movement hampering member 946 is held at the locking position without substantially acting on the coil spring 924', and when the movement hampering member 946 is held at the locking position, the coil spring 924' is received centrally in the movement hampering member 946 through an opening present at one end thereof.

The second locking means in the modified embodiment is comprised of a moving plate 928' mounted on the supporting body 906' as in the aforesaid embodiment. A guide channel 930' inclined slightly upwardly, and also rearwardly in the front-rear direction, is formed in the supporting body 906', and the moving plate 928' is fitted movably in the guide channel 930'. At one end of the moving plate 928', a downwardly projecting actuation piece 932' is provided. In the second locking means of the above structure, when the moving plate 928' is at the above locking position shown in FIG. 38-A, it is positioned below the loading hampering member 904'. Hence, the loading hampering member 904' is held at the non-operating position by the abutment of its lower end against the moving plate 928'.

On the other hand, when the moving plate 928' is held at the above non-locking position in the manner to be stated below, the lower part of the through-hole 940 formed in the supporting body 906' is opened and the loading hampering member 904' is biased toward the above hampering position.

This modified embodiment is also provided with the coil spring 924' constituting biasing means for biasing the loading hampering member 904' toward the hampering position. The coil spring 924' is received in the receiving depression 926' formed in the loading hampering member 904' One end of the coil spring 924' acts on the loading hampering member 904', and its other end, on the closure portion 918' fixed to the supporing body 906'.

With the loading hampering means 902' of this modified embodiment, the same operation and result as in the aforesaid embodiment can be achieved. For example, when the first-type toner cartridge **864*a'* is moved in the direction shown by arrow 834' (FIG. 38-A) through the opening 892' formed in the front wall 826' of the unit frame 822' as shown in FIG. 38-A, the rear end of the guided protrusion 890*a'* of the main receptacle body 888' acts on the actuation piece 932' projecting into the guide channel 898', and as the toner cartridge 864*a'* moves in the loading direction shown by arrow 934', the moving plate 928' recedes along the guide channel 930'. When the toner cartridge 864' is inserted as far as the holding position shown in FIG. 38-B, the moving plate 928' is brought to the non-locking position from the locking position. As a result, the locked state of the moving plate 928' is cancelled, and the loading hampering member 904' is elastically biased downwardly by the action of the coil spring 924' and maintained in a state in which its under surface abuts on the upper surface of the guided protrusion 890*a'***.

When the toner in the toner cartridge **864*a'* is used up and the toner cartridge 864*a'* is detached from the main body 835' of the developing device by moving it in the detaching direction shown by arrow 936' (FIG. 35-B), the loading hampering member 904' is moved further downwardly by the coil spring 924' and held at the hampering position shown in FIG. 38-C by the action of an abutting portion (not shown) provided in the supporting body 906' on the abutment piece 914' of the loading hampering member 904'. As a result, the movement hampering member 946 is brought to the locking position as shown in FIG. 38-C from the non-locking position, and the loading hampering member 904'** is accurately locked into the hampering position.

With the loading hampering means 902' in this modified embodiment, too, when the toner cartridge **864*a'*, 864*b'*, or 864*c'* is loaded into the main body 835' of the developing device and then detached from it, the loading hampering member 904' disposed in relation to the guide channel 898*a'*, 898*b'* or 898*c'* projects into the guide channel 898*a'*, 898*b'* or 898*c'* and held at the hampering position, re-loading of the same type of a toner cartridge 864*a*, 864*b* or 864*c* as the one detached from the main body 835'** of the developing device can be accurately hampered.

In an alternative arrangement, a permanent magnet may be provided in each of the toner cartridges **864*a*, 864*b* and 864*c*, and a loading hampering member movable between a received position and a projecting position may be provided in correspondence to each permanent magnet. In this arrangement, when the toner cartridge 864*a*, 864*b* or 864*c* is detached from the main body 835'** of the developing device, the loading hampering member is brought from the received position to the projecting position by the action of the corresponding permanent magnet with the detaching movement of the toner cartridge. This arrangement also makes it possible to hamper re-loading of the same type of toner cartridge.

While the image-forming machine of this invention has been described with reference to the various embodiments of an electrostatic copying machine as one example, it should be understood that the invention is not limited to these specific embodiments, and various changes and modifications are possible without departing from the spirit and scope of the invention described and claimed herein.

For example, in the embodiment described above, three toner cartridges are successively loaded until the service life of the electrostatographic material or the process unit, comes to an end. If desired, two or at least four toner cartridges may be successively used till the end of the life of the process unit. When the number of toner cartridges to be replaced is small, the toner cartridges will become relatively large in size. On the other hand, when the number of toner cartridges is large, the replacing operation will become troublesome.

The above embodiments are directed to the use of a two-component developer composed of a carrier and a toner in the developing device. This is not limitative, and the present invention may be equally applied to a developing device in which a one-component developer composed only of a toner is used.

What we claim is:

1. A cleaning device for removing toner remaining on an electrostatographic surface of an image bearing member within a process unit of an image-forming machine, the image-forming machine having a frame member for detachably mounting the process unit, the process unit including a developing device for developing a latent electrostatic image found on the electrostatographic surface, said cleaning device comprising:

toner removing means adapted to be selectively held at an operating position at which said toner removing means acts on the electrostatographic surface and a non-operating position at which said toner removing means is removed from the electrostatographic surface;

means for normally holding said toner removing means at the operating position; and a unit holding box for receipt of said process unit, said unit holding box including operating means operable on said toner removing means when said process unit is received in said unit holding box for bringing said toner removing means to the non-operating position when the process unit is detached from the frame member and held in the unit holding box.

2. The cleaning device of claim 1 wherein the toner removing means comprises a cleaning blade and means pivotably mounting the cleaning blade for pivoting between the operating position and the non-operating position.

3. The cleaning device of claim 2 wherein the toner removing means further comprises a rotatably supported rotating shaft having the cleaning blade mounted thereon, and an actuation member mounted on the rotating shaft, and wherein the unit holding box includes an actuation protrusion responsive to the process unit being held in the unit holding box for acting on the actuation member to hold the cleaning blade in the non-operating position.

4. The cleaning device of claim 2 wherein the toner removing means further comprises elastic biasing means for elastically biasing the cleaning blade toward the operating position.

5. A developing device for an image-forming machine, said developing device comprising:

a main body;

applicator means mounted on the main body for applying a toner to a latent electrostatic image;

a plurality of toner cartridges adapted to be selectively loaded detachably into the main body;

loading hampering means responsive to the loading and/or detachment of a predetermined number of the plurality of toner cartridges into and from the main body for assuming a hampering position at which the loading hampering means hampers loading of a toner cartridge into the main body.

6. The developing device of claim 5 wherein the loading hampering means includes a hampering plate adapted to be moved a predetermined amount in response to the loading and/or detachment of each toner cartridge, the hampering plate being held at the hampering position in response to loading and/or detaching of a predetermined number of toner cartridges into and from the main body, the hampering plate in the hampering position hampering loading of a toner cartridge into the main body.

7. The developing device of claim 6 wherein the loading hampering means further includes means rotatably mounting the hampering plate and permitting the hampering plate to rotate through a predetermined angle in response to the loading and/or detachment of each of the toner cartridges, the hampering plate in the hampering position abutting against part of a toner cartridge at the time of attempting of loading such toner cartridge into the main body.

8. The developing device of claim 7 wherein each of the toner cartridges includes a projecting portion, wherein the hampering plate has circumferentially spaced cuts corresponding in number to the number of toner cartridges to be loaded into the main body, each of the toner cartridges being loadable into the main body by the passing of the projecting portion of such toner cartridge through a corresponding cut in the hampering plate, and wherein when the hampering plate is held at the hampering position, the projecting portion of the toner cartridge abuts against part of the hampering plate during loading.

9. The developing device of claim 8 wherein the projecting portions of the toner cartridges are of different types, the hampering plate has cuts corresponding to the projecting portions of the toner cartridges, and the projecting portion in each of the toner cartridges can pass through only a corresponding cut formed in the hampering plate.

10. The developing device of claim 7 wherein the loading hampering means includes locking means releasably holding the hampering plate at a position in which the hampering plate is rotated through a predetermined angle in response to the loading and/or detachment of each of the toner cartridges.

11. The developing device of claim 6 wherein the hampering plate includes cartridge loading display means.

12. The developing device of claim 11 wherein the cartridge loading display means displays the number of toner cartridges that have been loaded into the main body.

13. The developing device of claim 11 wherein the cartridge loading display means displays the number of the toner cartridge next to be loaded in the main body.

14. A developing device for an image-forming machine, said developing device comprising a main body; applicator means mounted on said main body for applying toner to a latent electrostatic image on an image-bearing member in the image-forming machine; a plurality of toner cartridges adapted to be selectively loaded into said main body, each toner cartridge being of a different type; and means responsive to a toner cartridge of one of the different types being loaded into said main body and then detached therefrom for preventing another toner cartridge of the one type from subsequently being loaded into said main body.

15. The developing device of claim 14 wherein each of the toner cartridges includes a loading hampering member and the main body includes means responsive to loading of a toner cartridge into the main body for retaining in the main body the loading hampering member of the loaded toner cartridge, whereby when a toner cartridge ia loaded into, and then detached from, the main body, subsequent loading into the main body of the same type of toner cartridge is hampered.

16. The developing device of claim 15 wherein:

the loading hampering members are disposed at different relative sites on the toner cartridges; and said main body includes a plurality of receiving portions corresponding to the loading hampering members of different types of toner cartridges, so that when a toner cartridge of the one type is loaded into, and then detached from, the main body, the loading hampering member of the loaded toner cartridge is received in the corresponding receiving portion and thus remains in the main body of the developing device, whereby subsequent loading of the one type of toner cartridge is hampered.

17. The developing device of claim 16 wherein each of the toner cartridges includes a holding receptacle for holding toner, and each loading hampering member is provided integrally in the holding receptacle, so that when a toner cartridge is detached from the main body, part of the loading hampering member of the detached toner cartridge is broken in response to the movement of the corresponding holding receptacle in the detaching direction and therefore remains in the corresponding receiving portion.

18. The developing device of claim 17 wherein each loading hampering member has a connecting portion connected to the corresponding holding receptacle and an engagement portion at the end of the connecting portion; each receiving portion includes an engaging portion capable of engaging the corresponding engagement portion; and each connecting portion includes a weakened portion.

19. The developing device of claim 14 wherein the main body of the developing device includes reloading hampering means corresponding to each of the toner cartridges, such that when a toner cartridge of the one type is detached from the main body, the re-loading hampering means is held in a hampering state and thus hampers re-loading of a toner cartridge of the one type.

20. The developing device of claim 19 wherein each toner cartridge includes a guided portion positioned at a respective different site; wherein said main body includes a plurality of guiding portions corresponding to the guided portions; and wherein the re-loading hampering means is operative in response to each of the guiding portions.

21. The developing device of claim 19 wherein each of said re-loading hampering means includes a loading hampering member which is free to move between a non-operating position, at which it does not act on the corresponding toner cartridge, and a hampering position, at which it acts on the corresponding toner cartridge and hampers its re-loading into the main body of the developing device; and the loading hampering member is held at the hampering position when the corresponding toner cartridge is detached from the main body of the developing device.

22. The developing device of claim 21 wherein each of the re-loading hampering means includes first locking means for locking the loading hampering member into the hampering position.

23. The developing device of claim 21 wherein each of the re-loading hampering means includes second locking means for releasably locking the loading hampering member at the non-operating position, such that when the corresponding toner cartridge is loaded into the main body, the second locking means releases the loading hampering member from locking.

24. The developing device of claim 14 wherein:

the main body of the developing device includes means defining a developing chamber, and means defining a toner holding chamber having a discharge opening communicating with the developing chamber;

wherein the applicator means is disposed in the developing chamber; and wherein each of the toner cartridges is adapted to be selectively loaded into the toner holding chamber.

25. A developing device as claimed in claim 14 wherein said plurality of toner cartridges together hold a total amount of toner substantially equal to that required for making copies on the image-forming machine until the useful life of the image-bearing member ends.

26. A developing device for an image forming machine, said developing device comprising:

a main body member adapted to be mounted on an associated image processing unit provided with image-bearing means having a surface with an electrostatographic material thereon;

a plurality of toner cartridges, each toner cartridge adapted to be selectively loaded sequentially into said main body member, said plurality of toner cartridges together holding a total amount of toner substantially equal to that required for making of copies by the image processing unit until the useful life of the image-bearing means ends;

display means for displaying an indication of the one of said plurality of toner cartridges loaded in said main body member to indicate the one of said plurality of sequentially loaded toner cartridges that is in said main body member and thus to provide an approximate indication of the remaining useful life of said developing device.

27. The developing device of claim 26 wherein:

each of said toner cartridges includes detection means;

said main body member includes detecting means for detecting the detection means of said one of said plurality of toner cartridges loaded in said main body member; and said toner means displays an indication of the detected detection means.

28. The developing device of claim 26 wherein said display means includes moving means responsive to the loading and unloading of said toner cartridges into said main body member, and said display means is on said moving means.

29. An image-forming machine comprising:

image-forming means including image-bearing means having a surface with electrostatographic material thereon;

means for forming a latent electrostatic image on said electrostatographic surface;

a developing device for developing the latent electrostatic image, said developing device including:

(1) a main body member;

(2) applicator means mounted on said main body member for applying toner to the latent electrostatic image; and (3) a plurality of toner cartridges, each toner cartridge adapted to be selectively loaded in a predetermined sequence into said main body member;

cartridge discriminating means for generating a cartridge discrimination signal indicative of the one of said plurality of toner cartridges loaded in said main body member to indicate the one of said plurality of sequentially loaded toner cartridges that is in said main body member and thus to provide an approximate indication of the remaining useful life of said developing device; and means for adjusting the image-forming conditions on the basis of the cartridge discrimination signal.

30. An image-forming machine as claimed in claim 29 wherein said plurality of toner cartridges together hold a total amount of toner substantially equal to that required for making of copies on said image forming means until the useful life of said image bearing means ends.

31. The image-forming machine of claim 29 wherein:

said main body member includes means defining a developing chamber having said applicator means disposed therein, and means defining a toner holding chamber having a toner discharge opening communicating with the developing chamber; and said toner cartridges are adapted to be selectively loaded sequentially into the toner holding chamber.

32. The image-forming machine of claim 29 wherein said cartridge discriminating means comprises detection means provided in each of said toner cartridges, and detecting means provided in said main body member for detecting said detection means.

33. The image-forming machine of claim 32 wherein:

said detecting means includes a plurality of terminals provided in said main body member; and said detection means comprises a linking member for linking said terminals to each other.

34. The image-forming machine of claim 29 wherein said image-forming condition adjusting means adjusts a development bias voltage applied to said applicator means.

35. The image-forming machine of claim 29 wherein:

said latent electrostatic image forming means includes a charging corona discharger for applying a charge to said electrostatographic surface and document illuminating lamp means for projecting the image of a document onto said electrostatographic surface; and said image-forming condition adjusting means adjusts said document illuminating lamp means to control the intensity of light projected therefrom onto said electrostatographic surface.

36. The image-forming machine of claim 35 wherein said image-forming condition adjusting means adjusts a voltage applied to said document illuminating lamp means.

37. An image-forming machine comprising:

image-bearing means having a surface with electrostatographic material thereon;

means for forming a latent electrostatic image on the electrostatographic surface;

a developing device for developing the latent electrostatic image, said developing device comprising a main body, applicator means mounted on the main body for applying a toner to the latent electrostatic image, and a plurality of toner cartridges adapted to be selectively loaded into the main body;

first detecting means for producing a cartridge replacement signal when the amount of toner in a toner cartridge loaded into the main body for applying to the latent electrostatic image becomes excessively small;

second detecting means responsive to detecting of a specified one of the toner cartridges for producing a final cartridge signal; and life signal producing means responsive to simultaneous production of the cartridge replacement signal and the final cartridge signal for producing a life signal indicating that the life of the electrostatographic material has substantially come to an end.

38. The image-forming machine of claim 37 further comprising a life display lamp, and means responsive to the lief signal for turning on said life display lamp.

39. The image-forming machine of claim 37 further comprising means responsive to the life signal for stopping operation of said machine.

40. The image-forming machine of claim 37 wherein:

said main body includes means defining a developing chamber having the applicator means disposed therein, and means defining a toner holding chamber having a toner discharge opening communicating with the developing chamber; and said toner cartridges are adapted to be selectively loaded into the toner holding chamber.

41. The image-forming machine of claim 40 wherein the first detecting means includes means for detecting the concentration of toner in the developing chamber, and means responsive to detection of an excessively small concentration of toner for producing the cartridge replacement signal.

42. The image-forming machine of claim 37 wherein the second detecting means includes final cartridge detection means on the specified one of the plurality of toner cartridges and cartridge detecting means in the main body for detecting the final cartridge detection means.

43. The image-forming machine of claim 37 wherein the specified one of the plurality of toner cartridges includes securing means substantially preventing said specified one of said plurality of toner cartridge from being detached from the main body after being loaded therein.

44. The image-forming machine of claim 43 wherein the main body includes means defining a toner holding chamber, and locking means cooperating with the securing means for holding the specified one of said plurality of toner cartridges in a holding position in the toner holding chamber and substantially preventing its removal therefrom.

45. The image-forming machine of claim 44 wherein the locking means includes an engagement portion and the securing means includes a first engaging portion, the engagement portion engaging the first engaging portion when the specified one of said plurality of toner cartridges is loaded into the toner holding chamber and held at the holding position to substantially prevent disengagement thereof.

46. The image-forming machine of claim 45 wherein each tone cartridge except the specified one of the plurality of toner cartridges includes a second engaging portion releasably engageable with the engagement portion when said each of the toner cartridges is loaded into the toner holding chamber and held at the holding position.

47. An image-forming machine comprising:

image-bearing means having a surface with electrostatographic material thereon;

means for forming a latent electrostatic image on the electrostatographic surface;

a developing device for developing the latent electrostatic image, said developing device comprising a main body, applicator means mounted on the main body for applying a toner to the latent electrostatic image, and a plurality of toner cartridges adapted to be selectively loaded into the main body;

first detecting means for producing a cartridge replacement signal when the amount of toner in a toner cartridge loaded into the main body becomes too small;

second detecting means responsive to detecting of a selected one of said plurality of toner cartridges for producing a final cartridge signal;

third detecting means responsive to detection of a number of rotations of the image-bearing member exceeding a predetermined value for producing a rotation signal; and life signal producing means responsive to simultaneous production of the final cartridge signal and the cartridge replacement signal or simultaneous production of the final cartridge signal and the rotation signal for producing a life signal indicating that the life of the electrostatographic surface has substantially come to an end.

48. The image-forming machine of claim 47 wherein: said main body includes means defining a developing chamber having the applicator means disposed therein, and means defining a toner holding chamber having a toner discharge opening communicating with the developing chamber; and the toner cartridges are adapted to be selectively loaded into the toner holding chamber.

* * * * *